US010350128B2

(12) United States Patent
Nagata et al.

(10) Patent No.: US 10,350,128 B2
(45) **Date of Patent: *Jul. 16, 2019**

(54) ASSIST WEAR ITEM, CONTROL METHOD FOR CONTROLLER OF ASSIST WEAR ITEM, AND RECORDING MEDIUM

(71) Applicant: Panasonic Intellectual Property Management Co., Ltd., Osaka (JP)

(72) Inventors: Takayuki Nagata, Osaka (JP); Stephen William John, Kyoto (JP); Katsuhiko Asai, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 611 days.

This patent is subject to a terminal disclaimer.

(21) Appl. No.: 15/012,578

(22) Filed: Feb. 1, 2016

(65) Prior Publication Data

US 2016/0242987 A1 Aug. 25, 2016

(30) Foreign Application Priority Data

Feb. 19, 2015 (JP) ..... 2015-031100

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0244* (2013.01);
(Continued)

(58) Field of Classification Search
CPC .... A61H 1/008; A61H 3/00; A61H 2201/165; A61H 2201/5023; A61H 2201/5028;
(Continued)

(56) References Cited

U.S. PATENT DOCUMENTS

2003/0125781 A1* 7/2003 Dohno ..... A63B 21/00181 607/75
2007/0265140 A1* 11/2007 Kim ..... A61H 1/02 482/8

(Continued)

FOREIGN PATENT DOCUMENTS

JP 2002-120183 4/2002
JP 2003-250842 9/2003

(Continued)

OTHER PUBLICATIONS

Hong-Ki Kim, Seunggun Lee, Kwang-Seok Yun, Capacitive tactile sensor array for touch screen application, Jan. 13, 2010, Elsevie, pp. 1-7.*

*Primary Examiner* — Justine R Yu
*Assistant Examiner* — Zachary E Love
(74) *Attorney, Agent, or Firm* — Wenderoth, Lind & Ponack, L.L.P.

(57) ABSTRACT

An assist wear item is worn on a portion of a living body and has an inner surface brought into contact with the portion. The assist wear item includes assisting actuators, contact sensors, and a controller. Each assisting actuator is driven to expand and contract. The assisting actuators are linearly arranged along an expansion/contraction direction of a muscle at the portion. Each contact sensor detects a contact with an outer surface of the assist wear item. If the controller receives a detection result indicating a first contact from a first contact sensor among the contact sensors and receives a detection result indicating a second contact from a second contact sensor within a first time period after reception of the detection result indicating the first contact, the controller increases or decreases a driving power of expansion/contraction driving of an assisting actuator corresponding to the second contact sensor.

20 Claims, 34 Drawing Sheets

(52) U.S. Cl.
CPC ... *A61H 1/0277* (2013.01); *A61H 2201/1207* (2013.01); *A61H 2201/1238* (2013.01); *A61H 2201/165* (2013.01); *A61H 2201/5002* (2013.01); *A61H 2201/5061* (2013.01); *A61H 2230/605* (2013.01)

(58) Field of Classification Search
CPC .. A61H 2201/5046; A61H 3/008; A61H 3/06; G06F 3/044; B25J 9/00; B25J 11/00
See application file for complete search history.

(56) References Cited

U.S. PATENT DOCUMENTS

| | | | | |
|---|---|---|---|---|
| 2010/0249675 | A1 | 9/2010 | Fujimoto et al. | |
| 2014/0012164 | A1* | 1/2014 | Tanaka | B25J 9/0006 601/35 |
| 2014/0288664 | A1 | 9/2014 | Miyazawa | |
| 2016/0058646 | A1* | 3/2016 | Seo | A61H 3/00 623/32 |

FOREIGN PATENT DOCUMENTS

| | | |
|---|---|---|
| JP | 2009-112578 | 5/2009 |
| JP | 2010-176174 | 8/2010 |
| JP | 2013-146328 | 8/2013 |
| JP | 2013-170391 | 9/2013 |
| JP | 2014-184027 | 10/2014 |
| JP | 2015-128520 | 7/2015 |

* cited by examiner

FIG. 4C

| PHASE | TIME PERIOD | FIRST SENSOR | SECOND SENSOR |
|---|---|---|---|
| E | t1 | 1 | 0 |
| | t2 | 2 | 0 |
| | t3 | 3 | 0 |
| | t4 | 2 | 0 |
| | --- | | |

FIG. 4D

| PHASE | TIME PERIOD | ACTUATOR | | | | |
|---|---|---|---|---|---|---|
| | | A | B | C | D | E |
| E | t1 | 0 | 0 | 1 | 0 | 0 |
| | t2 | 0 | 1 | 2 | 1 | 0 |
| | t3 | 0 | 2 | 3 | 2 | 0 |
| | t4 | 0 | 1 | 1 | 1 | 0 |
| | --- | | | | | |

| THE NUMBER OF TOUCHES | SET VALUE OF ASSIST POWER |
|---|---|
| 1 | +10% |
| 2 | +20% |
| 3 | +30% |
| 4 | +40% |
| 5 OR MORE | +50% |

| AMOUNT OF CHANGE IN EXPANSION/CONTRACTION LENGTH | FIRST THRESHOLD |
|---|---|
| 0 TO 10% | A |
| 10 TO 30% | 1.5A |
| 30 TO 50% | 2.0A |
| 50% OR MORE | 3.0A |

ASSIST WEAR ITEM, CONTROL METHOD FOR CONTROLLER OF ASSIST WEAR ITEM, AND RECORDING MEDIUM

BACKGROUND

1. Technical Field

The present disclosure relates to an assist wear item, a control method for a controller of an assist wear item, and a recording medium that are capable of easily adjusting assist power when the assist wear item is worn on a living body and movements of the living body are assisted by supporting generation power of the living body by using the assist power.

2. Description of the Related Art

There is a human body movement assisting apparatus capable of assisting movements in daily life, in which an attachment made of meshed cloth or the like is attached to a joint portion such as a knee of a human body and generation power of the human body is supported by driving an actuator provided on the attachment (see, for example, Japanese Unexamined Patent Application Publication No, 2003-250842).

SUMMARY

However, the related art requires further improvements to easily adjust an increase or decrease in the driving power of expansion/contraction driving of assisting actuators of an assist wear item.

One non-limiting and exemplary embodiment provides an assist wear item capable of easily adjusting an increase or decrease in the driving power of expansion/contraction driving of assisting actuators in the case of assisting movements of a living body.

In one general aspect, the techniques disclosed here feature an assist wear item that is worn on a portion of a living body and that has an inner surface which is brought into contact with the portion. The assist wear item includes a plurality of assisting actuators each of which is driven to expand and contract, the plurality of assisting actuators being linearly arranged along an expansion/contraction direction of a muscle at the portion in a case where the assist wear item is worn on the portion; a plurality of contact sensors each of which detects a contact with an outer surface of the assist wear item; and a controller that, if the controller receives a detection result indicating a first contact from a first contact sensor among the plurality of contact sensors and receives a detection result indicating a second contact from a second contact sensor among the plurality of contact sensors within a first time period after reception of the detection result indicating the first contact, increases or decreases a driving power of expansion/contraction driving of an assisting actuator corresponding to the second contact sensor among the plurality of assisting actuators. If the controller receives a detection result indicating a contact with the outer surface of the assist wear item from the first contact sensor during expansion/contraction driving of the assisting actuator, the controller determines that the contact with the outer surface of the assist wear item is the first contact.

According to an embodiment of the present disclosure, an increase or decrease in the driving power of expansion/contraction driving of assisting actuators can be easily adjusted in the case of assisting movements of a living body.

It should be noted that general or specific embodiments may be implemented as a system, a method, an integrated circuit, a computer program, a computer-readable recording medium, or any selective combination thereof. The computer-readable recording medium includes a nonvolatile recording medium, for example, a compact disc-read only memory (CD-ROM) or the like.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 4C is an explanatory diagram of signals in a certain phase in a time response pattern used for the determination in FIG. 4B;

FIG. 4D is an explanatory diagram of an example of driving assisting actuators in a certain phase based on the determination in FIG. 4B;

DETAILED DESCRIPTION

Figure 1:
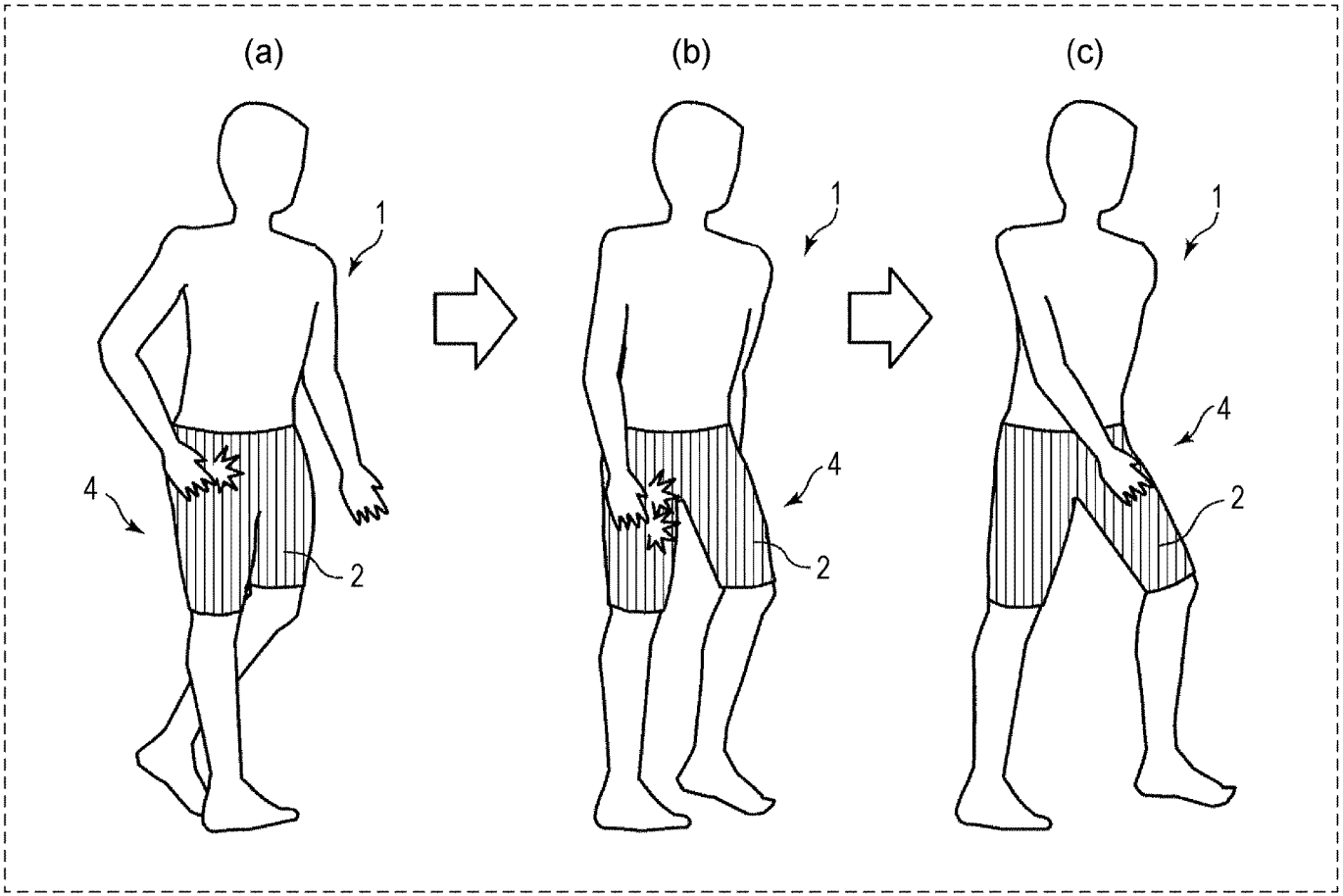
FIG. 1 is a schematic explanatory diagram illustrating movements of a user in a state where the user is wearing an assist wear item according to an embodiment of the present disclosure.

Hereinafter, an embodiment of the present disclosure will be described in detail with reference to the attached drawings. Before describing the embodiment of the present disclosure, various aspects of the present disclosure will be described.

An assist wear item according to an aspect of the present disclosure is an assist wear item that is worn on a portion of a living body and that has an inner surface which is brought into contact with the portion, including:

- a plurality of assisting actuators each of which is driven to expand and contract, the plurality of assisting actuators being linearly arranged along an expansion/contraction direction of a muscle at the portion in a case where the assist wear item is worn on the portion;
- a plurality of contact sensors each of which detects a contact with an outer surface of the assist wear item; and
- a controller that, if the controller receives a detection result indicating a first contact from a first contact sensor among the plurality of contact sensors and receives a detection result indicating a second contact from a second contact sensor among the plurality of contact sensors within a first time period after reception of the detection result indicating the first contact, increases or decreases a driving power of expansion/contraction driving of an assisting actuator corresponding to the second contact sensor among the plurality of assisting actuators.

If a dedicated terminal (an information terminal, an input/output device, or the like), is used to increase or decrease the driving power of expansion/contraction driving of assisting actuators, it is necessary to specify the part where the driving power is to be increased or decreased and input an amount of increase or decrease in the driving power every time the driving power is to be increased or decreased, which is inconvenient.

According to the above-described aspect, a driving power of expansion/contraction driving of an assisting actuator is increased or decreased if a detection result indicating a second contact is received from the second contact sensor that is arranged within a certain range from the first contact sensor that has detected a first contact.

Accordingly, a user, which is an example of a living body that wears the assist wear item, is able to increase or decrease the driving power of expansion/contraction driving of the assisting actuators only by touching the assist wear item at the portion where the driving power is to be increased or decreased, that is, without using the dedicated terminal.

Here, the assist wear item is worn by a user who performs movements or the like, and thus the outer surface of the assist wear item often receives a contact. For example, it is possible that a user's hand accidentally touches the assist wear item during movements. In this case, if the driving power is increased or decreased every time the assist wear item receives a contact, an increase or decrease in the driving power not intended by the user may occur.

According to the above-described aspect, the driving power is increased or decreased if a detection result indicating a first contact is received from the first contact sensor and a detection result indicating a second contact is received from the second contact sensor that is arranged within a certain range from the first contact sensor within the first time period after reception of the detection result indicating the first contact. This is because, if the user accidentally touches the assist wear item, there is a low probability that a second contact as the next contact is detected in a short time period after the unintended first contact. On the other hand, when the user touches the assist wear item with his/her intention, that is, when the user wants to increase or decrease the driving power, the first contact and the second contact following the first contact are detected in a short time period. With use of this, in the above-described aspect, a detection result indicating a second contact is received, from the second contact sensor that is arranged within a certain range from the first contact sensor that has detected a first contact, only within the first time period after reception of a detection result indicating the first contact. Accordingly, an increase or decrease in the driving power of the assisting actuators not intended by the user can be prevented.

In the above-described aspect, if the controller receives a detection result indicating a contact with the outer surface of the assist wear item from the first contact sensor during expansion/contraction driving of the assisting actuator, the controller may determine that the contact with the outer surface of the assist wear item is the first contact.

In many cases, when the user wants to increase or decrease the driving power of expansion/contraction driving of the assisting actuators, the user wants to fine-tune assist power when the user is wearing the assist wear item and performing movements while receiving the assist power (the driving power of expansion/contraction driving the assisting actuators) from the assist wear item. In other words, when the user is not receiving assist power from the assist wear item, it is rare that the user wants to fine-tune the assist power, that is, wants to increase or decrease the driving power of expansion/contraction driving of the assisting actuators.

According to the above-described aspect, if the controller receives a detection result indicating a contact with the outer surface of the assist wear item from the first contact sensor during expansion/contraction driving of the assisting actuator, the controller determines that the contact with the outer surface of the assist wear item is the first contact. Thus, a detection result indicating the first contact is received in a situation where the user wants to fine-tune the assist power, that is, while the user is receiving the assist power from the assist wear item. As a result, in a situation where the user is less likely to want to increase or decrease the driving power of expansion/contraction driving of the assisting actuators, determination of reception of a detection result indicating the first contact is prevented from being made, and accordingly an increase or decrease in the driving power not intended by the user can be prevented.

In the above-described aspect, if the controller receives a detection result indicating the second contact during expansion driving of the assisting actuator, the controller may increase a driving power of the expansion driving of the assisting actuator.

In the above-described aspect, if the controller receives a detection result indicating the second contact during contraction driving of the assisting actuator, the controller may increase a driving power of the contraction driving of the assisting actuator.

In the above-described aspect, if the controller receives a detection result indicating the second contact from the second contact sensor a plurality of times, the controller may increase a width of increase or decrease in the driving power in accordance with a total number of the plurality of times.

According to the above-described aspect, when a user wants to increase the driving power, the user only has to touch the assist wear item until a desired driving power can be obtained, and thus is able to perform an input operation more intuitively.

In the above-described aspect, the controller may determine a detection result indicating the second contact received within a second time period from when a detection result indicating the second contact is first received to be valid.

If the time interval in which it is determined that a detection result indicating the second contact is valid is long, the driving power may be increased or decreased if the user has finished a second contact and after that the user unintendedly touches the assist wear item.

According to the above-described aspect, a detection result indicating the second contact received within the second time period from when a detection result indicating the second contact is first received is determined to be valid. Accordingly, when the user unintendedly touches the assist wear item, an increase or decrease in the driving power can be prevented.

In the above-described aspect, an increase in the driving power of the expansion/contraction driving of the corresponding assisting actuator may be controlled by changing an expansion/contraction length of the corresponding assisting actuator.

In the above-described aspect, an increase in the driving power of the expansion/contraction driving of the corresponding assisting actuator may be controlled by changing a spring constant of the corresponding assisting actuator.

In the above-described aspect, the second contact sensor may be identical to the first contact sensor.

In general, a user who performs an input operation for increasing or decreasing the driving power of expansion/contraction driving of the assisting actuators without using the terminal wants to specify the portion of the assist wear item for which the driving power is to be increased or decreased and then wants to input the amount of increase or decrease in the driving power.

According to the above-described aspect, a first contact and a second contact are detected by the same contact sensor. Thus, if the user touches a certain position of the assist wear item and if the user touches the same position within the first time period after that, the driving power at the touched position is increased or decreased. As a result, the user is able to perform an intuitive input operation of touching a portion for which the driving power is to be increased or decreased and then touching the portion in accordance with the amount to be increased or decreased.

In the above-described aspect, the second contact sensor may be different from the first contact sensor.

In a case where some contacts not intended by a user are sequentially performed on the assist wear item, it is often the case that the contacts are performed at the same portion of the assist wear item. For example, in a case where a user who is wearing assist pants as a kind of assist wear is walking while swinging his/her arms, the user's hand may come into contact with the same portion of the assist pants sequentially.

The user who wears the assist wear item is often an aged person having weakened muscles. To reliably detect even a weak touch of such an aged person having weakened muscles, it is necessary to sufficiently decrease the threshold of the sensor for detect a contact. In this case, it is estimated that a first contact and a second contact are sequentially detected by the same contact sensor often.

As described above, in a case where a first contact and a second contact are detected by the same contact sensor, the contacts are estimated to be contacts not intended by the user. According to the above-described aspect, a first contact is detected by the first contact sensor and a second contact is detected by the second contact sensor, and thereby the driving power of expansion/contraction driving of the assisting actuator corresponding to the second contact sensor is increased or decreased. That is, the user needs to first touch a portion different from a portion where the driving power is to be increased or decreased, and accordingly an increase or decrease in the driving power not intended by the user can be effectively prevented.

In the above-described aspect, the plurality of contact sensors may be a plurality of pressure sensors each of which detects a pressure value of a pressure applied to the outer surface of the assist wear item, and If the controller receives a detection result indicating a pressure value which is a first threshold or larger from each of the plurality of pressure sensors, the controller may determine that a contact with the outer surface of the assist wear item has been detected.

According to the above-described aspect, the plurality of pressure sensors are used as the plurality of contact sensors. Here, when the user wants to increase or decrease the driving power of expansion/contraction driving of the assisting actuators, the user is likely to touch the assist wear item more strongly than in the case of accidentally touching it. Thus, for example, if the first threshold is set to a value equal to or larger than a pressure value that is detected when the user accidentally touches the assist wear item, an increase or decrease in the driving power can be prevented when the user accidentally touches the assist wear item.

In the above-described aspect, if the controller receives, as a detection result indicating the first contact, a detection result indicating a first pressure value which is a second threshold or larger from a first pressure sensor among the plurality of pressure sensors and receives, as a detection result indicating the second contact, a detection result indicating a second pressure value which is a third threshold or larger from a second pressure sensor among the plurality of pressure sensors within the first time period after reception of the detection result indicating the first pressure value, the controller may increase or decrease a driving power of expansion/contraction driving of an assisting actuator corresponding to the second pressure sensor among the plurality of assisting actuators.

According to the above-described aspect, the first pressure sensor receives a pressure value which is the second threshold or larger as a first contact, and the second pressure sensor receives a pressure value which is the third threshold or larger as a second contact. That is, the threshold for detecting a contact is different between the first pressure sensor and the second pressure sensor. This is because it is considered that a first contact as an initial contact and a second contact subsequent to the first contact have different pressure values. For example, the first contact, which is an initial contact, is stronger than the second contact. Thus, if the same value is used as the thresholds for the first pressure sensor and the second pressure sensor, there is a possibility that a second contact is not detected by the second pressure sensor. According to the above-described aspect, the occurrence of a situation where a second contact is not detected can be prevented.

In the above-described aspect, the assist wear item may further include a plurality of myoelectric sensors each of which detects a voltage value of a voltage generated when the muscle at the portion is moved, the plurality of myoelectric sensors being arranged at positions where the plurality of assisting actuators are arranged or around the positions, and the controller may cause the plurality of assisting actuators to be driven to expand and contract in accordance with the individual voltage values detected by the plurality of myoelectric sensors.

Here, a voltage detected by the myoelectric sensor is a voltage that is generated immediately before the muscle is moved, and is not a voltage that is generated after the muscle is moved. Thus, according to the above-described aspect, driving of the assisting actuators can be controlled on the basis of a detection result indicating a voltage that is generated immediately before the muscle is moved. As a result, trackability of assist by the assisting actuators is increased.

In the above-described aspect, if an amount of change in the voltage value per unit time detected by a first myoelectric sensor among the plurality of myoelectric sensors is equal to or larger than a fourth threshold, the controller may increase a first threshold that is used by a pressure sensor corresponding to the first myoelectric sensor to detect a pressure value.

A pressure value that is detected by the pressure sensor when the user is moving hard is considered to be larger than a pressure value that is detected by the pressure sensor when the user is not moving hard. For example, a pressure value that is detected when the user is running and a hand of the user accidentally touches the assist wear item is estimated to be larger than a pressure value that is detected when the user is walking and a hand of the user accidentally touches the assist wear item. In this case, if the first threshold is a fixed value, it may be determined or not determined that there has been a touch with the outer surface of the assist wear item depending on the degree of movements of the user.

According to the above-described aspect, when an amount of change in the voltage value per unit time detected by the first myoelectric sensor among the plurality of myoelectric sensors is the fourth threshold or larger, that is, when the user is moving hard, the first threshold used by the pressure sensor corresponding to the first myoelectric sensor to detect a pressure value is increased. Accordingly, even when the user is moving hard, an increase or decrease in the driving power of expansion/contraction driving of the assisting actuators not intended by the user can be effectively prevented.

In the above-described aspect, the plurality of contact sensors may be a plurality of touch sensors each of which detects an amount of change in capacitance, the plurality of touch sensors being arranged on the outer surface of the assist wear item, and If the controller receives a detection result indicating an amount of change in capacitance that is equal to or larger than a fifth threshold from each of the plurality of touch sensors, the controller may determine that a contact with the outer surface of the assist wear item has been detected.

According to the above-described aspect, the plurality of touch sensors are used as the plurality of contact sensors. Here, when the user wants to increase or decrease the driving power of expansion/contraction driving of the assisting actuators, the user is likely to touch the assist wear item more strongly than in the case of accidentally touching it. Thus, for example, if the fifth threshold is set to a value equal to or larger than an amount of change in capacitance that is detected when the user accidentally touches the assist wear item, an increase or decrease in the driving power can be prevented when the user accidentally touches the assist wear item.

In the above-described aspect, the assist wear item may include a pair of attachments that are respectively worn on two symmetrical portions of the living body, each of a plurality of assisting actuators arranged on a first attachment in the pair of attachments may be associated with a corresponding one of a plurality of assisting actuators arranged on a second attachment in the pair of attachments, and if a driving power of expansion/contraction driving of a first assisting actuator arranged on the first attachment is increased or decreased, the controller may increase or decrease, in conjunction with the increase or decrease in the first assisting actuator, a driving power of expansion/contraction driving of a second assisting actuator arranged on the second attachment and corresponding to the first assisting actuator.

According to the above-described aspect, in a case where assist pants worn on the individual legs are used as the assist wear item, for example, if the driving power for one of the legs is increased or decreased, the driving power for the other leg is also increased or decreased. Accordingly, if an input operation is performed for one of the legs, an input operation for the other leg can be performed at the same time, and thus an input operation can be performed more easily.

A control method for a controller of an assist wear item according to another aspect of the present disclosure is a control method for a controller of an assist wear item that is worn on a portion of a living body and that has an inner surface which is brought into contact with the portion, the assist wear item including a plurality of assisting actuators each of which is driven to expand and contract, the plurality of assisting actuators being linearly arranged along an expansion/contraction direction of a muscle at the portion in a case where the assist wear item is worn on the portion, a plurality of contact sensors each of which detects a contact with an outer surface of the assist wear item, and the controller, the control method including:

receiving a detection result indicating a first contact from a first contact sensor among the plurality of contact sensors;

if a detection result indicating a second contact is received from a second contact sensor among the plurality of contact sensors within a first time period after reception of the detection result indicating the first contact, increasing or decreasing a driving power of expansion/contraction driving of an assisting actuator corresponding to the second contact sensor among the plurality of assisting actuators; and if a detection result indicating a contact with the outer surface of the assist wear item is received from the first contact sensor during expansion/contraction driving of the assisting actuator, determining that the contact with the outer surface of the assist wear item is the first contact.

A recording medium according to another aspect of the present disclosure is a recording medium storing a control program that causes a device including a processor to perform processing executed by a controller of an assist wear item that is worn on a portion of a living body and that has an inner surface which is brought into contact with the portion, the recording medium being nonvolatile and computer-readable, the assist wear item including a plurality of assisting actuators each of which is driven to expand and contract, the plurality of assisting actuators being linearly arranged along an expansion/contraction direction of a muscle at the portion in a case where the assist wear item is worn on the portion, a plurality of contact sensors each of which detects a contact with an outer surface of the assist wear item, and the controller, the processing comprising:

receiving a detection result indicating a first contact from a first contact sensor among the plurality of contact sensors;

if a detection result indicating a second contact is received from a second contact sensor among the plurality of contact sensors within a first time period after reception of the detection result indicating the first contact, increasing or decreasing a driving power of expansion/contraction driving of an assisting actuator corresponding to the second contact sensor among the plurality of assisting actuators; and if a detection result indicating a contact with the outer surface of the assist wear item is received from the first contact sensor during expansion/contraction driving of the assisting actuator, determining that the contact with the outer surface of the assist wear item is the first contact.

The assist wear item may further include a sensor that detects a posture of the portion of the living body, the second contact sensor may be selected in accordance with the posture detected by the sensor, and detection of the second contact may be performed based on an output from the selected second contact sensor.

The assist wear item may further include a myoelectric sensor, the posture of the portion of the living body may be detected based on a waveform of a voltage detected by the myoelectric sensor, and the plurality of assisting actuators may be caused to periodically expand and contract.

An assist wear item according to another aspect of the present disclosure includes:

one or more sensors that output an initial signal and one or more signals when the one or more sensors detect a plurality of contacts with the assist wear item;

an actuator that changes a degree of contraction in accordance with a control signal; and a controller that receives the initial signal and the one or more signals and that generates the control signal if the initial signal is valid and a first signal included in the one or more signals is valid, wherein the control signal includes information indicating the degree of contraction, the information is generated based on a total number of one or more valid signals among the one or more signals, and the degree of contraction indicated by the information increases as the total number of the one or more valid signals increases, wherein one of conditions in which the first signal is valid is that a time period between the initial signal and the first signal is within a first time period, wherein a first condition, which is one of conditions in which a signal included in the one or more signals except the first signal is valid, is that a time period between the first signal and the signal is within a second time period, and wherein the first time period is longer than the second time period.

If the signal is subsequent to a valid signal included in the one or more signals, another condition in which the signal is valid may be that the first time period is longer than a time period between the signal and the valid signal.

Embodiment

Hereinafter, an embodiment of the present disclosure will be described in detail with reference to the drawings.

Schematic Configuration and Operation

Figure 2:
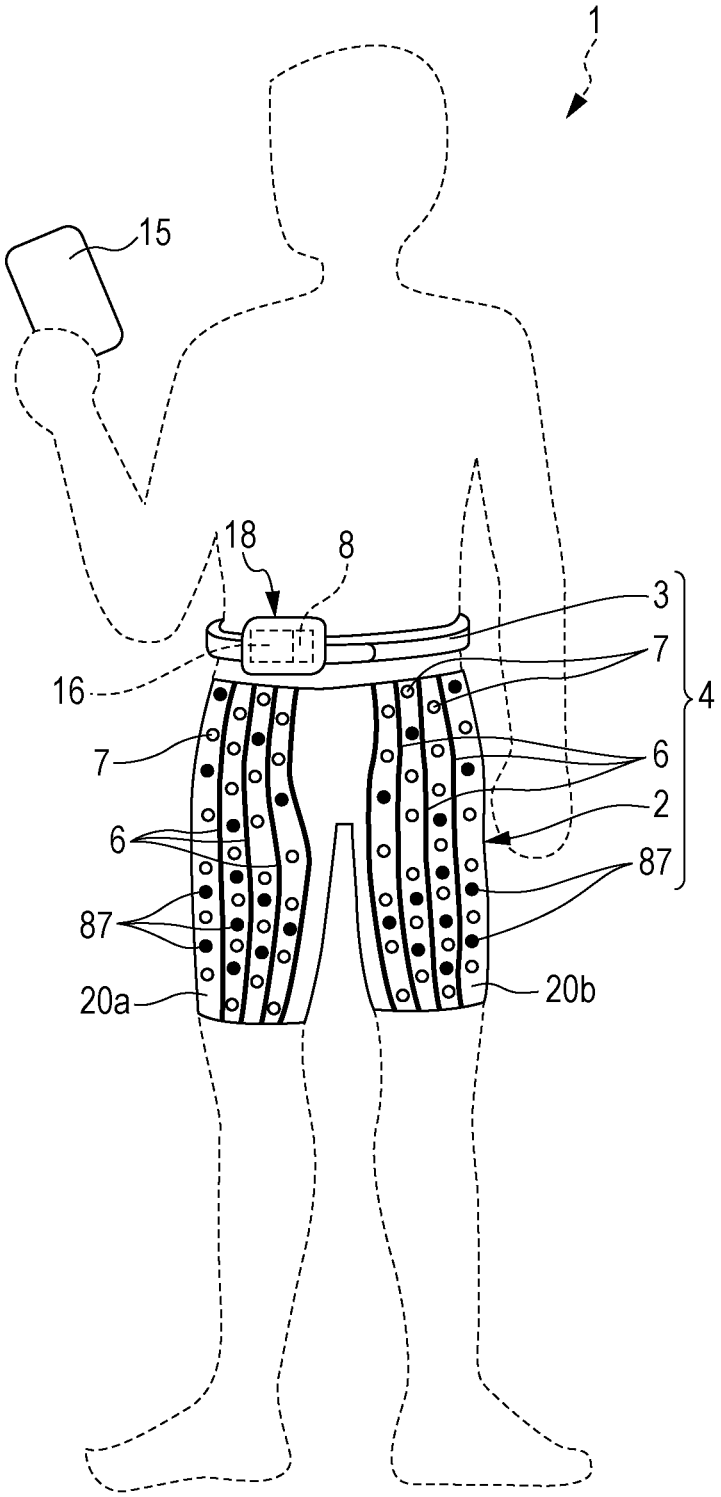
FIG. 2 is an explanatory diagram illustrating a state where the user is wearing the assist wear item according to the embodiment of the present disclosure.
Figure 3:
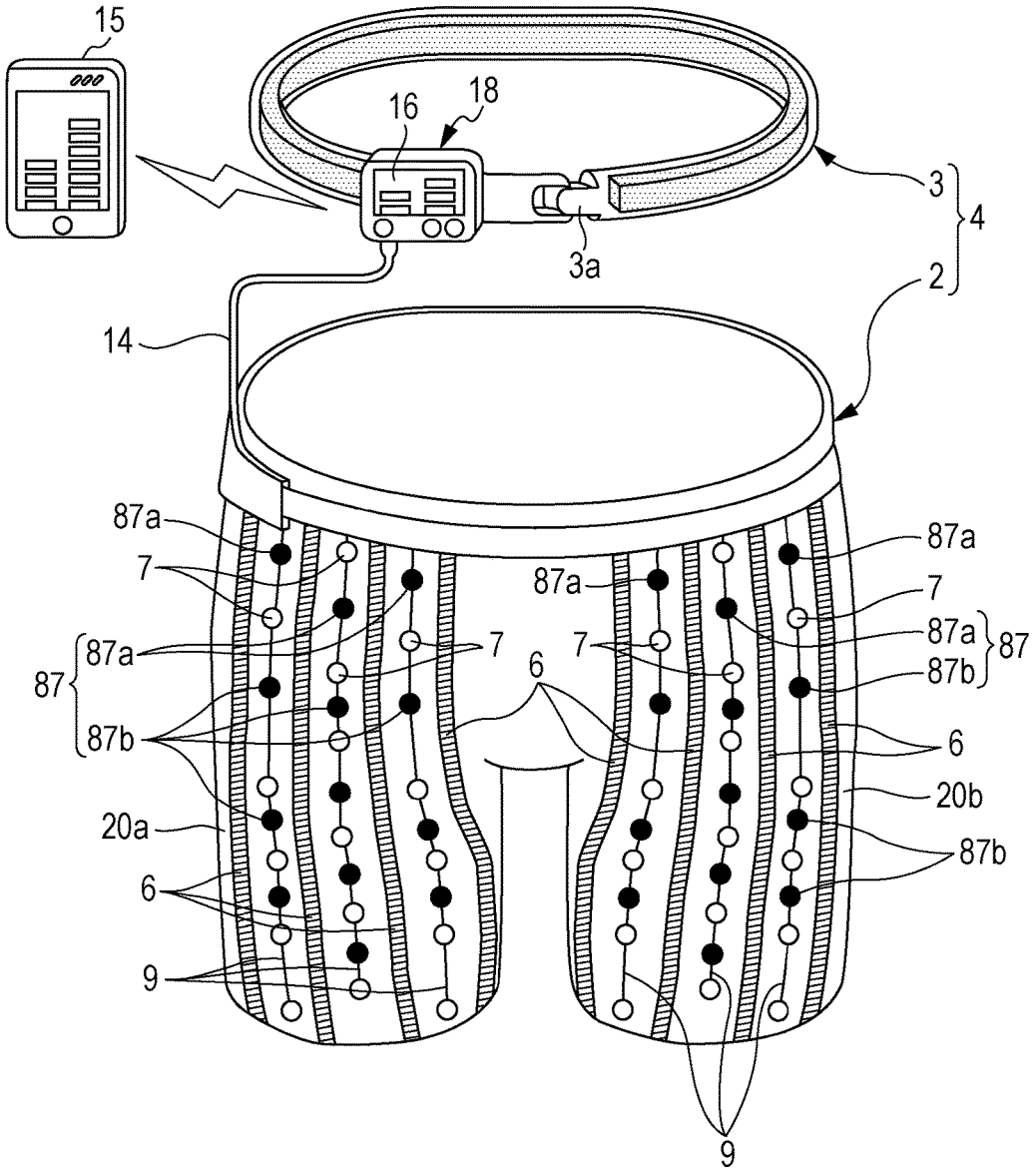
FIG. 3 is a perspective view of the assist wear item illustrated in FIG. 2.

FIG. 1 is a schematic explanatory diagram illustrating movements of a user 1, which is an example of a living body, in a state where the user 1 is wearing an assist wear item 4 according to the embodiment of the present disclosure. FIG. 2 is an explanatory diagram illustrating a state where the user 1 is wearing the assist wear item 4 according to the embodiment of the present disclosure, and FIG. 3 is a perspective view of the assist wear item 4 illustrated in FIG. 2. The assist wear item 4 is worn on a portion to be assisted and assists movements of muscles. In the embodiment, a description will be given of, as an example, an assist wear item for assisting walking, in which a wear main body 2 is formed of pants. Note that the wear main body 2 is not limited to pants and may be a jacket, an elbow supporter, or a knee supporter according to an assist function.

In the embodiment, as illustrated in FIG. 2, the user 1 uses the assist wear item 4 by wearing a controller belt 3 including a controller 8 on the waist and wearing the wear main body 2. As illustrated in FIG. 3, the wear main body 2 is provided with many myoelectric sensors 7 and pressure sensors 87 and many assisting actuators 6 that are fixed on both front and back sides of the wear main body 2 with certain intervals in a vertical direction of the pants, in other words, in a body axis direction of the user 1 (upward/downward direction in FIG. 3). That is, wiring lines 9 to which the many myoelectric sensors 7 and pressure sensors 87 are connected and the assisting actuators 6 are alternately arranged.

The plurality of pressure sensors 87 illustrated in FIG. 3 correspond to an example of contact sensors, and may be capacitive touch sensors. As illustrated in FIG. 3, each pressure sensor 87 may include a pressure sensor 87*a* for detecting a preliminary movement and a pressure sensor 87*b* for detecting a command input movement, and the pressure sensors 87*a* and 87*b* may be arranged in different regions so as to avoid incorrect input. The controller 8 includes a preliminary movement/command input movement determining unit 8*h* that determines whether each of signals detected by the pressure sensors 87 corresponds to a preliminary movement or a command input movement.

First, a description will be given of, with reference to FIG. 1, movements performed by the user 1 in the case of adjusting an assist power (a driving power of expansion/contraction driving of the assisting actuators 6) in the assist wear item 4 according to the embodiment of the present disclosure. First, the user 1 activates a walking assist function and starts walking. Subsequently, as illustrated in part (a) of FIG. 1, the user 1 performs a preliminary movement (reception operation), for example, taps a portion of the wear main body 2 (for example, an abdominal portion in part (a) of FIG. 1) during an assist operation. Within a few seconds after the preliminary movement, as illustrated in part (b) of FIG. 1, the user 1 performs a command input movement (assist power adjustment operation), for example, taps a portion near the assisting actuators 6 for which the assist power (the driving power of expansion/contraction driving of the assisting actuators 6, which will be described below) is to be controlled (for example, the right thigh in part (b) of FIG. 1). With this movement, as illustrated in part (c) of FIG. 1, an assist operation of a desired movement is performed while adjusting the assist power on the basis of the command. Here, the command is an assist power adjustment command.

As illustrated in FIG. 2, the assist wear item 4 includes, in the wear main body 2, at least the plurality of pressure sensors 87 (see black circles in FIGS. 2 and 3), the plurality of linear assisting actuators 6, and the controller 8 including the preliminary movement/command input movement determining unit 8*h*, and is worn on a portion to be assisted such as the lower portion of the body of the user 1 (a human body as an example of a living body) to assist movements of muscles. The pressure sensors 87 function as an example of contact sensors.

The method according to the embodiment is advantageous in that an assist power can be set by directly tapping a target portion, which is intuitive and simple compared to a method for adjusting an assist power by using an information terminal or an input/output device, and thus the method can be used even during movements (during assist operation).

Such a method is simple but has an issue that an incorrect input is likely to occur. In the embodiment, a preliminary movement is detected, and a signal detected within a few seconds after the detection of the preliminary movement is determined to be a command input, so as to prevent an incorrect input. Further, regarding the preliminary movement, a place for detecting the preliminary movement is different from a place for detecting the command input movement, and the preliminary movement is formed of a plurality of touch movements, so as to prevent incorrect input. The preliminary movement formed of a plurality of touch movements will be described below. If the plurality of touch movements are formed of, for example, touches in certain rhythm, touches at a plurality of positions in specific order, simultaneous touches at a plurality of positions, or a combination of the touches and a specific movement, an incorrect input can be reliably prevented. In a case where the preliminary movement is performed in this manner, it is not always necessary to make the place for detecting the preliminary movement different from the place for detecting the command input movement.

Hereinafter, individual components will be described in detail.

Arrangement of Assisting Actuators

The plurality of assisting actuators 6 are linearly arranged on the wear main body 2 along an expansion/contraction direction of a muscle at a target portion to be assisted of the user 1 in a case where the user 1 is wearing the wear main body 2, and are driven to expand and contract to assist movements of muscles near the assisting actuators 6. The expansion/contraction direction of a muscle is, for example, a direction from one end portion toward the other end portion of the wear main body 2. An end portion of the wear main body 2 is, in a case where the assist wear item 4 corresponds to pants, a waist portion (upper end portion) or a lower end portion. In a case where the assist wear item 4 corresponds to a tube-like member to be worn around an arm, the end portion of the wear main body 2 is a wrist portion or an end portion on the base side of the arm. In a case where the assist wear item 4 corresponds to a tube-like member to be worn around a trunk, the end portion of the wear main body 2 is an upper or lower end portion. In a case where the assist wear item 4 corresponds to a tube-like member to be worn on a hand, the end portion of the wear main body 2 is a tip of a finger portion or an end portion of the base. That is, in a case where the assist wear item 4 is formed as a tube-like member to be worn around a portion of a human body, the end portion of the wear main body 2 is any end portion in the center axis direction thereof.

Pressure Sensors

The plurality of pressure sensors 87 are arranged on the wear main body 2 so as to detect a contact with the outer surface of the wear main body 2, for example. In other words, the pressure sensors 87 are a plurality of pressure sensors that detect a pressure value of a pressure applied on the outer surface and are arranged on the wear main body 2 with regular or random intervals. The pressure sensors 87 are arranged at the positions where the assisting actuators 6 are arranged or around the positions. The pressure sensors 87 detect a contact (a touch) with the outer surface of the wear main body 2, and outputs a detection result to the controller 8 (the preliminary movement/command input movement determining unit 8*h* or a receiving unit 8*f* in a third modification example described below). That is, the pressure sensors 87 are used to detect a preliminary movement for adjusting the assist power of the assisting actuators 6 and a command input movement performed after the preliminary movement and to determine a command. Some of the pressure sensors 87, which are touched to input a command, are associated with the respective assisting actuators 6. For example, an assisting actuator 6 and the pressure sensors 87 that are arranged near the assisting actuator 6 (for example, within 10 mm) are associated with each other, and information representing the correspondence is stored in a storage unit 8*a*, which will be described below, Thus, the controller 8 (a command determination controller 88 in the third modification example) controls, on the basis of the number of times a second contact has been detected by at least one of the pressure sensors 87 associated with the assisting actuator 6, an increase or decrease in the driving power of expansion/contraction driving of the assisting actuator 6 corresponding to the at least one pressure sensor 87. Note that the pressure sensor 87*a* that is used only for a preliminary movement is not necessarily associated with the assisting actuator 6.

With this configuration, in which some of the pressure sensors 87 are associated with the assisting actuators 6, an increase or decrease in the driving power of expansion/contraction driving of the assisting actuator 6 corresponding to the position touched by the user 1 is controlled. Accordingly, the user 1 may touch the wear main body 2 at the position where the driving power of expansion/contraction driving of the assisting actuators 6 is to be changed (increased or decreased).

The pressure sensor 87 to be associated may be located within a certain distance (for example, within 10 mm) from the target assisting actuator 6. In this way, the pressure sensor 87 and the assisting actuator 6 associated therewith are located within the certain distance. Thus, when the user 1 touches a position where the driving power of expansion/contraction driving of the assisting actuator 6 is to be changed (increased or decreased), the driving power of expansion/contraction driving of the assisting actuator 6 at the touched position is changed (increased or decreased). Accordingly, the driving power of expansion/contraction driving of the assisting actuator 6 can be intuitively adjusted (increased or decreased).

Arrangement of Myoelectric Sensors

As a more specific example, the assist wear item 4 further includes the plurality of myoelectric sensors 7 (see white circles illustrated in FIGS. 2 and 3). The myoelectric sensors 7 are located so as to come into a direct or indirect contact with a skin of a portion of the user 1, detect a signal generated from the user 1, and output the signal to the controller 8. For example, the myoelectric sensors 7 are arranged at the positions where the individual assisting actuators 6 are arranged or around the positions, and detect whether or not the assist wear item 4 has come into contact with the user 1. The density at which the myoelectric sensors 7 are arranged in a region corresponding to a muscle at a portion of the user 1 may be higher than the density at which the myoelectric sensors 7 are arranged in a region other than the region corresponding to the muscle.

Preliminary Movement/Command Input Movement Determining Unit

Figure 4A:
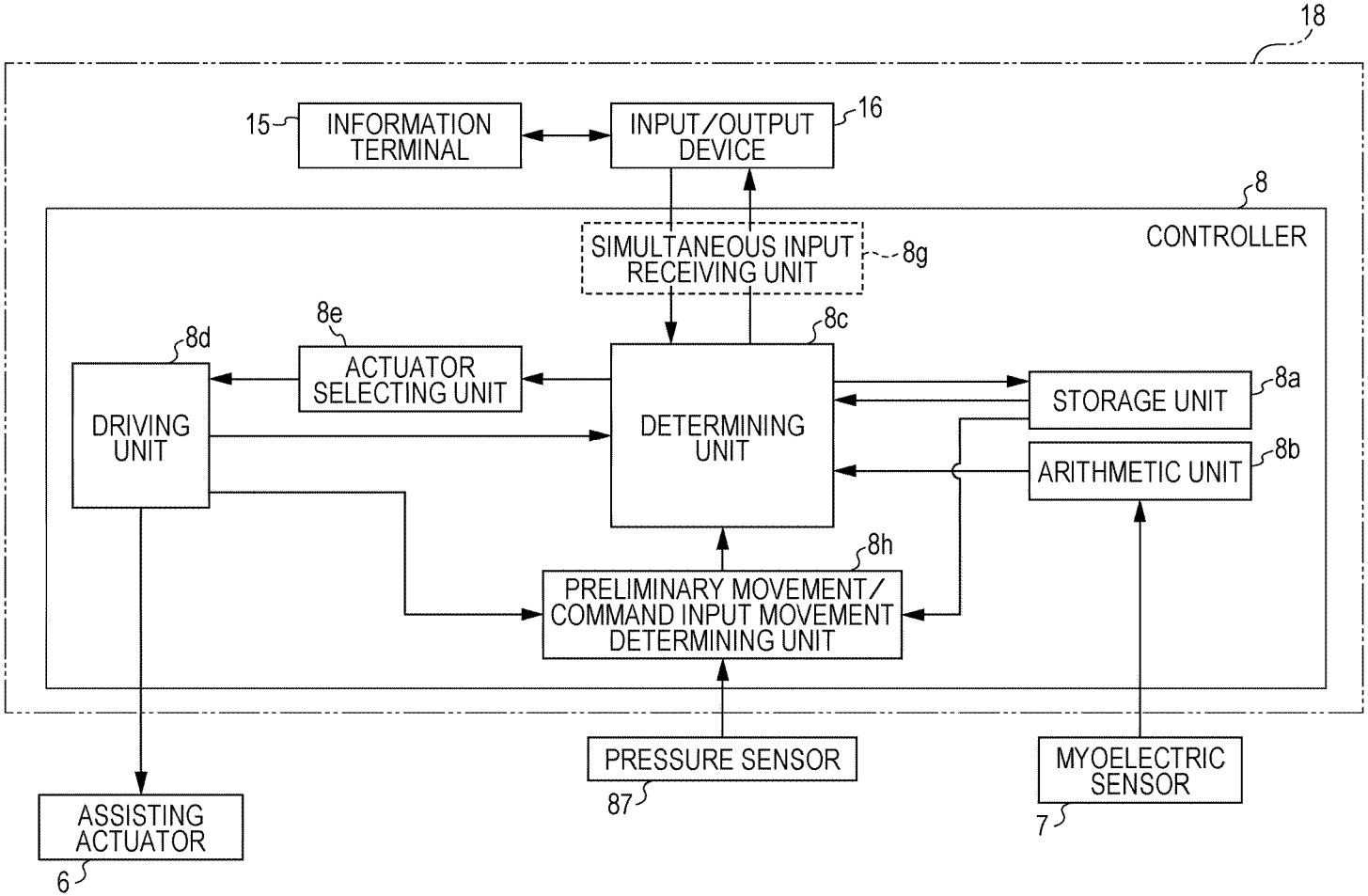
FIG. 4A is a block diagram related to the assist wear item.

FIG. 4A is a block diagram related to the assist wear item 4. As illustrated in FIG. 4A, the controller 8 includes at least the preliminary movement/command input movement determining unit 8*h*. The preliminary movement/command input movement determining unit 8*h* receives outputs from the pressure sensors 87, and determines whether or not a preliminary movement has been performed and a command input movement has been performed on the basis of the received outputs. Only in a case where a preliminary movement and a command input movement have been performed, the preliminary movement/command input movement determining unit 8*h* outputs a signal for controlling the driving of the assisting actuators 6 to the assisting actuators 6 via a determining unit 8*c*, an actuator selecting unit 8*e*, and a driving unit 8*d*. In other words, the pressure sensors 87 and the preliminary movement/command input movement determining unit 8*h* enable input of an assist power increase/decrease command without using an input/output device 16, which will be described below.

More specifically, the preliminary movement/command input movement determining unit 8*h* (the receiving unit 8*f* in the third modification example described below) is capable of, during expansion/contraction driving of the assisting actuators 6, receiving a detection result indicating a contact (touch), that is, a first contact, from a pressure sensor 87 among the plurality of pressure sensors 87. After receiving the detection result indicating the first contact, the preliminary movement/command input movement determining unit 8*h* (the receiving unit 8*f* in the third modification example described below) is capable of, within a first time period t1 from the time when the detection result indicating the first contact is received, receiving a detection result indicating a contact (touch), that is, a second contact, from the plurality of pressure sensors 87, When receiving the detection result indicating the second contact, the preliminary movement/command input movement determining unit 8*h* (the receiving unit 8*f* in the third modification example described below) performs control to increase or decrease the driving power of expansion/contraction driving of the assisting actuator 6 corresponding to the pressure sensor that has detected the contact.

Figure 27:
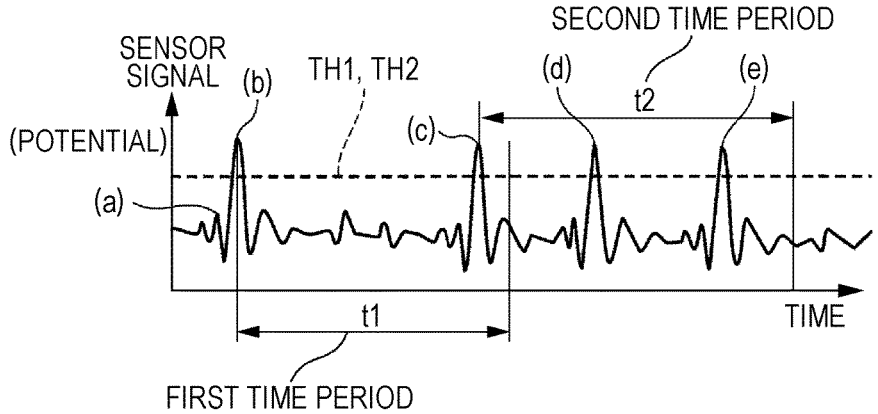
FIG. 27 is a graph for describing a relationship among a sensor signal which is an output from one pressure sensor, a first threshold, a first time period, and a second time period.

FIG. 27 illustrates an example of a sensor signal for determining detection of a first contact and a second contact. FIG. 27 is a graph for describing the relationship between a sensor signal, which is an output from one pressure sensor, a first threshold, and a second threshold. As illustrated in FIG. 27, whether or not a detection result indicating a first contact has been received is determined by the preliminary movement/command input movement determining unit 8*h* (the receiving unit 8*f* in the third modification example described below), on the basis of whether or not a pressure value (sensor signal) detected by the pressure sensor 87 is equal to or larger than the first threshold TH1. In FIG. 27, a detection result indicating a first contact is received in state (b).

The preliminary movement/command input movement determining unit 8*h* (the receiving unit 8*f* in the third modification example described below) determines whether or not a detection result indicating a second contact has been received, on the basis of whether or not a pressure value (sensor signal) detected by the pressure sensor 87 within a first time period t1 after a detection result indicating a first pressure value is received is a second threshold TH2 or larger. In FIG. 27, a detection result indicating a second contact is received in state (c). In a case where the detection result indicating the second contact is received, when a detection result indicating a second contact is received within the first time period t1 and then a detection result indicating another second contact is received from the pressure sensor 87 within a second time period t2, the preliminary movement/command input movement determining unit 8*h* (the command determination controller 88 in the third modification example described below) sums up the number of times a second contact has been detected within the first time period t1 (the contact indicated by (c) in FIG. 27) and the number of times a second contact has been detected within the second time period t2 (the contacts indicated by (d) and (e) in FIG. 27), transmits an instruction corresponding to the total number of times to the determining unit 8*c*, and performs control to increase or decrease the driving power of expansion/contraction driving of the assisting actuators 6. In FIG. 27, three contacts (see states (c), (d), and (e)) are detected.

As an example, the preliminary movement/command input movement determining unit 8*h* maintains the setting in an initial state (the state before a preliminary movement) if a command input movement is not performed within the first time period t1 after a preliminary movement. If it is determined that a command input movement has been performed once after the preliminary movement, the preliminary movement/command input movement determining unit 8*h* performs setting to increase the assist power of the corresponding assisting actuator 6 by one step. If a contact corresponding to a command input movement is detected within the second time period t2 from the contact corresponding to the first command input movement, the preliminary movement/command input movement determining unit 8*h* performs setting to increase the assist power by one step every time a contact is detected. At this time, if the preliminary movement/command input movement determining unit 8*f* (the command determination controller 88 in the third modification example described below) receives a detection result indicating a second contact once or more during expansion driving of the assisting actuators 6, the preliminary movement/command input movement determining unit 8*h* (the command determination controller 88 in the third modification example described below) performs control to increase the driving power of expansion driving of the assisting actuators 6 in accordance with the number of times of detection. On the other hand, if the preliminary movement/command input movement determining unit 8*f* (the command determination controller 88 in the third modification example described below) receives a detection result indicating a second contact once or more during contraction driving of the assisting actuators 6, the preliminary movement/command input movement determining unit 8*h* (the command determination controller 88 in the third modification example described below) performs control to increase the driving power of contraction driving of the assisting actuators 6 in accordance with the number of times of detection.

Figures 33, 34:
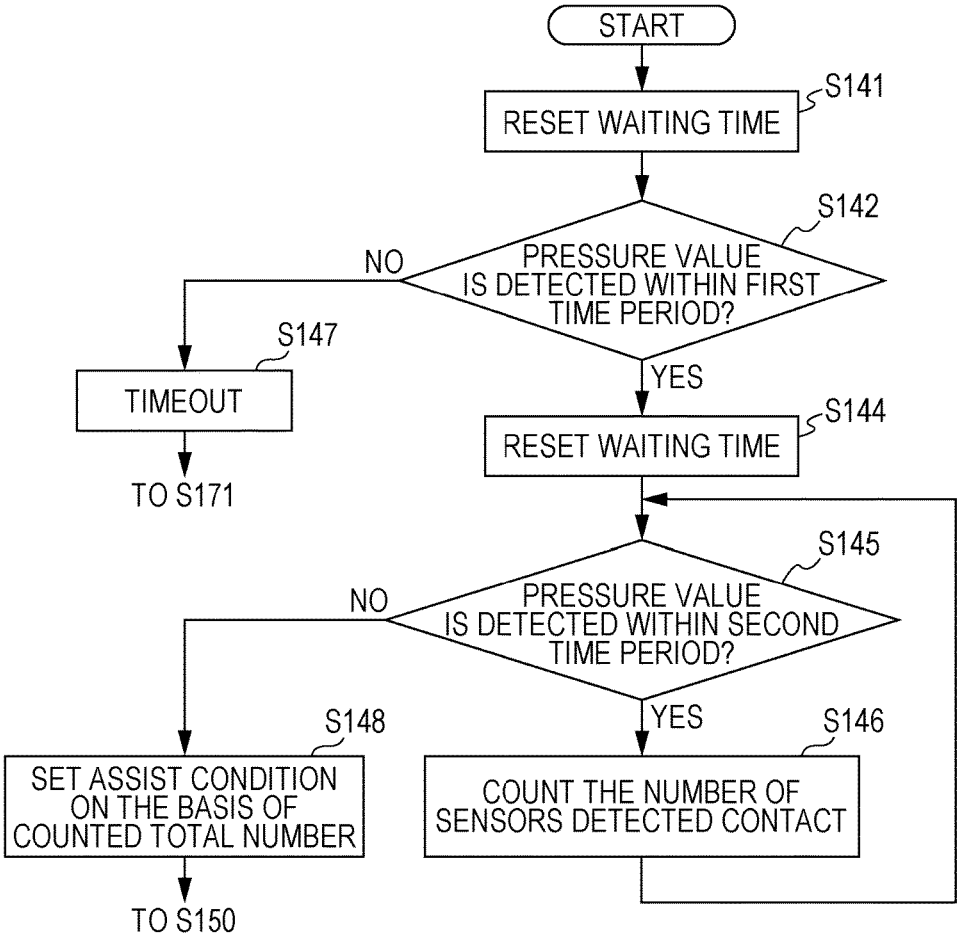
FIG. 33 is a flowchart illustrating processing for a command input movement in the processing performed by the preliminary movement/command input movement determining unit.
FIG. 34 is an explanatory diagram illustrating, in the form of a table, a relationship between the numbers of touches and set values of assist power in the case of increasing assist power of assisting actuators in proportion to the number of times a second contact has been detected.

As described above, the controller 8 is capable of performing control to increase the driving power of expansion/contraction driving of the assisting actuators 6 as the number of times a second contact has been detected increases within an upper limit number of times (see FIG. 34 described below). In other words, the controller 8 is capable of performing control to increase the width of increase or decrease in the driving power in accordance with the number of times in a case where the controller 8 receives a detection result indicating a second contact a plurality of times.

Also in the command input movement, a command may be formed of a plurality of touches. For example, two touches at an interval of one second or less may cause the assist power to be increased by one step, and two touches at an interval of one second or less after a few seconds may cause the assist power to be increased by one step. In this way, an incorrect input can be prevented more reliably.

Specific Configuration of Assisting Actuators

Figure 5A:
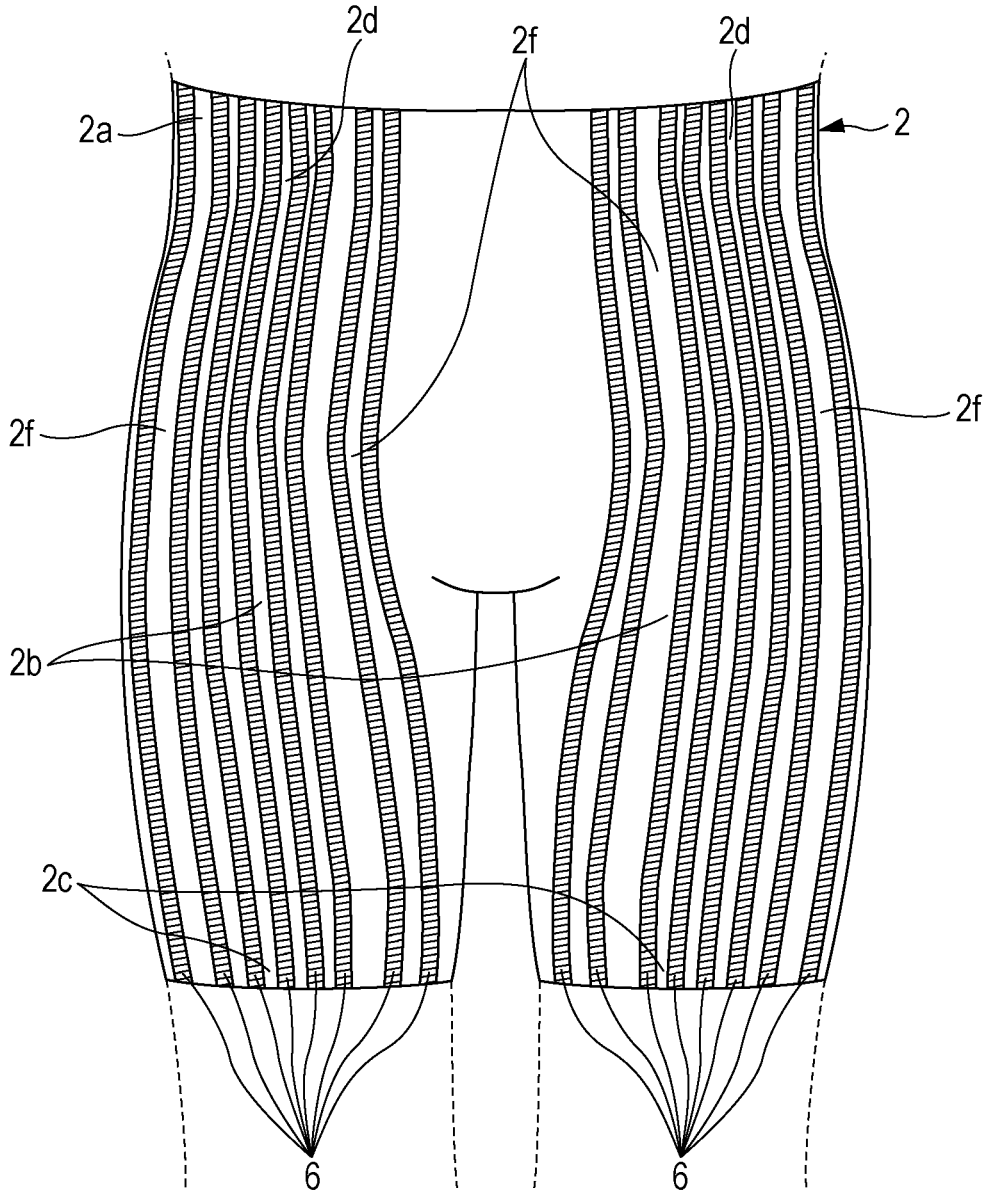
FIG. 5A is an explanatory diagram illustrating an arrangement state of assisting actuators on a front side of a wear main body.
Figure 6:
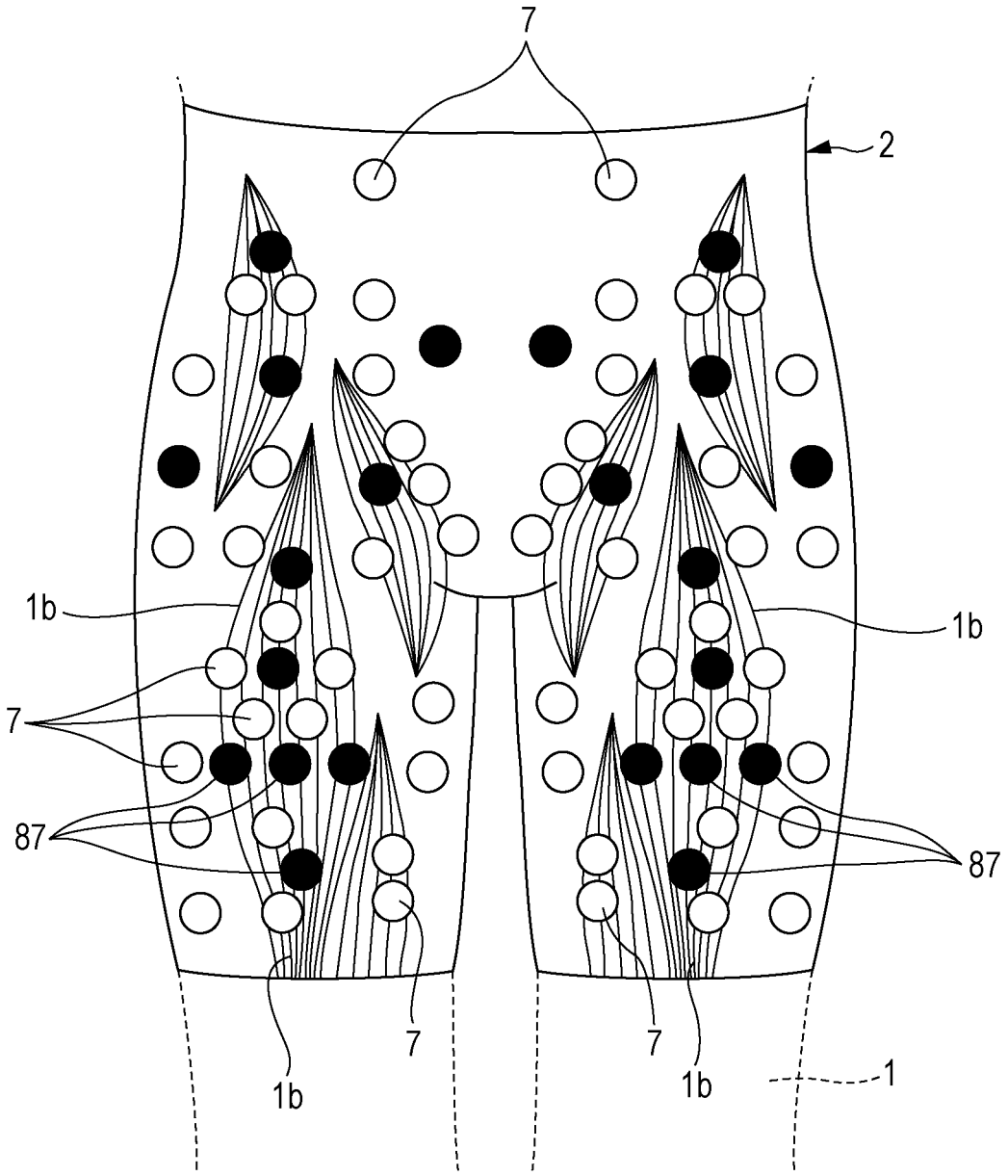
FIG. 6 is an explanatory diagram illustrating a relationship between muscles and an arrangement state of sensors on the front side of the wear main body.
Figure 7:
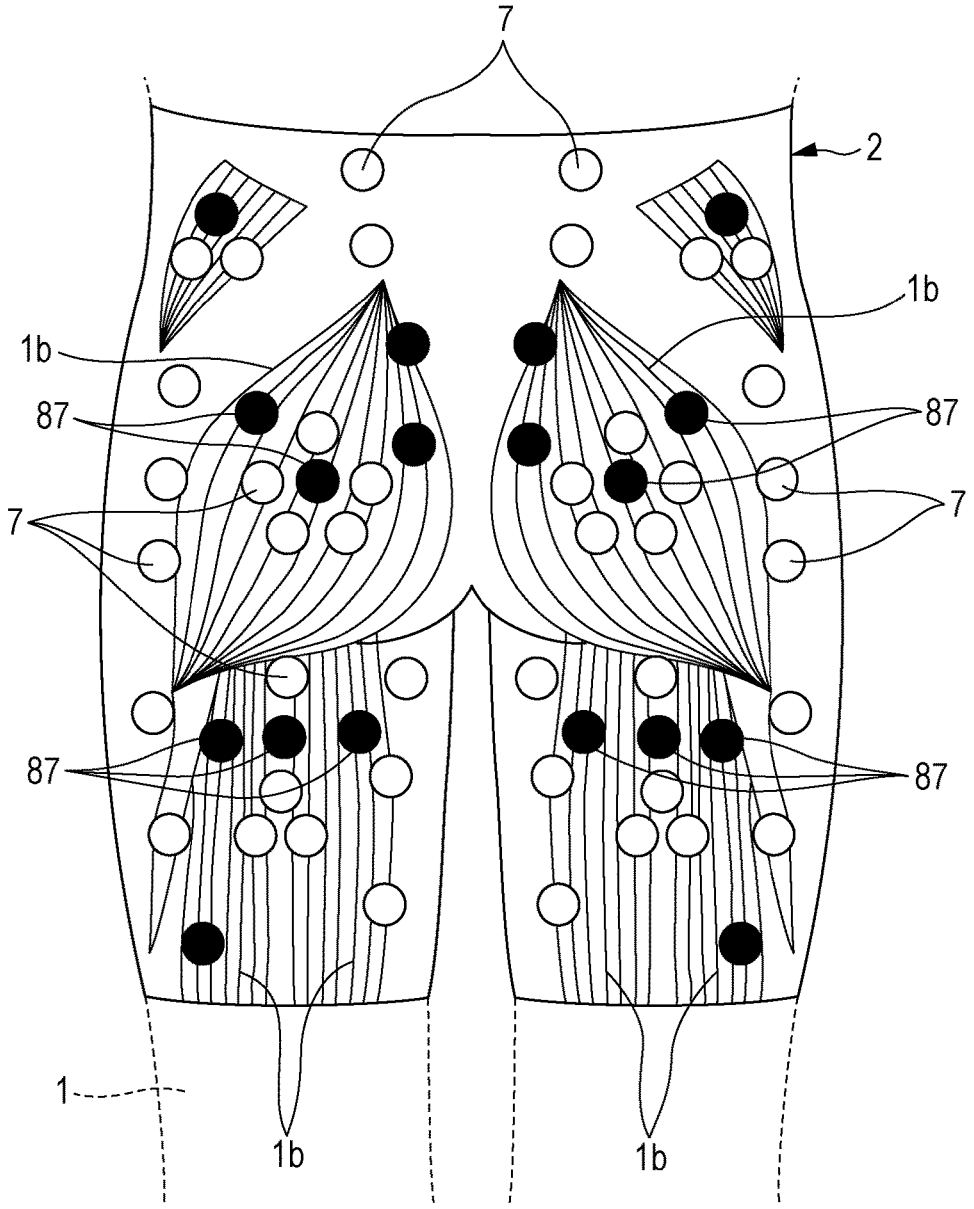
FIG. 7 is an explanatory diagram illustrating a relationship between muscles and an arrangement state of sensors on a back side of the wear main body.

FIG. 5A is an explanatory diagram illustrating an arrangement state of the assisting actuators 6 on the front side of the wear main body 2. FIGS. 6 and 7 are explanatory diagrams respectively illustrating a relationship between muscles and an arrangement state of the myoelectric sensors 7 and the pressure sensors 87 on the front side and back side of the wear main body 2.

Specifically, as illustrated in FIG. 5A, the assisting actuators 6 are densely arranged in portions 2*d* ranging from the front center of the thighs to a waist portion on the front and back sides of the wear main body 2 and in the portions corresponding to the portions 2*d* ranging from the back center of the thighs to the waist portion (the region corresponding to muscles), compared to portions 2*f* other than the portions 2*d*, so that the assist power of the assisting actuators 6 easily acts on the muscles of the thighs (muscles 1*b* in FIG. 6). In this way, the assisting actuators 6 are arranged densely or sparsely in accordance with muscles on the basis of an assist function, in other words, so that the assist function is efficiently utilized.

Figure 5B:
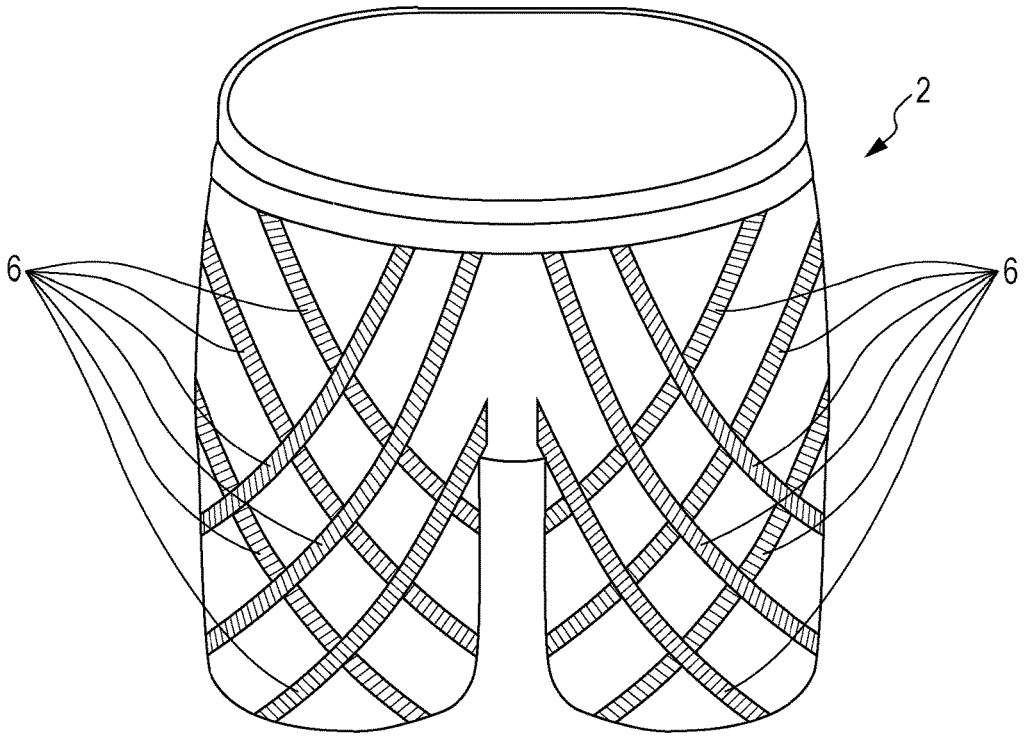
FIG. 5B is a perspective view of an assist wear item a cording to a modification example of FIG. 5A.

The assisting actuators 6 may be arranged in almost parallel with one another, or may be arranged so as to cross one another as illustrated in FIG. 5B. In this case, the composite power of the assisting actuators 6 acts in the direction along an expansion/contraction direction of muscles in a target portion to be assisted.

All of the linear assisting actuators 6 used here are the same. Alternatively, different actuators may be used.

In the embodiment, actuators having the same structure are used as the linear assisting actuators 6.

Figure 8:
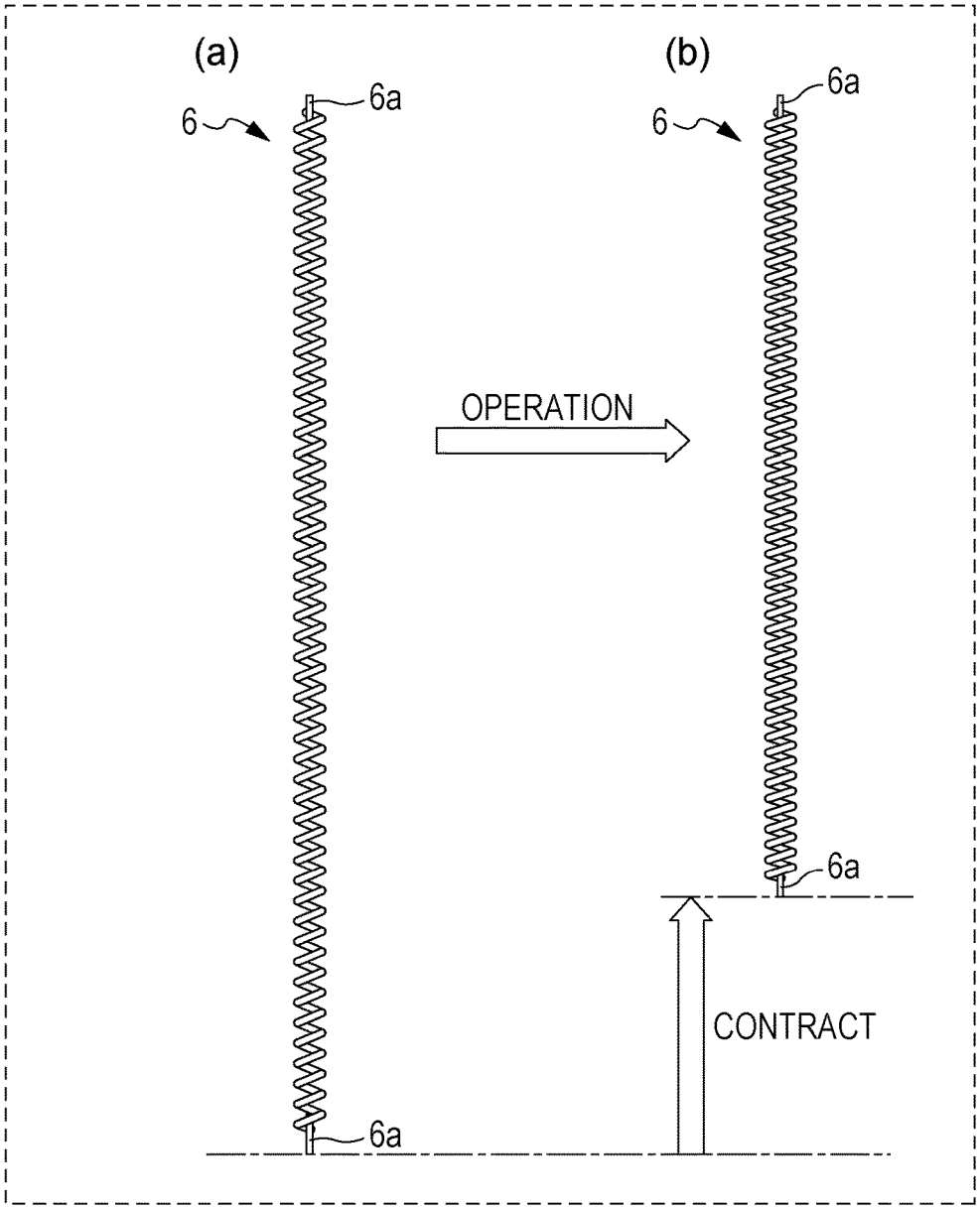
FIG. 8 is an explanatory diagram of an assisting actuator.
Figure 9:
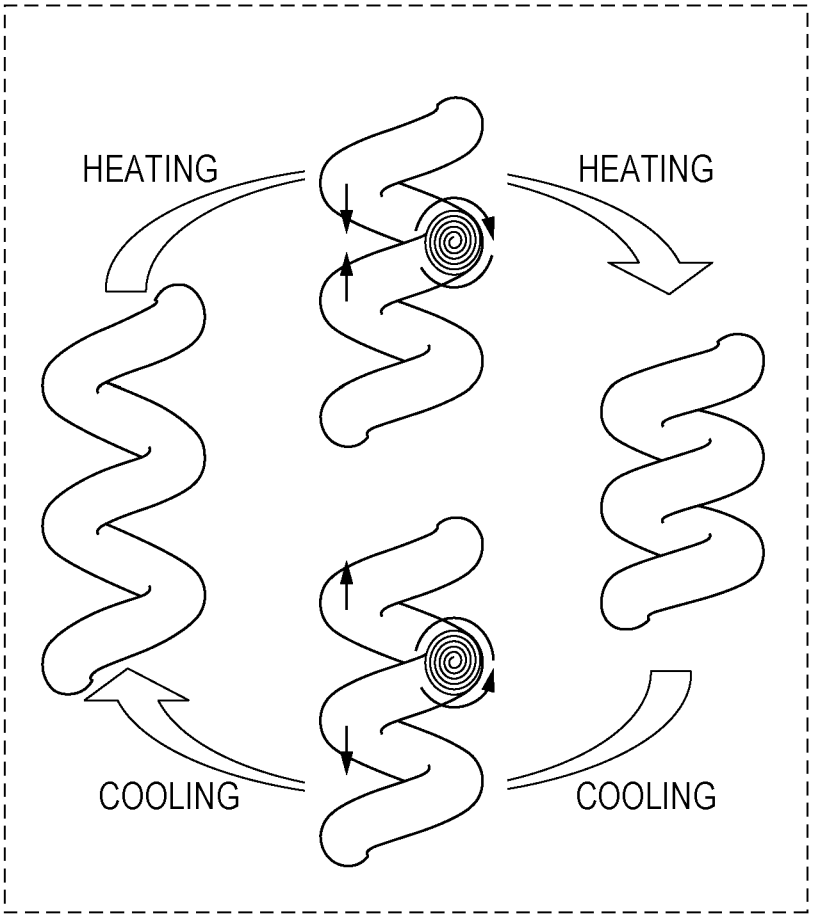
FIG. 9 is an enlarged explanatory diagram of the assisting actuator.
Figure 10:
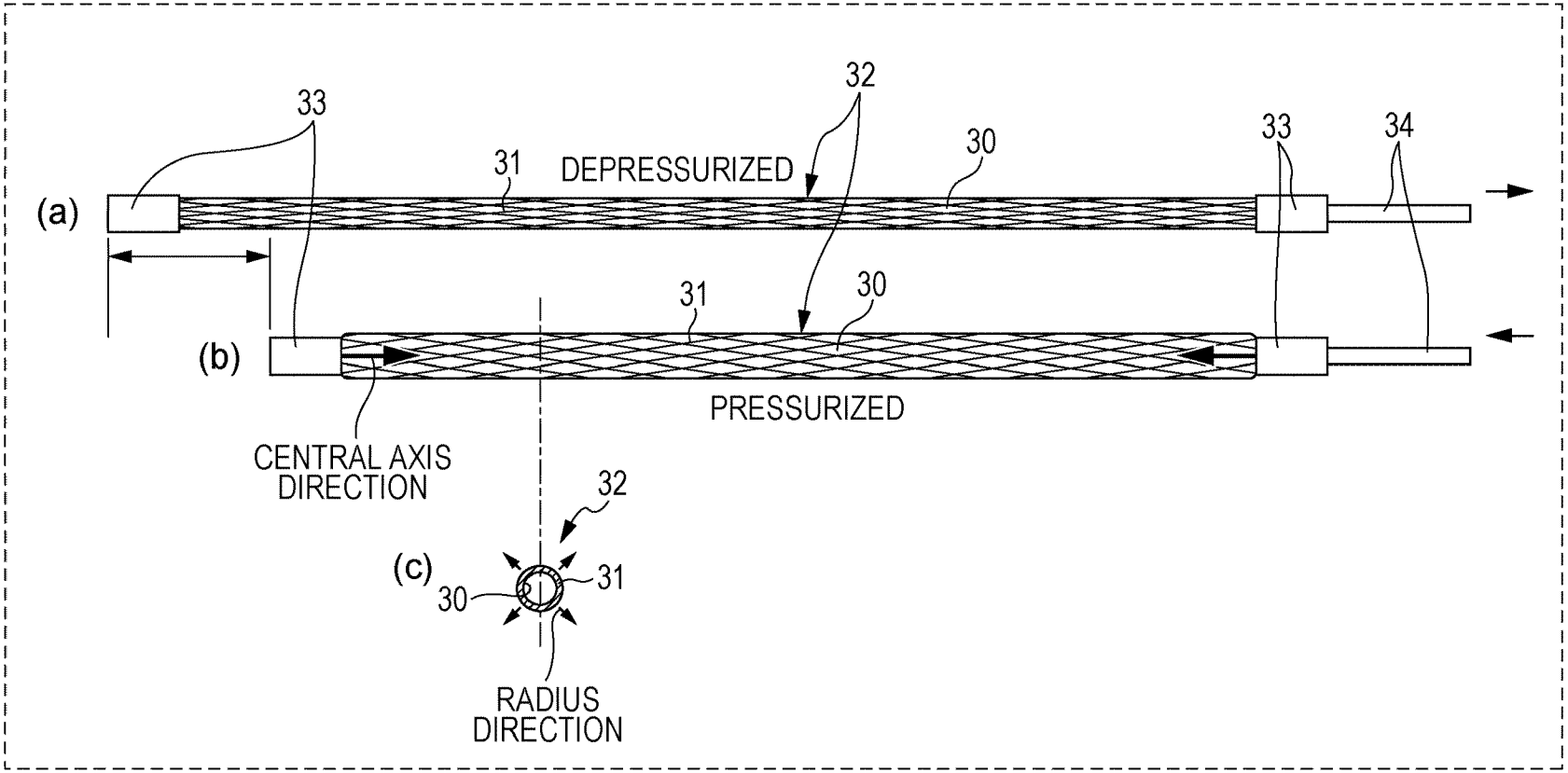
FIG. 10 is an explanatory diagram of another assisting actuator.
Figure 11:
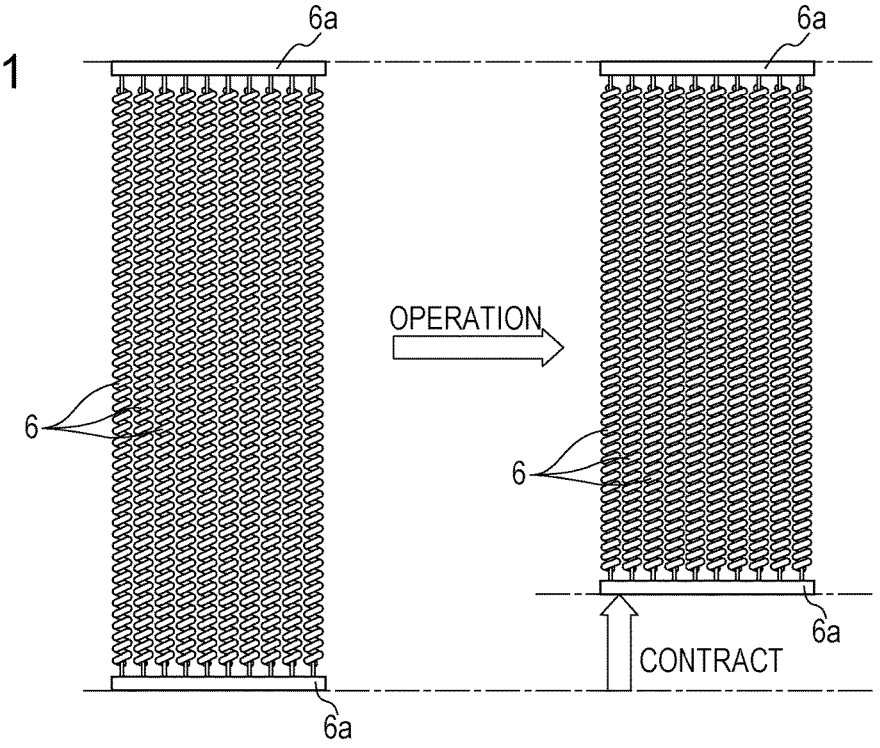
FIG. 11 is an explanatory diagram of assisting actuators according to a modification example of the assisting actuator in FIG. 8.
Figure 12:
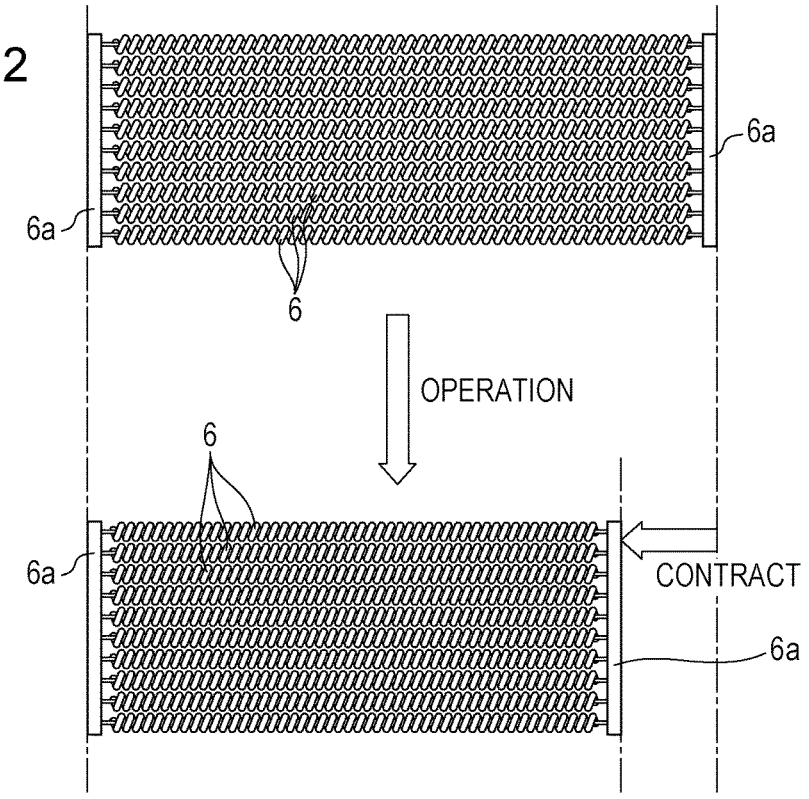
FIG. 12 is an explanatory diagram of assisting actuators according to a modification example of the assisting actuator in FIG. 8.
Figure 13:
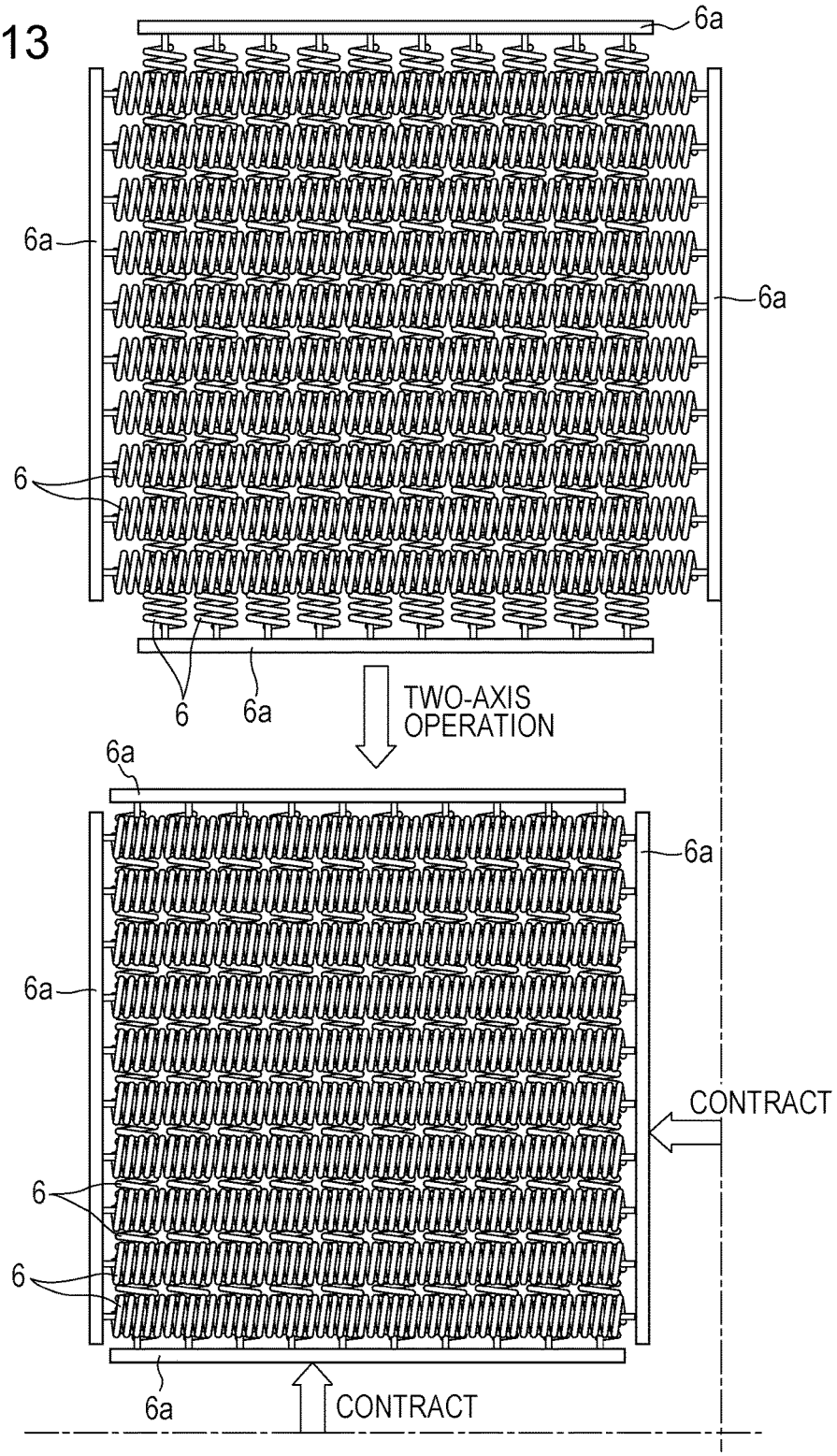
FIG. 13 is an explanatory diagram of assisting actuators according to a modification example of the assisting actuator in FIG. 8.

FIG. 8 is an explanatory diagram of an assisting actuator 6. FIG. 9 is an enlarged explanatory diagram of the assisting actuator 6. FIG. 10 is an explanatory diagram of another actuator. FIGS. 11 to 13 are explanatory diagrams of actuators according to modification examples of the assisting actuator 6 illustrated in FIG. 8. As illustrated in part (a) of FIG. 8, each assisting actuator 6 is formed of, for example, a helically wound linear member having a diameter of 0.233 mm and made of a synthetic resin. When a voltage is applied to electrodes 6*a* at both ends to energize and heat the assisting actuator 6, the entire length contracts as illustrated in part (b) of FIG. 8. On the other hand, when the assisting actuator 6 is no longer energized and heat is naturally discharged, the assisting actuator 6 expands to the original length. This is because, as illustrated in FIG. 9, heating causes torsion in a circumferential direction of the helically wound resin linear member and accordingly the entire length contracts. Cooling due to natural heat radiation causes the torsion to be cancelled in the circumferential direction and accordingly the entire length expands. Each assisting actuator 6 may be used alone. Alternatively, as illustrated in FIGS. 11 and 12, many assisting actuators 6 may be arranged in parallel in accordance with the level of power to be used and may be allowed to expand and contract in synchronization with one another. Alternatively, as illustrated in FIG. 13, many assisting actuators 6 may be arranged in parallel along two axis directions orthogonal to each other and may be allowed to expand and contract in synchronization with one another in the two axis directions.

An example of such an actuator is a linear actuator that contracts when heat is applied thereto, specifically, a high polymer actuator that is linear and capable of expanding and contracting in an axis direction. More specifically, a coiled actuator that is formed by twisting nylon fiber whose surface is silver coated, that contracts due to torque when current is applied to the silver coating to energize and heat the actuator, and that expands to the original length when the application of current is stopped, may be used. Such an actuator can be easily driven and the output per weight can be increased.

Another example of the actuator is a linear pneumatic actuator that expands and contracts in accordance with adjustment of an air pressure illustrated in FIG. 10. An example of the pneumatic actuator may be a Mckibben actuator 32 in which flanges 33 are fixed at both ends of a rubber tube 30 and a mesh fiber 31 is wound around the outer periphery of the rubber tube 30. In the Mckibben actuator 32, when a fluid (air or the like) is flown from a pipe 34 into the rubber tube 30 through one of the flanges 33, the rubber tube 30 is pressurized and expands. However, since the rubber tube 30 is restrained by the mesh fiber 31, the rubber tube 30 expands in a radius direction (see part (c) of FIG. 10) and significantly contracts in a center axis direction (see part (b) of FIG. 10). On the other hand, when the fluid (air or the like) is discharged from the rubber tube 30 via one of the flanges 33 and the pipe 34, the rubber tube 30 is depressurized, contracts in the radius direction (see part (c) of FIG. 10) together with the mesh fiber 31, and significantly expands in the center axis direction. As a specific example, the Mckibben actuator 32 having an outer diameter of 1.2 mm has already been developed. Such an actuator is capable of easily performing a holding operation by blocking coming in and out of the rubber tube 30 of a fluid.

The assisting actuators 6 described above are arranged in an axis direction of a portion of the user 1 (in other words, an axis direction of a muscle of the portion), but may be arranged in a direction that crosses the axis direction of the portion (for example, any direction such as an orthogonal direction or slanting direction). For example, if the assisting actuators 6 are caused to expand and contract in accordance with movements of the muscles 1*b* illustrated in FIG. 6, the movements of the muscles 1*b* can be assisted.

Specific Configuration of Myoelectric Sensors

The myoelectric sensors 7 measure a myoelectric potential, which is a voltage generated when a muscle is moved and is an example of a biological signal. The myoelectric sensors 7 are capable of detecting an instruction provided from the brain to a muscle, and thus the trackability of assisting muscular movements can be increased. Distortion sensors, acceleration sensors, gyro sensors, or the like may be used instead of the myoelectric sensors 7.

Figure 14:
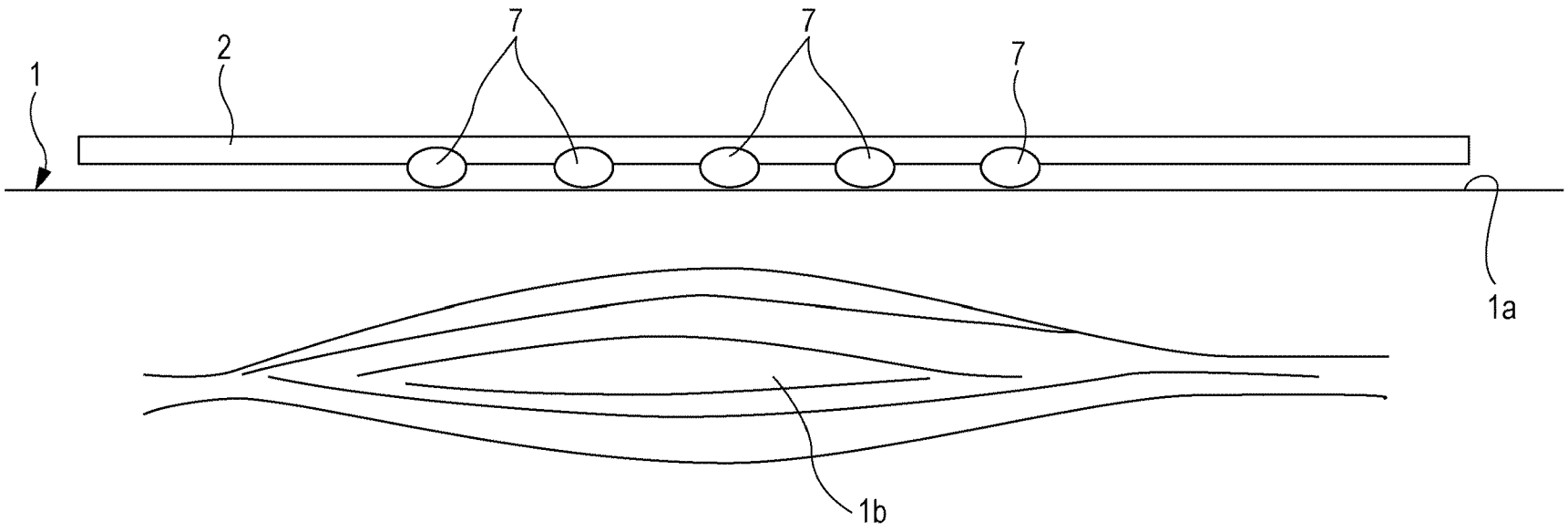
FIG. 14 is an explanatory diagram illustrating a relationship between an arrangement of sensors and a muscle.

The relationship between the arrangement of the myoelectric sensors 7 and a muscle 1*b* is illustrated in FIG. 14. The individual myoelectric sensors 7 are arranged at the positions where movements of the muscle 1*b* can be measured. For example, the myoelectric sensors 7 may be arranged at, among the positions corresponding to the muscle 1*b*, the positions corresponding to the positions where the muscle 1*b* moves the most greatly, so that the myoelectric sensors 7 can easily detect movements of the muscle 1*b*, Specifically, as illustrated in FIGS. 6 and 7, one or plural myoelectric sensors 7 are arranged in a region corresponding to the muscles 1*b* on both the front and back sides of the wear main body 2, so that movements of the muscles 1*b* can be easily measured by the myoelectric sensors 7. More specifically, on the front side of the wear main body 2, the myoelectric sensors 7 are arranged at the positions or regions corresponding to femoral muscles such as rectus femoris. On the back side of the wear main body 2, the myoelectric sensors 7 are arranged at the positions or regions corresponding to muscles of buttocks and hamstrings.

Figure 15:
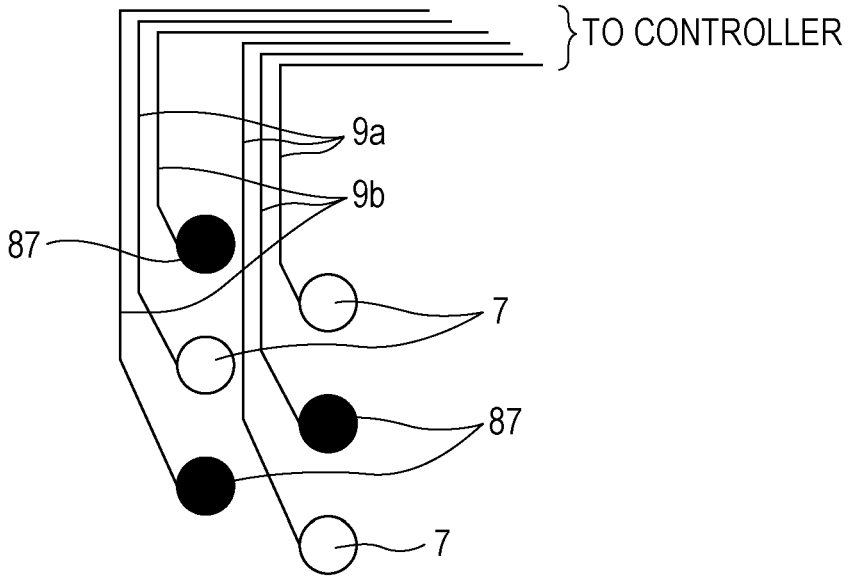
FIG. 15 is an explanatory diagram illustrating wiring lines extending from sensors in the case of analog wiring.
Figure 16:
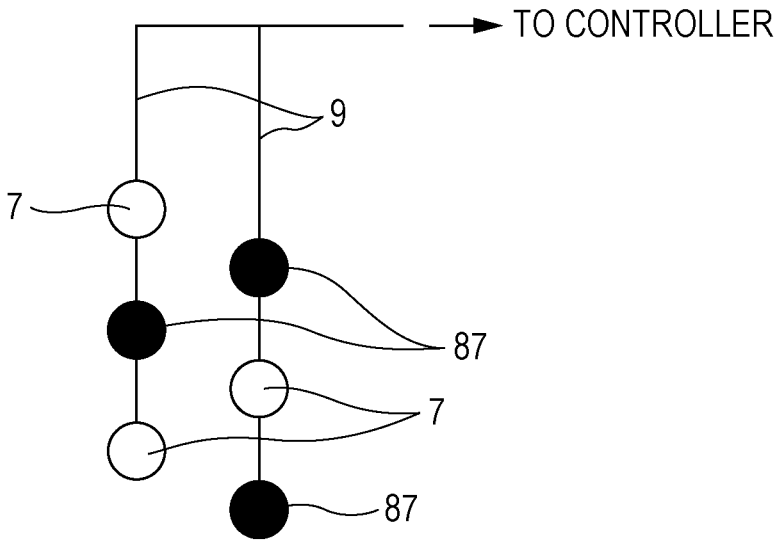
FIG. 16 is an explanatory diagram illustrating wiring lines extending from sensors in the case of digital wiring.

Wiring lines 9*a* extending from the myoelectric sensors 7 and wiring lines 9*b* extending from the pressure sensors 87 are arranged in the manner illustrated in FIG. 15 in the case of analog wiring. With such a configuration, signals of the individual myoelectric sensors 7 and signals of the individual pressure sensors 87 can be independently detected. On the other hand, in the case of digital wiring, wiring lines 9 extending from the individual myoelectric sensors 7 and the individual pressure sensors 87 are common wiring lines using a digital communication bus, as illustrated in FIG. 16. With such a configuration, the number of wiring lines can be decreased.

The wiring lines 9 for all the myoelectric sensors 7, all the pressure sensors 87, and all the assisting actuators 6 converge at the waist portion, which is the upper end portion of the pants, and are connected to the ring-shaped controller belt 3 through a wiring line 14.

Specific Configuration of Controller Belt

The controller belt 3 includes an engagement portion 3*a* at both ends thereof and can be worn on the waist of the user 1 by being engaged at the engagement portion 3*a*. The engagement portion 3*a* may be provided with a switch so that a start signal for the assisting actuators 6 is input to the controller 8 when the engagement portion 3*a* is engaged. Alternatively, a start signal for the assisting actuators 6 may be input by the user 1 from the input/output device 16 described below to the controller 8.

The controller belt 3 includes an operation device 18. As illustrated in FIG. 2, the operation device 18 includes the input/output device 16 that is capable of communicating with an information terminal 15 such as a smartphone and that includes an operation button, a speaker, a light-emitting diode (LED), a display, a wireless communication device, and so forth, and also includes the controller 8 connected to the input/output device 16. The input/output device 16 does not necessarily include the wireless communication device for communicating with the information terminal 15 such as a smartphone, and may receive only a direct input in the input/output device 16. The user 1 directly inputs an instruction to start or end assist into the input/output device 16 or indirectly inputs the instruction to the input/output device 16 via the information terminal 15 and controls driving of the assisting actuators 6 by using the controller 8.

An instruction to start or end an assist operation (driving of the assisting actuators 6) or an instruction to end an assist power adjustment operation is input to the input/output device 16 and is transmitted to the controller 8. Signals to start and end the assist operation (driving of the assisting actuators 6) may be automatically input through, for example, an engagement operation and a release operation of the engagement portion 3*a* of the controller belt 3.

The user 1, which is a human body, is capable of inputting an instruction to start or end an assist operation (driving of the assisting actuators 6) or an instruction to end an assist power adjustment operation into the information terminal 15 such as a smartphone. The instruction input to the information terminal 15 is transmitted from the information terminal 15 to the controller 8. In accordance with a warning instruction from the controller 8, a warning operation may be performed by the information terminal 15.

The controller belt 3 is not always necessary. In this case, the operation device 18 is attached to the wear main body 2 (see FIGS. 39 and 40 described below).

Specific Configuration of Controller

The controller 8 includes, as illustrated in FIG. 4A, the preliminary movement/command input movement determining unit 8*h*, the storage unit 8*a*, an arithmetic unit 8*b*, the determining unit 8*c*, the actuator selecting unit 8*e*, and the driving unit 8*d*. The controller 8 controls the driving of the assisting actuators 6 on the basis of signals from the myoelectric sensors 7 in response to an instruction from the input/output device 16. Also, the controller 8 determines a preliminary movement and a command input movement and controls an increase or decrease in the driving power of expansion/contraction driving of the assisting actuators 6 in order to adjust the assist power. Whether or not a preliminary movement has been performed is determined on the basis of the level of an output from the pressure sensor 87. Whether or not a command input movement has been performed is determined on the basis of the level of an output from the pressure sensor 87 and a time interval after the preliminary movement has been detected.

The storage unit 8*a* stores thresholds to be used for determination of contact detection in the preliminary movement/command input movement determining unit 8*h* (a first threshold for determination of a preliminary movement, a second threshold for determination of a command input movement, third to fifth thresholds described below, etc.), and also stores a plurality of assist operation modes in which the level of assist power or assist timing varies, or a single assist operation mode. The assist operation modes include, for example, a walking mode and a stairs up/down mode. The storage unit 8*a* stores, for each assist operation mode, a change pattern corresponding to a temporal change in values of the myoelectric sensors 7 calculated by the arithmetic unit 8*b*. Further, the storage unit 8*a* stores a program to be used by the determining unit 8*c* to determine the operation of the assisting actuators 6. Also, the storage unit 8*a* stores, in advance, position information about the individual myoelectric sensors 7 and the individual pressure sensors 87, position information about the assisting actuators 6 corresponding to the individual myoelectric sensors 7, and position information about the assisting actuators 6 corresponding to the individual pressure sensors 87.

The arithmetic unit 8*b* performs, as necessary, arithmetic operation for myoelectric sensor calibration, in which the strongest signal or a relatively strong signal is extracted from among a plurality of output signals from the myoelectric sensors 7, and a weight is applied to the plurality of output signals from the myoelectric sensors 7, and then an average value is calculated. Also, the arithmetic unit 8*b* may perform arithmetic operation for gain adjustment or noise cancelling on the output signals from the myoelectric sensors 7. The calculation result generated by the arithmetic unit 8*b* is transmitted from the arithmetic unit 8*b* to the determining unit 8*c*.

The determining unit 8*c* receives, from the preliminary movement/command input movement determining unit 8*h*, setting information about a driving condition for controlling an increase or decrease in the driving power of expansion/contraction driving of the assisting actuators 6 as command determination result information, and transmits an instruction to the actuator selecting unit 8*e*. Alternatively, the determining unit 8*c* may receive, from the preliminary movement/command input movement determining unit 8*h*, information representing the total number of contacts detected as second contacts (the number of command input movements) after the second time period t2 has elapsed, calculate the amount of increase in the assist power corresponding to the number of command input movements on the basis of the relationship information stored in the storage unit 8*a*, and transmit an instruction to the actuator selecting unit 8*e*.

In the case of an assist phase, the determining unit 8*c* determines a movement or state of the user 1 by comparing a temporal change in the values of the myoelectric sensors 7 calculated by the arithmetic unit 8*b* with a change pattern corresponding to the assist operation mode read from the storage unit 8*a*. Also, the determining unit 8*c* determines the operation of the assisting actuators 6 on the basis of a program stored in the storage unit 8*a* in advance, and provides an instruction to the actuator selecting unit 8*e* as necessary.

Figure 4B:
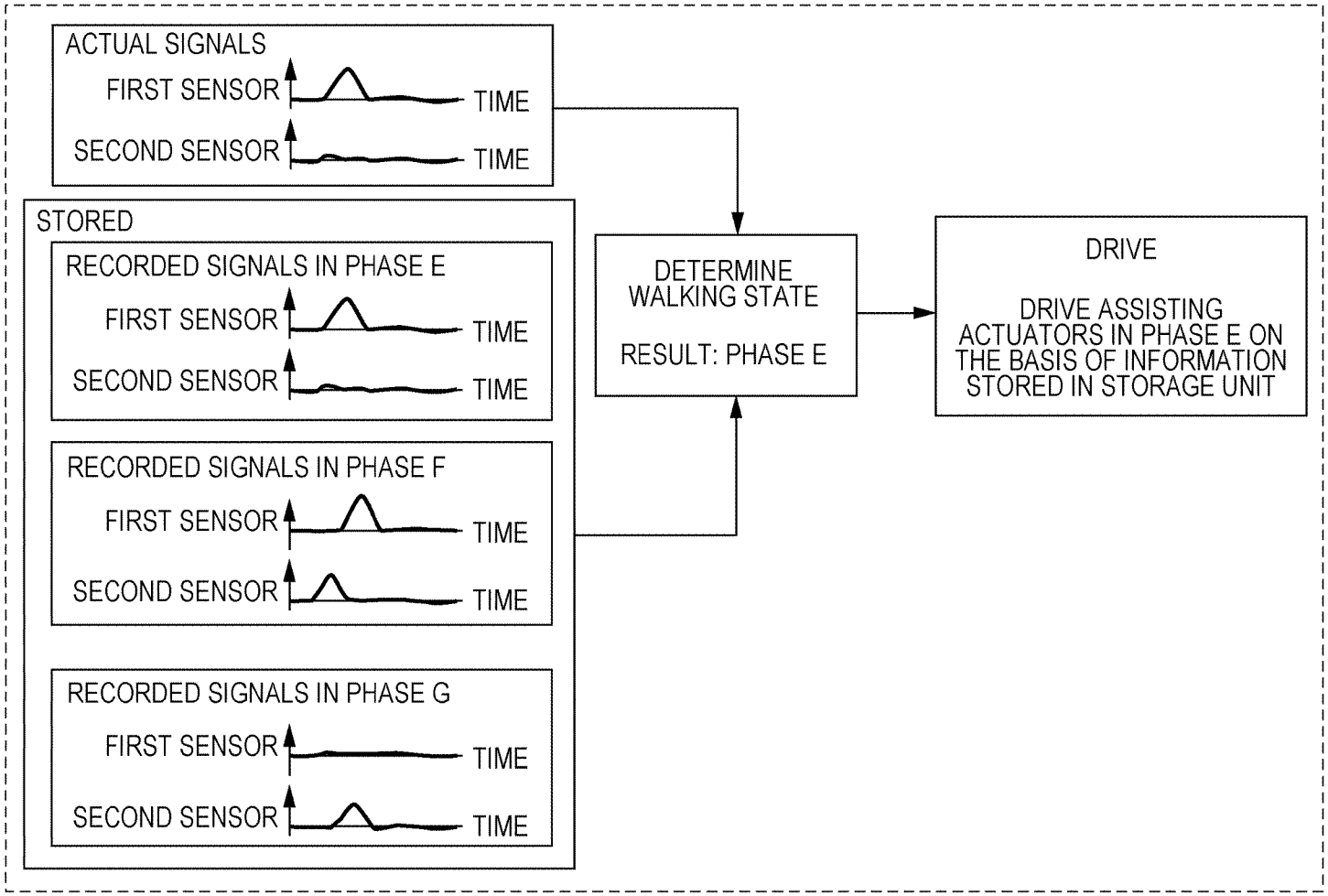
FIG. 4B is an explanatory diagram for describing comparison and determination.
Figure 25:
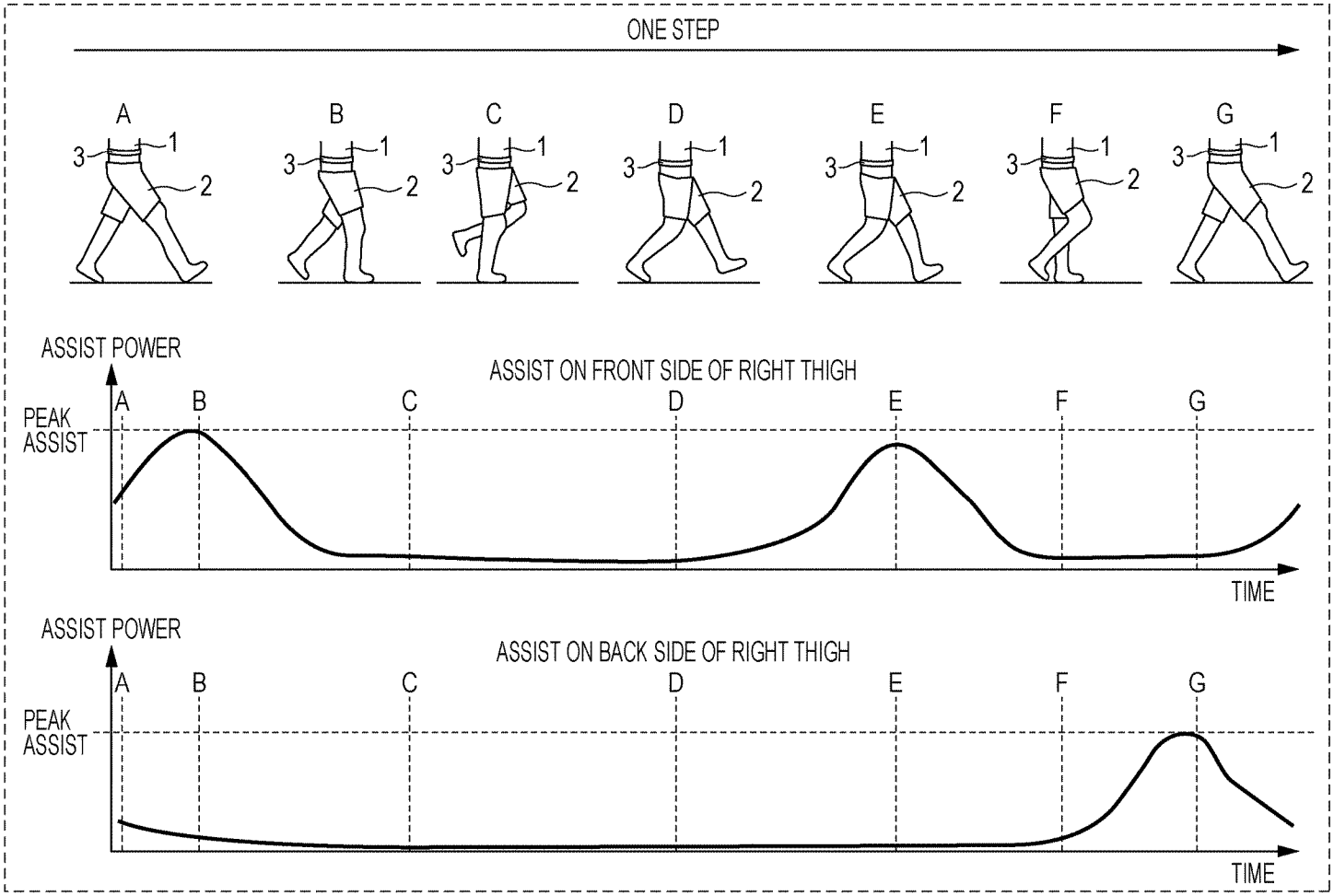
FIG. 25 is an explanatory diagram of a process of assisted walking using the assist wear item.

A specific example of determining a movement or state of the user 1 will be described with reference to FIGS. 25 and 4B to 4D. FIG. 25 is an explanatory diagram of a process of assisted walking using the assist wear item 4, and FIG. 4B is an explanatory diagram for describing comparative determination between actual signals used for determining a walking state in phase E among phases A to G in the process of assisted walking illustrated in FIG. 25 and signals in individual phases stored in the storage unit 8*a* (only phases E, F, and G are illustrated as a representative example). FIG. 4C is an explanatory diagram of signals in phase E of a time response pattern used for the determination illustrated in FIG. 4B, and FIG. 4D is an explanatory diagram of an example of driving the assisting actuators 6 (actuators A to E as a representative example) in phase E based on the determination illustrated in FIG. 4B. As an example, FIG.

4B illustrates actual signals used for determining a walking state in phase E among phases A to G in the process of assisted walking using the assist wear item 4 illustrated in FIG. 25, and signals in individual phases stored in the storage unit 8*a* (only phases E, F, and G are illustrated as a representative example). As an example of "signals of the myoelectric sensors 7 in individual phases stored in the storage unit 8*a*" illustrated in FIG. 4B, signal values of a first sensor (for example, a myoelectric sensor on the front side of the right thigh) in phase E and signal values of a second sensor (for example, a myoelectric sensor on the back side of the right thigh) in phase E are illustrated in FIG. 4C. In FIG. 4C, signal values are expressed by using digital values 0, 1, 2, and 3. As the digital value increases, the signal value of the myoelectric sensor increases. FIG. 4D illustrates an example of driving the assisting actuators 6 (only actuators A to E arranged on the front side of the right thigh are illustrated as a representative example) in phase E. In FIG. 4D, the drive levels of the actuators are expressed by 0, 1, 2, and 3. As the value of the drive level increases, the degree of contraction of the actuator increases.

Referring to FIG. 25, in the case of determining a movement or state of the user 1, the determining unit 8*c* compares actual signals output from the sensors arranged at specific positions, such as the first and second sensors, with the signals corresponding to the first and second sensors in individual phases stored in the storage unit 8*a*, The actual signals are the most similar to the signals in phase E in the time response pattern illustrated in FIG. 4B, and thus the determining unit 8*c* determines that the walking state of the user 1 corresponds to phase E.

On the basis of the determination result generated by the determining unit 8*c* and a program stored in the storage unit 8*a* in advance (here, a walking program), the determining unit 8*c* determines the operation of the assisting actuators 6 on the basis of a drive example of the assisting actuators 6 in phase E (only the actuators A to E are illustrated as a representative example) as illustrated in FIG. 4D, and provides an instruction to the driving unit 8*d* via the actuator selecting unit 8*e*. The driving unit 8*d* drives the corresponding assisting actuators 6 (the actuators A to E as a representative example) in response to the instruction provided from the determining unit 8*c*.

The driving unit 8*d* inputs information indicating which assisting actuator 6 is performing an assist operation and information that is necessary to adjust the assist power, such as the driving power at the time, to the determining unit 8*c* and the preliminary movement/command input movement determining unit 8*h* (the receiving unit 8*f* in the third modification example described below).

The preliminary movement/command input movement determining unit 8*h* is capable of receiving outputs from all the pressure sensors 87, and determines, on the basis of the outputs from the pressure sensors 87, whether or not a first contact as a preliminary movement has been detected by the pressure sensors 87, and whether or not a second contact as a command input movement has been detected by the pressure sensors 87. In the case of determining whether or not a second contact has been detected, if the second contact has been detected, the preliminary movement/command input movement determining unit 8*h* also determines the number of times the second contact has been detected. Further, the preliminary movement/command input movement determining unit 8*h* has, for example, a timer function, so as to be able to measure the first time period t1 and the second time period t2.

The operation of the preliminary movement/command input movement determining unit 8*h* (a preliminary movement/command input movement determination operation) will be described in detail below.

Specific Configuration of Wear Main Body

Figure 17:
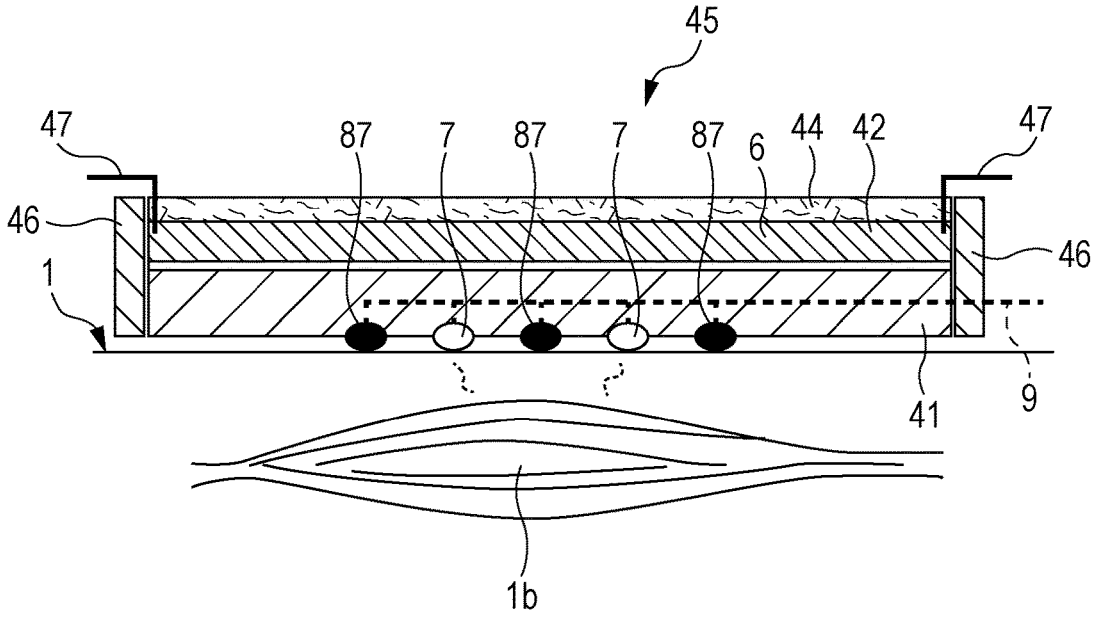
FIG. 17 is a cross-sectional view of an example structure of the wear main body.

FIG. 17 illustrates an example structure 45 of the wear main body 2. As illustrated in FIG. 17, the pressure sensors 87, the myoelectric sensors 7, and the wiring lines 9 for the sensors are arranged in a first layer 41 on the side nearest the user 1. The assisting actuators 6 are arranged in a second layer 42 on the first layer 41, A cover made of cloth or the like for covering the entire second layer 42 is arranged in a third layer 44, which is the outermost layer. With this structure, the example structure 45 has a three-layer structure as a whole. In FIG. 17, reference numeral 46 denotes assisting actuator fixing portions for fixing both ends of the assisting actuators 6, and reference numeral 47 denotes wiring lines for the assisting actuators 6.

Myoelectric Sensor Calibration

Figure 18:
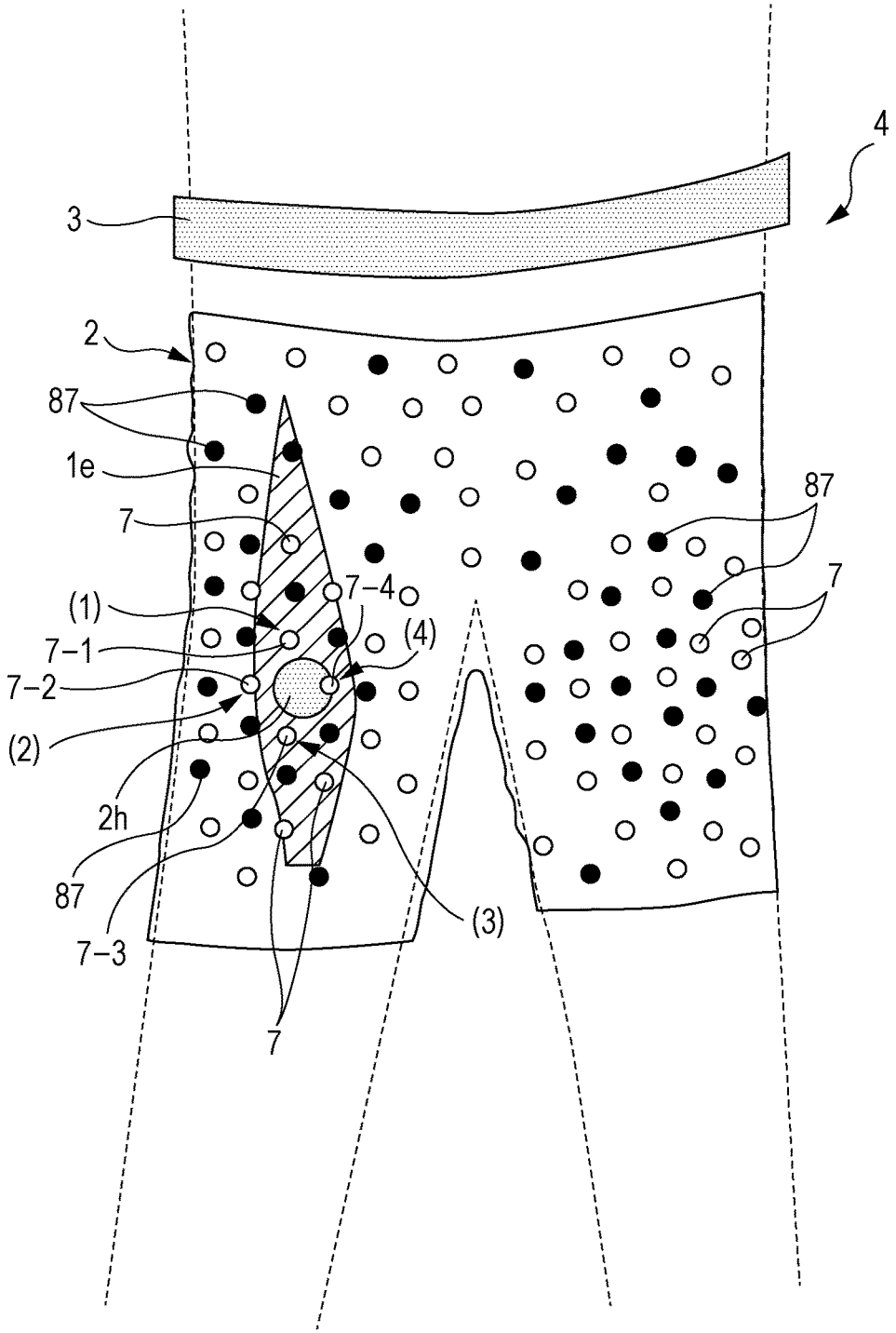
FIG. 18 is an explanatory diagram of sensor calibration.
Figure 19:
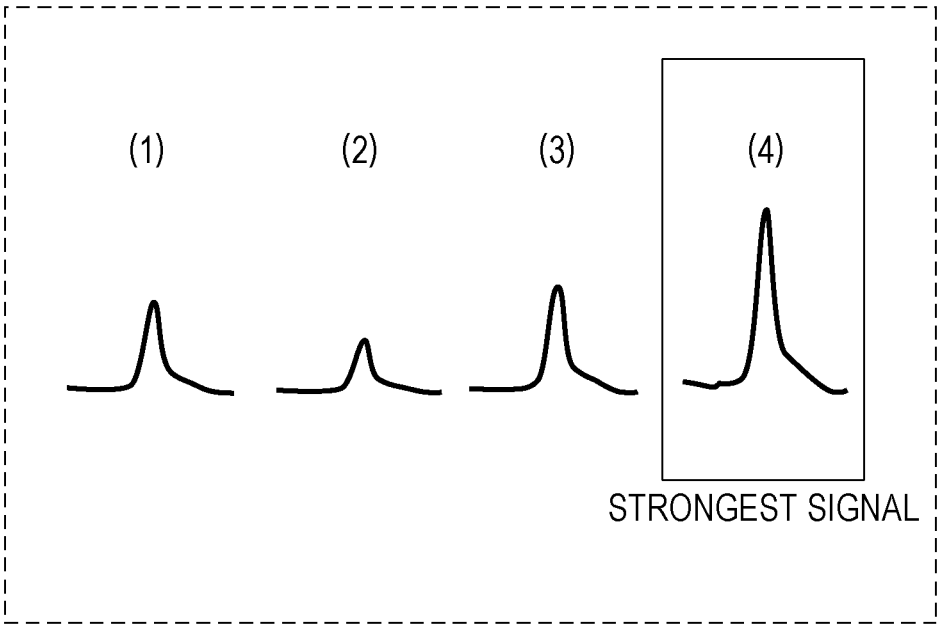
FIG. 19 is an explanatory diagram of a method for processing of sensor output.
Figure 20:
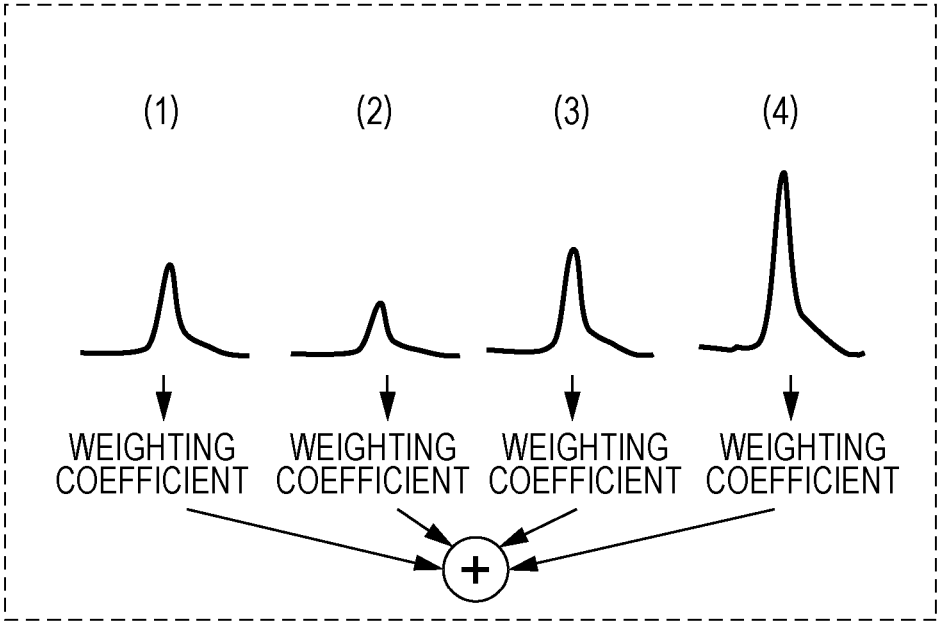
FIG. 20 is an explanatory diagram of another method for processing of sensor output.

FIG. 18 is an explanatory diagram of myoelectric sensor calibration. FIG. 19 is an explanatory diagram of a method for processing of output from the myoelectric sensors. FIG. 20 is an explanatory diagram of another method for processing of output from the myoelectric sensors.

Actually, the positions of the myoelectric sensors 7 vary among users or every time a user wears the assist wear item 4, depending on the features of the user 1 (body shape, sex, age, etc.) or how the wear main body 2 fits the user 1. In such a case, the controller 8 may be able to automatically perform myoelectric sensor calibration so that the user 1 does not need to perform adjustment each time.

For example, as illustrated in FIG. 18, biological signals such as myoelectric potentials are obtained by using the myoelectric sensors 7 arranged near a target region 2*h* located in accordance with a target muscle 1*e*, which is a muscle for which muscular movements are assisted. The target region 2*h* is set at, for example, a region where the signal level of the target muscle 1*e* is higher than the level of noise generated from the muscles near the target muscle 1*e*. Specifically, a target region for rectus femoris is set at a point on the rectus femoris and near an intermediate point between a pelvis (anterior inferior iliac spine) and a knee (tuberositas tibiae). The myoelectric sensors 7 arranged in the region which includes the intermediate point at the center and where displacement of the myoelectric sensors 7 may occur (for example, a region having a radius of 2 cm) obtain signals. In FIG. 18, the myoelectric sensors 7 are evenly arranged over the entire area of the wear main body 2.

Subsequently, among the biological signals obtained by the myoelectric sensors 7, the strongest signal is extracted by the arithmetic unit 8*b* of the controller 8. For example, as illustrated in FIG. 19, when it is assumed that output signals of four myoelectric sensors 7, that is, myoelectric sensors 7-1, 7-2, 7-3, and 7-4, are represented by (1), (2), (3), and (4), the output signal (4) of the myoelectric sensor 7-4 is the strongest signal.

As a result, the myoelectric sensor 7-4 that has detected the strongest output signal (4) is handled by the controller 8 as the myoelectric sensor 7 in the target region 2*h*. In this way, even if use of only the myoelectric sensors 7 in the target region 2*h* may cause a malfunction due to insufficient detection of power, correction, that is, myoelectric sensor calibration, can be performed by extracting the strongest signal and selecting, by the controller 8, the corresponding myoelectric sensor 7 as an appropriate myoelectric sensor 7 to be used in consideration of the output signals of the plurality of myoelectric sensors 7 near the target region 2*h*.

As another method for processing of the myoelectric sensor calibration, instead of extracting only the strongest signal, the arithmetic unit 8*b* of the controller 8 multiplies each of the output signals (1), (2), (3), and (4) by a weighting coefficient, adds the results, and divides the sum by the number of the output signals, so as to calculate an average value of the output signals, as illustrated in FIG. 20. The average value of the output signals calculated in this manner can be obtained as a corrected output signal, and myoelectric sensor calibration can be performed by using the corrected output signal.

Figure 21:
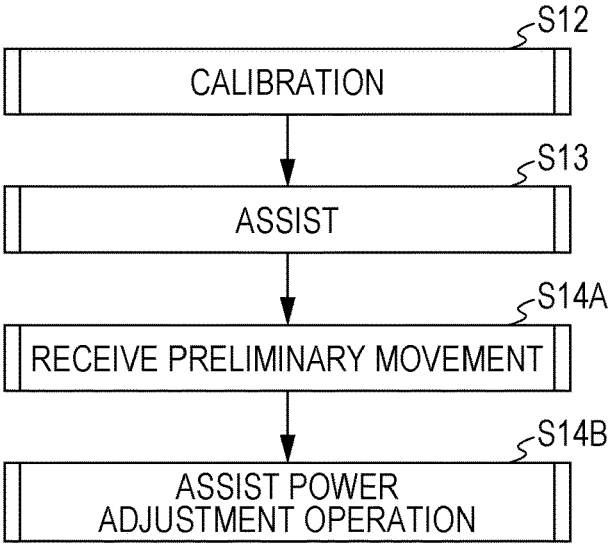
FIG. 21 is a flowchart illustrating a flow of entire operation in wear assist.

For example, the calibration is performed at the timing described below. FIG. 21 is a flowchart illustrating a flow of entire operation in wear assist.

As illustrated in FIG. 21, the wear main body 2 is worn on the user 1 and then myoelectric sensor calibration is performed in the above-described manner in step S12.

Subsequently, in step S13, an assist operation is performed by using the assisting actuators 6. At this time, for example, in a case where there are a plurality of selectable assist operation modes, any one of the modes may be selected by using the input/output device 16. For example, in a case where there are a walking mode and a stairs up/down mode, either of them is selected and then the assist operation is started.

Subsequently, in step S14A, during the assist operation using the assisting actuators 6, a preliminary movement for assist power adjustment is received.

Subsequently, in step S14B, after the preliminary movement has been received, an assist power adjustment operation is performed.

Actuator Calibration

Figure 22:
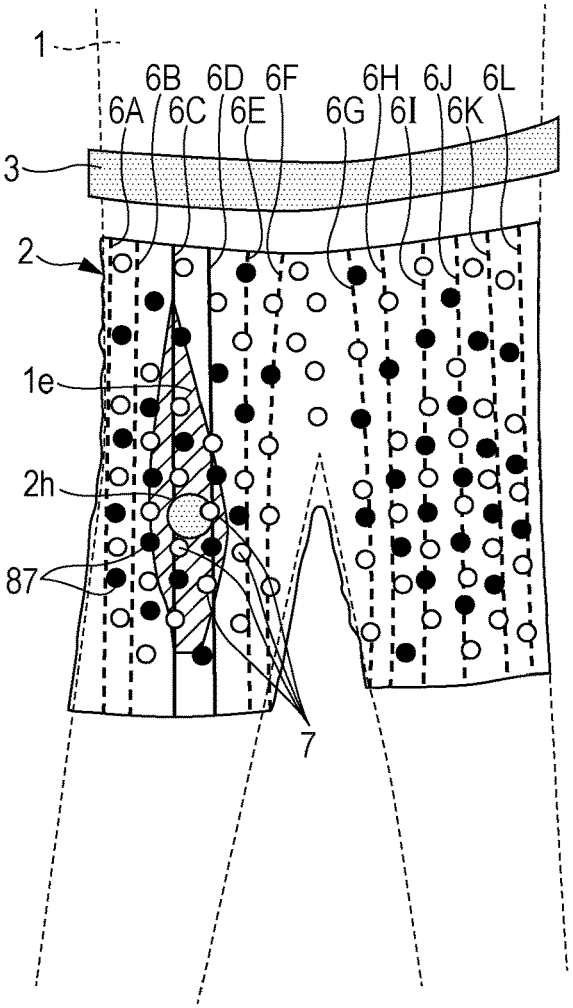
FIG. 22 is an explanatory diagram of the case of selecting different assisting actuators because muscle positions are different among users.
Figure 23:
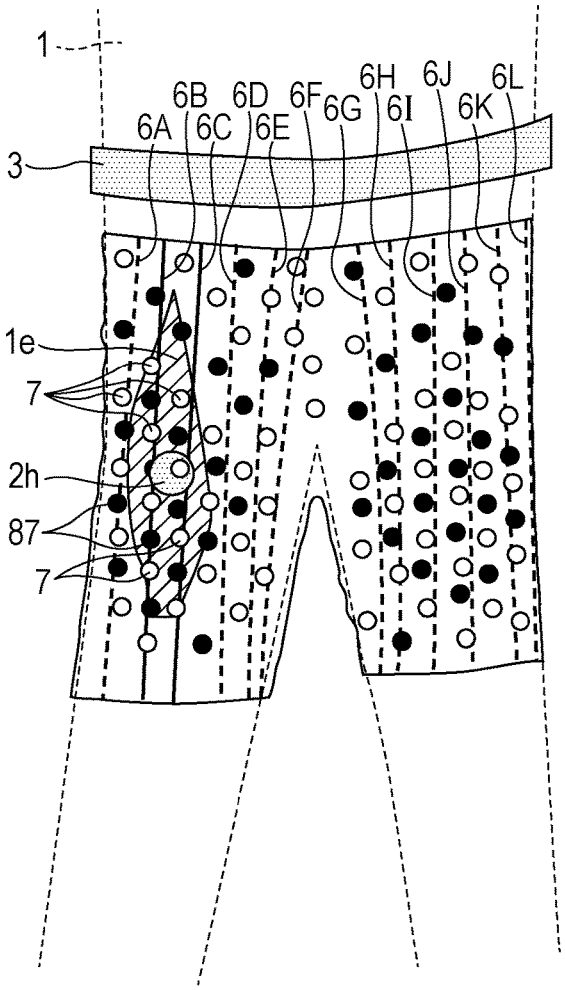
FIG. 23 is an explanatory diagram of the case of selecting different assisting actuators because muscle positions are different among users.
Figure 24:
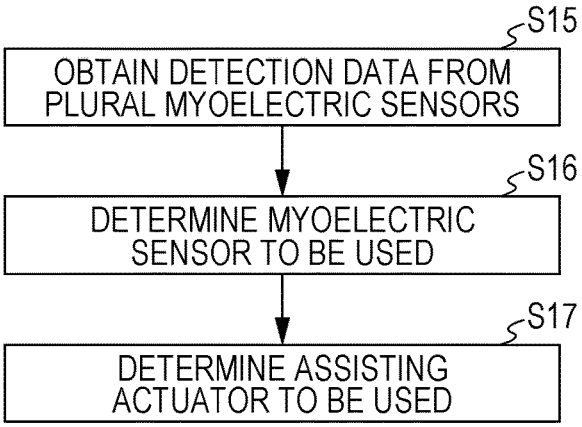
FIG. 24 is a flowchart illustrating a flow of operation of actuator calibration.

FIGS. 22 and 23 are explanatory diagrams in the case of selecting different assisting actuators because the positions of muscles vary among users 1. FIG. 24 is a flowchart illustrating a flow of operation of actuator calibration.

After the myoelectric sensor 7 corresponding to the strongest signal among the output signals of the plurality of myoelectric sensors 7 is extracted, the controller 8 selects the assisting actuator 6 arranged in association with the myoelectric sensor 7 (for example, arranged near the myoelectric sensor 7), and accordingly the assist power of the assisting actuator 6 can be appropriately transmitted from the assisting actuator 6 to the target muscle 1*e*, For example, as illustrated in FIG. 22, for a certain user 1, two assisting actuators 6C and 6D whose signals are stronger than those of the other assisting actuators 6A, 6B, 6E, and 6F may be used, among the assisting actuators 6A to 6F corresponding to the thigh and the vicinity thereof among the assisting actuators 6 arranged in the vertical direction of the wear main body 2. On the other hand, as illustrated in FIG. 23, for another user 1 whose muscle positions are different from those of the certain user 1, two assisting actuators 6B and 6C whose signals are stronger than those of the other assisting actuators 6A, 6D, 6E, and 6F may be used, among the assisting actuators 6A to 6F corresponding to the thigh and the vicinity thereof among the assisting actuators 6 arranged in the vertical direction of the wear main body 2. In this way, the controller 8 is able to detect the position of the muscle 1*b* relative to the wear main body 2 and appropriately select the assisting actuator 6 that is the nearest the muscle 1*b* on the basis of data output from the myoelectric sensors 7. Position information about the individual myoelectric sensors 7 and position information about the assisting actuators 6 corresponding to the individual myoelectric sensors 7 are stored in the storage unit 8*a* of the controller 8 in advance.

The actuator calibration is performed at the timing described below, for example.

As illustrated in FIG. 24, in step S15, the wear main body 2 is worn on the user 1 and then the controller 8 obtains detection data from the plurality of myoelectric sensors 7 near the target region 2*h*.

Subsequently, in step 16, the controller 8 determines, as the myoelectric sensor 7 to be used, the myoelectric sensor 7 corresponding to the strongest signal in the detection data of the plurality of myoelectric sensors 7.

Finally, in step S17, the controller 8 (actuator selecting unit 8*e*) determines, as the assisting actuator 6 to be used, the assisting actuator 6 corresponding to the determined myoelectric sensor 7.

Assisted Walking

FIG. 25 is an explanatory diagram of the process of assisted walking using the assist wear item 4.

As illustrated in FIG. 25, assist by the assisting actuators 6 for the muscles 1*b* on the front and back sides of the right thigh is performed in the following manner, for example, under the control performed by the controller 8. The assist is performed by generating an assist power that is linked to movements of the muscles 1*b* detected by the myoelectric sensors 7. Here, a description will be given of only the assisting actuators 6 corresponding to the muscles 1*b* on the front and back sides of the right thigh for simplicity. The same applies to the assisting actuators 6 corresponding to the muscles 1*b* on the front and back sides of the left thigh.

First, when the state shifts from state G to state A, the user 1 takes a step forward with the right leg and starts waking. At this time, assist by the assisting actuators 6 corresponding to the muscles 1*b* on the front side of the right thigh is increased, whereas assist by the assisting actuators 6 corresponding to the muscles 1*b* on the back side of the right thigh is gradually decreased. To increase assist may mean to cause the assisting actuators 6 to contract when the muscles contract or to cause the assisting actuators 6 to expand when the muscles expand.

Subsequently, when the state shifts from state A to state B, the user 1 starts taking the left leg away from the ground while keeping his/her weight on the right leg to support the body. When the state shifts to state B, assist by the assisting actuators 6 corresponding to the muscles 1*b* on the front side of the right thigh is performed to a maximum extent until the assist value reaches a peak value. At this time, assist by the assisting actuators 6 corresponding to the muscles 1*b* on the back side of the right thigh is performed only to a small extent.

Subsequently, when the state shifts from state B to state C, the user 1 keeps his/her whole weight on the right leg to support the body and the left leg is not in contact with the ground. At this time, assist by the assisting actuators 6 corresponding to the muscles 1*b* on the front side of the right thigh is gradually decreased, and assist by the assisting actuators 6 corresponding to the muscles 1*b* on the back side of the right thigh is performed only to a small extent.

Subsequently, when the state shifts from state C to state D, the user 1 takes a step forward with the left leg and starts waking. At this time, assist by the assisting actuators 6 corresponding to the muscles 1*b* on the front and back sides of the right thigh is performed only to a small extent.

Subsequently, when the state shifts from state D to state E, the user 1 starts taking the right leg away from the ground while keeping his/her weight on the left leg to support the body. When the state shifts from state D to state E, assist by the assisting actuators 6 corresponding to the muscles 1*b* on the front side of the right thigh is increased. At this time, assist by the assisting actuators 6 corresponding to the muscles 1*b* on the back side of the right thigh is performed only to a small extent.

Subsequently, when the state shifts from state E to state F, the user 1 keeps his/her whole weight on the left leg to support the body and the right leg is not in contact with the ground. At this time, assist by the assisting actuators 6 corresponding to the muscles 1*b* on the front side of the right thigh is gradually decreased, and assist by the assisting actuators 6 corresponding to the muscles 1*b* on the back side of the right thigh is performed only to a small extent.

Subsequently, when the state shifts from state F to state G, the user 1 takes a step forward with the right leg and starts waking. When the state shifts from state F to state G, assist by the assisting actuators 6 corresponding to the muscles 1*b* on the back side of the right thigh is increased to a maximum extent until the assist value reaches the peak value. At this time, assist by the assisting actuators 6 corresponding to the muscles 1*b* on the front side of the right thigh is performed only to a small extent.

In this assist example, the assist power is gradually changed in conjunction with the movements of the muscles 1*b*, but the embodiment is not limited thereto, and a pulsed assist power may be generated at the timing when assist is necessary. In a case where assist is performed only slightly, no assist may be performed.

Assist Phase

Figure 26A:
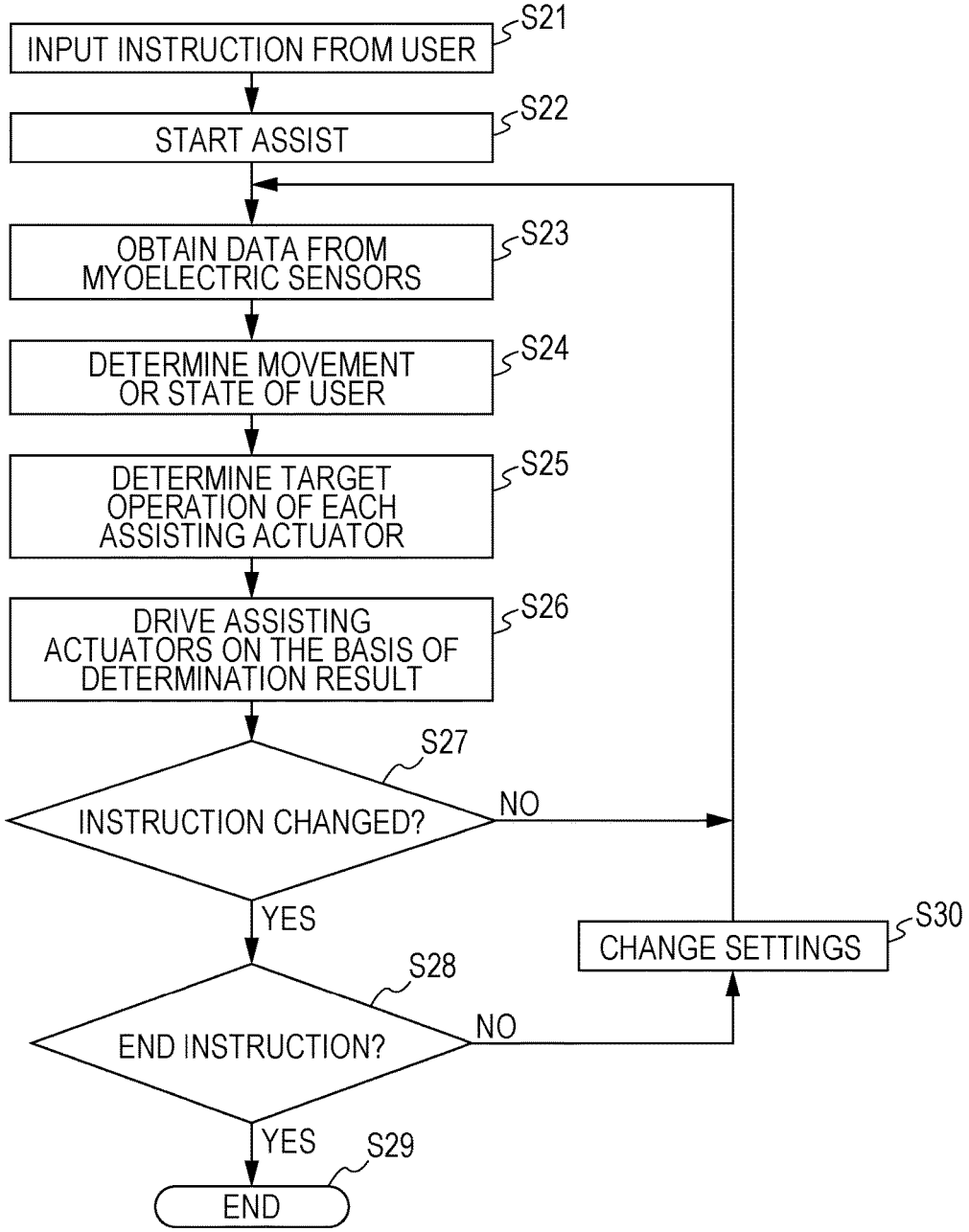
FIG. 26A is a flowchart of control of driving assisting actuators performed by a controller.

FIG. 26A is a flowchart of drive control of the assisting actuators 6 performed by the controller 8.

As illustrated in FIG. 26A, drive control of the assisting actuators 6 is performed by the controller 8 in the following manner. Here, the assisting actuators 6 to be used for assist vary depending on the walking state of the user 1. Pieces of information about movements of the muscles 1*b* can be obtained from the corresponding myoelectric sensors 7. As a result of comparing the pieces of information with walking patterns of a human by the controller 8, the walking state of the user 1 can be determined. Accordingly, the controller 8 is capable of selecting the assisting actuators 6 corresponding to the muscle 1*b* to be moved and performing assist in synchronization with the muscle 1*b*.

First, in step S21, the user 1 inputs an instruction about a walking mode or the like by using the input/output device 16.

Subsequently, in step S22, the controller 8 starts assist. That is, the controller 8 starts drive control of the assisting actuators 6 on the basis of a program stored in the storage unit 8*a* of the controller 8 in advance.

Subsequently, in step S23, the controller 8 obtains data from all the myoelectric sensors 7 before actually starting drive control of the assisting actuators 6.

Subsequently, in step S24, on the basis of the data obtained by the controller 8 from all the myoelectric sensors 7, the controller 8 determines the movement or state of the user 1. For example, the controller 8 determines whether the user 1 is now walking, and, if the user 1 is now walking, the controller 8 determines a walking state.

Subsequently, in step S25, on the basis of the determined movement or state of the user 1, the controller 8 determines the target operation of each assisting actuator 6. The target operation of the assisting actuator 6 may be when and how much the assisting actuator 6 is allowed to contract or when and how much the assisting actuator 6 is allowed to expand.

Subsequently, in step S26, on the basis of the target operations determined in step S25, the controller 8 performs drive control of the assisting actuators 6.

Subsequently, in step S27, the controller 8 determines whether or not an instruction has been changed by using the input/output device 16 or the like. If the controller 8 determines that an instruction has been changed, the processing proceeds to step S28. If the controller 8 determines that an instruction has not been changed, the processing returns to step S23.

Subsequently, in step S28, the controller 8 determines whether or not the change of instruction is an end instruction. If the controller 8 determines that the change of instruction is not an end instruction, the processing proceeds to step S30. If the controller 8 determines that the change of instruction is an end instruction, the processing proceeds to step S29.

Subsequently, in step S29, the series of operation processing ends.

In step S30, the controller 8 changes the settings on the basis of the change of instruction and then the processing returns to step S23.

Detailed Description of Operation of Preliminary Movement/Command Input Movement Determining Unit Next, a detailed description will be given of determination of a preliminary movement and a command input movement performed by the preliminary movement/command input movement determining unit 8*h*.

During a period in which the assisting actuators 6 are being driven to expand and contract by the driving unit 8*d*, detection results indicating a first contact as a preliminary movement are received from a plurality of pressure sensors 87. The period in which the assisting actuators 6 are being driven to expand and contract is actually a period in which the assisting actuators 6 are being driven to expand and contract or a period after a drive start signal for the assisting actuators 6 has been input. Specifically, when the drive start signal for the assisting actuators 6 is input from the driving unit 8*d* to the preliminary movement/command input movement determining unit 8*h*, the preliminary movement/command input movement determining unit 8*h* determines that the assisting actuators 6 are being driven to expand and contract.

The period of reception is limited for the following reason.

In many cases, when the user 1 wants to increase or decrease the driving power of expansion/contraction driving of the assisting actuators 6, the user 1 wants to fine-tune assist power when the user 1 is wearing the wear main body 2 and performing movements while receiving the assist power from the assist wear item 4. In other words, when the user 1 is not receiving assist power from the assist wear item 4, the user 1 is less likely to want to fine-tune the assist power, that is, want to increase or decrease the driving power of expansion/contraction driving of the assisting actuators 6.

In the embodiment, a detection result indicating a first contact received while the assisting actuators 6 are driven to expand and contract, that is, while the user 1 is receiving assist power from the assist wear item 4. Accordingly, a detection result indicating a first contact is received while the user 1 is receiving assist power from the assist wear item 4 when the user 1 wants to fine-tune the assist power. As a result, in a situation where the user 1 is less likely to want to increase or decrease the driving power of expansion/contraction driving of the assisting actuators 6, reception of a detection result indicating a first contact is prevented, and accordingly an increase or decrease in the driving power not intended by the user 1 is prevented.

Whether or not a detection result is a detection result indicating a first contact as a preliminary movement and whether or not a detection result is a detection result indicating a second contact as a command input movement are determined on the basis of whether or not the movement at the time is a movement that can be accidentally performed by the user 1. This is because, for example, a movement of the user 1 of lightly tapping a portion of the wear main body 2 once or twice may be determined as both a movement of the user 1 in which the user's hand accidentally touches the portion and a movement of tapping the portion once or twice as an intended preliminary movement.

Thus, if the first threshold TH1 for determining a preliminary movement and the second threshold TH2 for determining a command input movement are set to a value that is equal to or larger than several times a pressure value detected when the user accidentally touches a portion, an increase or decrease in the driving power of expansion/contraction driving of the assisting actuators 6 not intended by the user 1 can be prevented. Alternatively, a preliminary movement may be formed of a plurality of touches, which is a movement that is less likely to be performed accidentally.

Specific examples of the preliminary movement performed by the user 1 include the following.

Figure 26B:
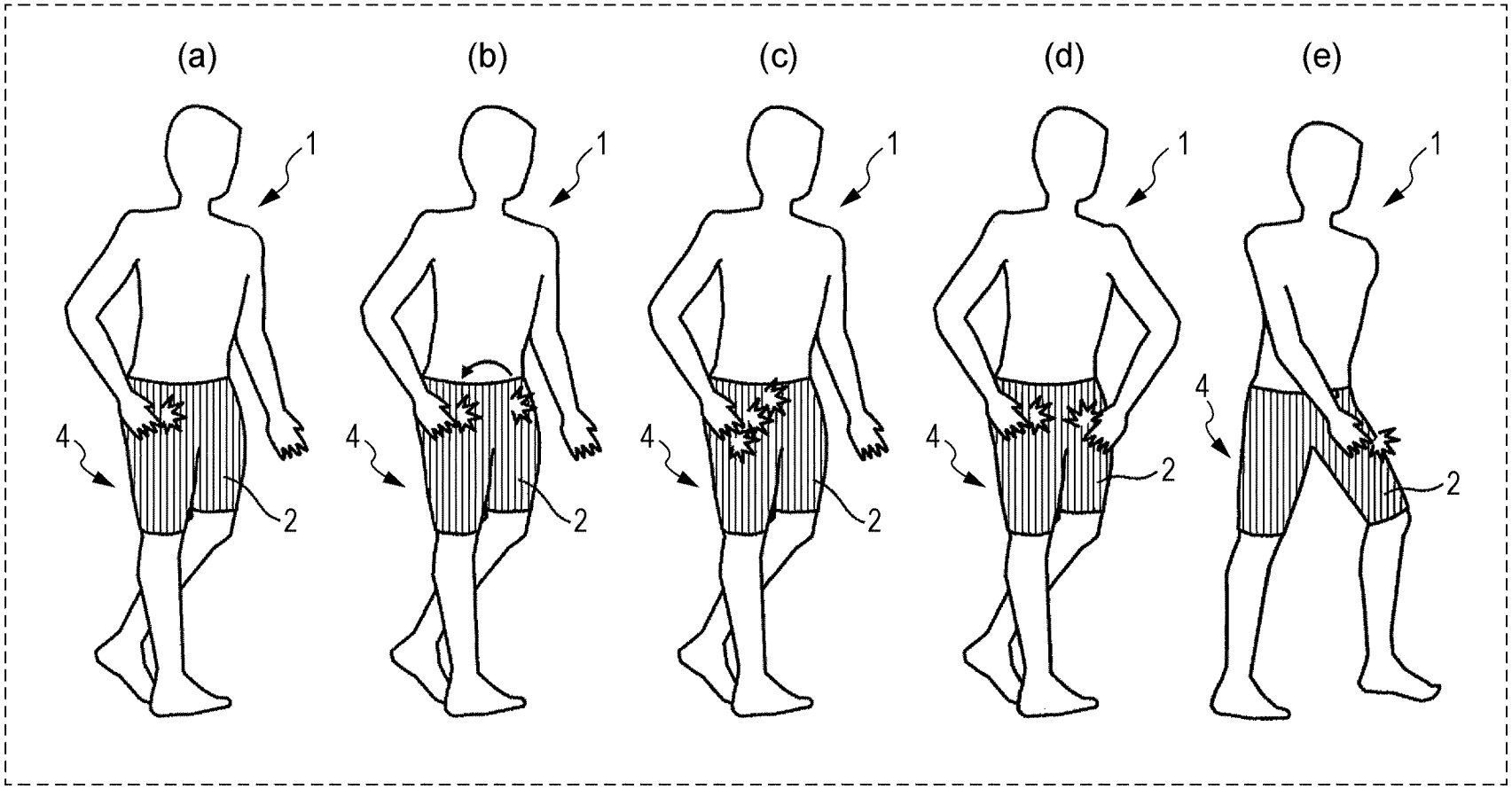
FIG. 26B is an explanatory diagram illustrating variation of a preliminary movement.

An example of the preliminary movement using one hand of the user 1 is movement in which the same position in the waist region is strongly tapped twice or more and a certain threshold (the first threshold and the second threshold) or more is output from the pressure sensors 87 at the same position twice or more (see part (a) of FIG. 26B). At this time, the time interval between the outputs may be set to a certain time interval (for example, one second) or less so as to prevent misrecognition more reliably. Alternatively, the outputs may be performed in certain rhythm (for example, the time interval between the first output and the second output is different from the time interval between the second output and the third output).

Another example of the preliminary movement using one hand of the user 1 is that the same position or different positions are tapped a certain number of times (twice or more) and as a result a certain threshold (the first threshold and the second threshold) or more is output from the pressure sensors 87 at the same position or different positions the certain number of times. At this time, the order of the tapped (or swiped) positions may be determined (see part (b) of FIG. 26B) so as to prevent misrecognition more reliably.

Another example of the preliminary movement using one hand of the user 1 is that a movement of continuously and strongly pressing the same position or different positions for a certain time period is repeated twice or more and as a result a certain threshold (the first threshold and the second threshold) or more is output from the pressure sensors 87 at the same position or different positions twice or more in a certain time period or more.

Another example of the preliminary movement using one hand of the user 1 is that a certain position is tapped in specific rhythm (see part (c) of FIG. 26B) and as a result a certain threshold (the first threshold and the second threshold) or more is output from the pressure sensors 87 at a certain position at a certain interval within a certain time period.

Another example of the preliminary movement using one hand of the user 1 is a combination with a movement of the body of the user 1 (for example, a portion of a leg is tapped during a leg lift movement (see part (e) of FIG. 26B)) and as a result a certain threshold (the first threshold and the second threshold) or more is output from the pressure sensors 87 at the position where an operating assisting actuator 6 is located or the vicinity thereof twice or more.

An example of the preliminary movement using both hands of the user 1 is that a movement of simultaneously tapping once different positions by both hands or continuously pressing the different positions by both hands for a certain time period is performed (see part (d) of FIG. 26B) and as a result simultaneous output of a certain threshold (the first threshold and the second threshold) or more from a plurality of pressure sensors 87 at the different positions occurs twice, or simultaneous output of the certain threshold (the first threshold and the second threshold) or more occurs twice in a certain time period or more.

Another example of the preliminary movement using both hands of the user 1 is that different positions are sequentially tapped by both hands (once by each hand) within a certain time period or the different positions are continuously pressed by both hands for a certain time period or more, and as a result a certain threshold (the first threshold and the second threshold) or more is output from a plurality of pressure sensors 87 at different positions within a certain time period or in the certain time period or more.

A command input movement is performed by making a touch within the first time period t1 from a preliminary movement so as to prevent misrecognition. With a method similar to the above-described preliminary movement, misrecognition can be prevented more reliably.

The above-described preliminary movements and command input movements are merely examples, and a plurality of methods can be used in combination. In any of the movement examples, detection of a first contact as a preliminary movement and detection of a second contact as a command input movement are performed by using the processing method described above.

FIG. 27 is a graph for describing the relationship among a sensor signal, which is an output from one pressure sensor 87, the first threshold TH1, the second threshold TH2, the first time period t1, and the second time period t2. Note that, in this example, the value of the first threshold TH1 is the same as the value of the second threshold TH2.

For example, if the preliminary movement/command input movement determining unit 8*h* determines that the output from the same pressure sensor 87 is a certain threshold (the first threshold TH1 in FIG. 27) or larger (see part (b) of FIG. 27), the preliminary movement/command input movement determining unit 8*h* determines that a first contact has been detected and a preliminary movement has been input. An example of the movement corresponding to the first contact in FIG. 27, that is, a preliminary movement, is a movement in which the user 1 taps a certain position once with one hand with a power that is the first threshold TH1 or larger.

If the preliminary movement/command input movement determining unit 8*h* determines that the output from the pressure sensor 87 is a certain threshold (the second threshold TH2 in FIG. 27) or larger within a certain time period (the first time period t1 in FIG. 27) after the preliminary movement has been input (see part (c) of FIG. 27), the preliminary movement/command input movement determining unit 8*h* determines that a second contact has been detected once. At this time, if the preliminary movement/command input movement determining unit 8*h* determines that the output from the pressure sensor 87 is the certain threshold (the second threshold TH2 in FIG. 27) or larger within a certain time period (the second time period t2 in FIG. 27) after the first detection of the second contact (see parts (d) and (e) of FIG. 27), the preliminary movement/command input movement determining unit 8*h* determines that a second contact has been effectively detected once more. That is, the preliminary movement/command input movement determining unit 8*h* counts the number of effective detections of the second contact within the second time period t2. Here, each of the first time period t1 and the second time period t2 may be about 3 seconds, for example. If the time periods are too long, there is a possibility that incorrect input occurs due to an unintended contact by the user 1.

After the second time period t2 has elapsed, the preliminary movement/command input movement determining unit 8*h* determines that a command input movement has been performed, and transmits setting information about the driving power corresponding to the number of times of detection of the second contact to the determining unit 8*c*. An example of the movement corresponding to the second contact in FIG. 27, in other words, a command input movement, is a movement in which the user 1 taps the same position or different positions a certain number of times with one hand with a power that is the second threshold TH2 or larger within the second time period t2.

Figure 28:
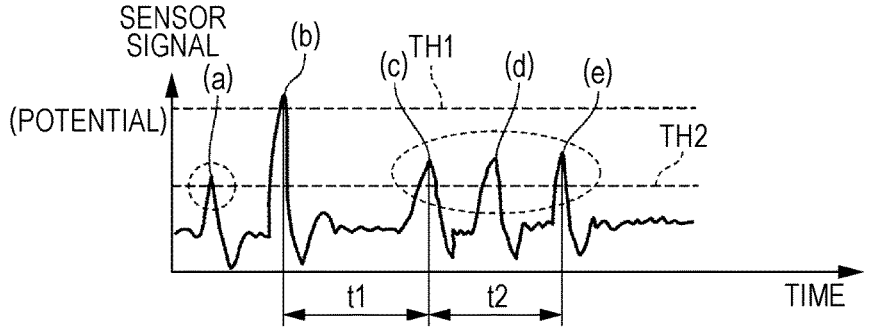
FIG. 28 is a graph for describing a relationship among a sensor signal which is an output from one pressure sensor, a first threshold, and a second threshold.

Another example will be described in which the first threshold TH1 is different from the second threshold TH2. FIG. 28 is a graph for describing a relationship among a sensor signal which is an output from one pressure sensor 87, the first threshold TH1, and the second threshold TH2. In this example, if the preliminary movement/command input movement determining unit 8*h* determines that an output from the same pressure sensor 87 is a certain threshold (the first threshold TH1 in FIG. 28) or larger (see part (b) of FIG. 28), the preliminary movement/command input movement determining unit 8*h* determines that a first contact has been detected and a preliminary movement has been input. If the preliminary movement/command input movement determining unit 8*h* determines that the output from the pressure sensor 87 is smaller than the certain threshold (the first threshold TH1 in FIG. 28, see part (a) of FIG. 28), the preliminary movement/command input movement determining unit 8*h* determines that a first contact has not been detected even if the output is another threshold (the second threshold TH2 in FIG. 28) or larger.

If the preliminary movement/command input movement determining unit 8*h* determines that the output from the pressure sensor 87 is a certain threshold (the second threshold TH2 in FIG. 28) or larger within a certain time period (the first time period t1 in FIG. 28) after the preliminary movement has been input (see part (c) of FIG. 28), the preliminary movement/command input movement determining unit 8*h* determines that a second contact has been detected once. At this time, if the preliminary movement/command input movement determining unit 8*h* determines that the output from the pressure sensor 87 is the certain threshold (the second threshold TH2) or larger within a certain time period (the second time period t2) after the first detection of the second contact (see parts (d) and (e) of FIG. 28), the preliminary movement/command input movement determining unit 8*h* determines that a second contact has been detected once more. That is, the preliminary movement/command input movement determining unit 8*h* counts the number of times of detection of the second contact within the second time period t2. After the second time period t2 has elapsed, the preliminary movement/command input movement determining unit 8*h* determines that a command input movement has been performed and transmits the number of times of detection of the second contact to the determining unit 8*c*.

Figure 29:
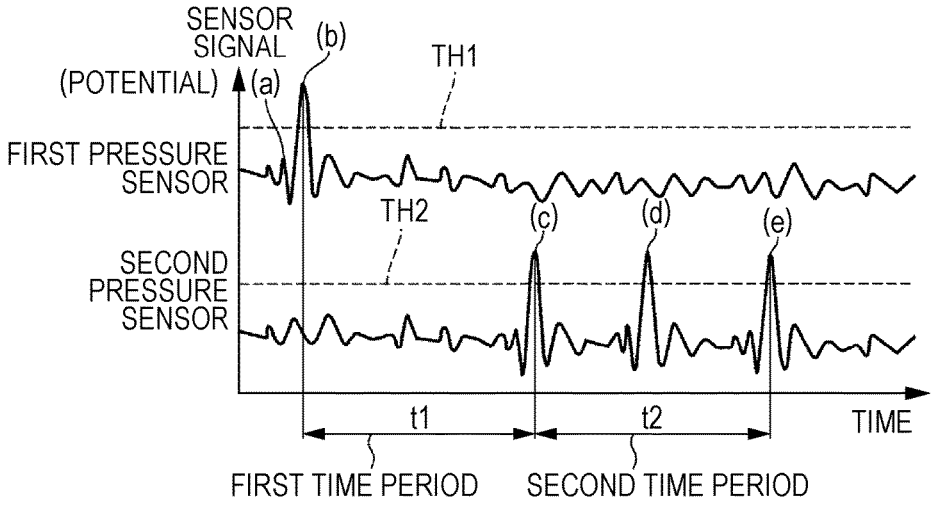
FIG. 29 is a graph for describing a relationship among sensor signals which are outputs from two pressure sensors, a first time period, a second time period, and thresholds.

Another example will be described in which the outputs from two different pressure sensors 87 are used. FIG. 29 is a graph for describing a relationship among sensor signals which are outputs from two pressure sensors 87 (the first pressure sensor 87*a* and the second pressure sensor 87*b* in FIG. 3), the first time period t1, the second time period t2, the first threshold TH1, and the second threshold TH2. In this example, if the preliminary movement/command input movement determining unit 8*h* determines that the output from the first pressure sensor 87*a* among the two pressure sensors 87, that is, the first pressure sensor 87*a* and the second pressure sensor 87*b*, is a certain threshold (the first threshold TH1 in FIG. 29) or larger (see part (b) of FIG. 29), the preliminary movement/command input movement determining unit 8*h* determines that a first contact has been detected and a preliminary movement has been input. If the preliminary movement/command input movement determining unit 8*h* determines that the output from the first pressure sensor 87*a* is smaller than the certain threshold (the first threshold TH1 in FIG. 29, see part (a) of FIG. 29), the preliminary movement/command input movement determining unit 8*h* determines that a first contact has not been detected even if the output is another threshold (the second threshold TH2 in FIG. 29) or larger.

If the preliminary movement/command input movement determining unit 8*h* determines that the output from the second pressure sensor 87*b* is a certain threshold (the second threshold TH2 in FIG. 29) or larger within a certain time period (the first time period t1 in FIG. 29) after the preliminary movement has been input (see part (c) of FIG. 29), the preliminary movement/command input movement determining unit 8*h* determines that a second contact has been detected once. At this time, if the preliminary movement/command input movement determining unit 8*h* determines that the output from the second pressure sensor 87*b* is the certain threshold (the second threshold TH2) or larger within a certain time period (the second time period t2) after the first detection of the second contact (see parts (d) and (e) of FIG. 29), the preliminary movement/command input movement determining unit 8*h* determines that a second contact has been detected once more. That is, the preliminary movement/command input movement determining unit 8*h* counts the number of times of detection of the second contact within the second time period t2. After the second time period t2 has elapsed, the preliminary movement/command input movement determining unit 8*h* determines that a command input movement has been performed and transmits setting information about the driving power corresponding to the number of times of detection of the second contact at the time to the determining unit 8*c*.

Figure 30:
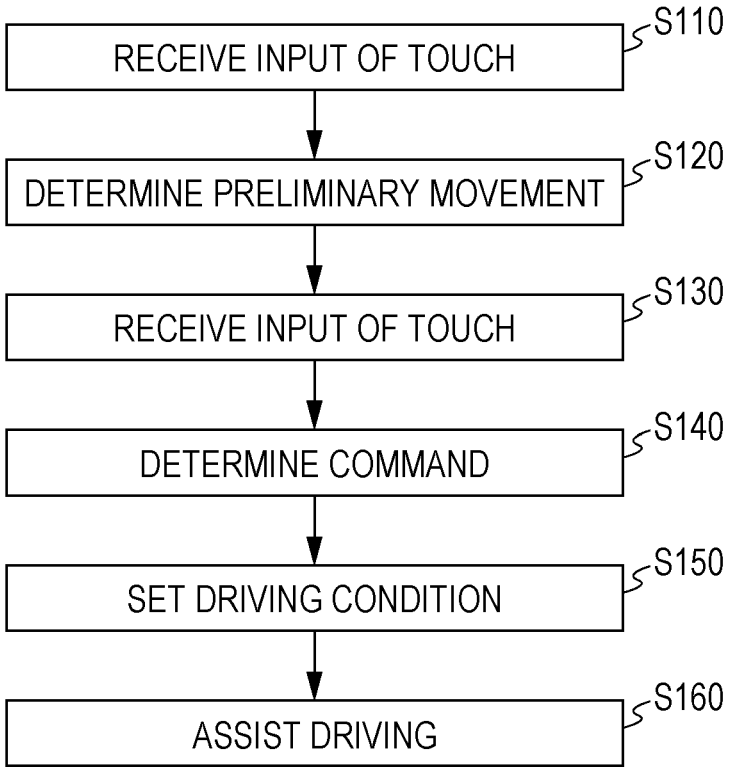
FIG. 30 is a flowchart illustrating processing of determination of a preliminary movement and a command input movement, and assist driving performed by a preliminary movement/command input movement determining unit and a driving unit.

FIG. 30 illustrates processing of preliminary movement/command input movement determination and assist driving, which is performed by the preliminary movement/command input movement determining unit 8*h* and the driving unit 8*d*.

Figure 31:
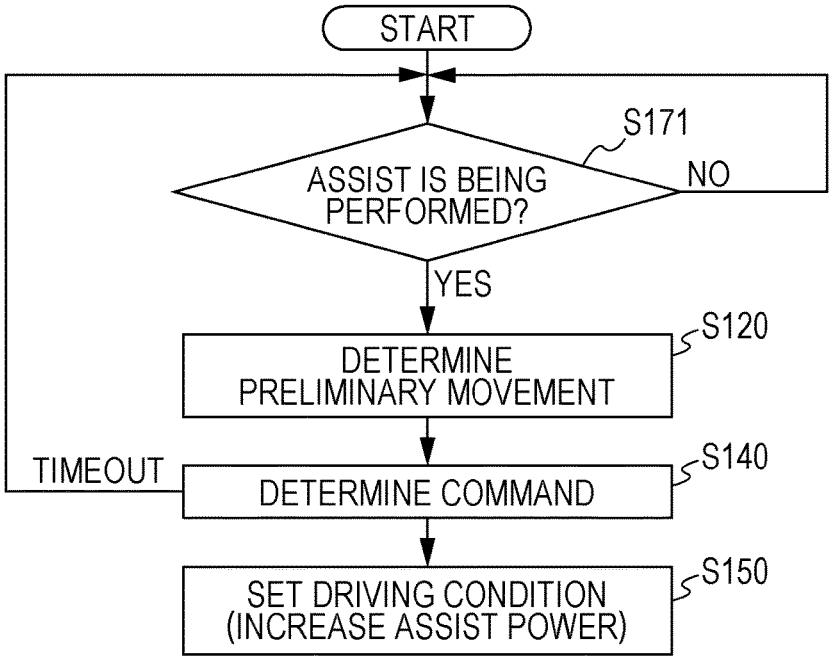
FIG. 31 is a flowchart illustrating processing performed by the preliminary movement/command input movement determining unit.
Figure 32:
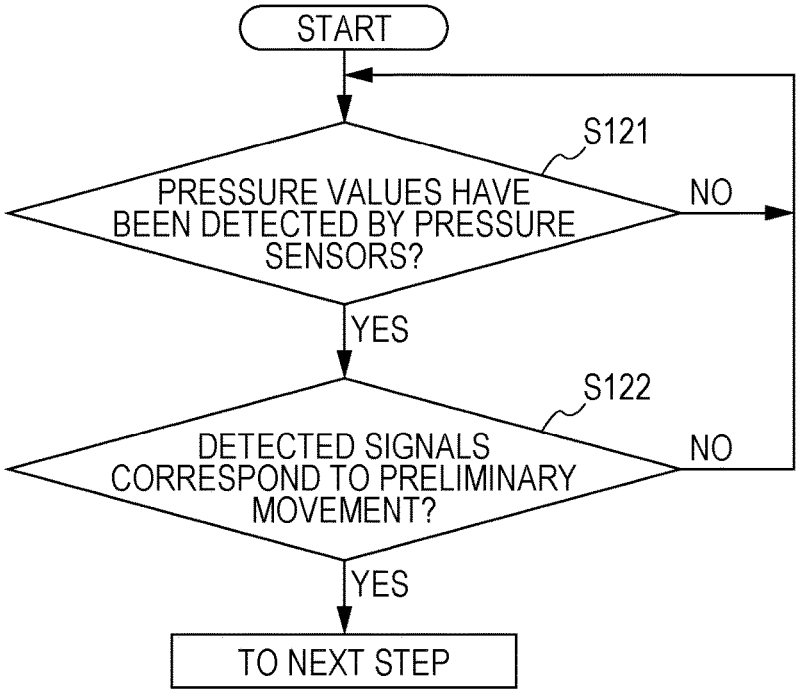
FIG. 32 is a flowchart illustrating processing for a preliminary movement in the processing performed by the preliminary movement/command input movement determining unit.

FIG. 31 illustrates processing performed by the preliminary movement/command input movement determining unit 8*h*. FIG. 32 illustrates processing for a preliminary movement in the processing performed by the preliminary movement/command input movement determining unit 8*h*, FIG. 33 illustrates processing for a command input movement in the processing performed by the preliminary movement/command input movement determining unit 8*h*.

First, FIG. 30 will be described.

In step S110, the user 1 inputs a touch, and accordingly sensor signals are output from the pressure sensors 87.

Subsequently, in step S120, the preliminary movement/command input movement determining unit 8*h* determines whether or not the output of a pressure sensor 87 (a first pressure value (sensor signal)) obtained in step S110 corresponds to a preliminary movement. The processing proceeds to the next step only if the output of the pressure sensor 87 (the first pressure value (sensor signal)) corresponds to a preliminary movement.

Subsequently, in step S130, the user 1 performs touch input, and accordingly a sensor signal is output from the pressure sensor 87.

Subsequently, in step S140, the preliminary movement/command input movement determining unit 8*h* determines whether or not the output of the pressure sensor 87 (a second pressure value (sensor signal)) obtained in step S130 corresponds to a command input movement. The processing proceeds to the next step only if the output of the pressure sensor 87 (the second pressure value (sensor signal)) represents a command.

Subsequently, in step S150, the preliminary movement/command input movement determining unit 8*h* sets a driving condition on the basis of the information stored in the storage unit 8*a* and determination result information.

Subsequently, in step S160, the driving condition is output from the preliminary movement/command input movement determining unit 8*h* to the driving unit 8*d* via the determining unit 8*c* and the actuator selecting unit 8*e*, and the driving unit 8*d* drives the assisting actuators 6 on the basis of the driving condition. As a result, an increase or decrease in the assist power, that is, the driving power of expansion/contraction driving of the assisting actuators 6, is adjusted.

Next, processing performed by the preliminary movement/command input movement determining unit 8*h* will be described with reference to FIG. 31.

In step S171, the preliminary movement/command input movement determining unit 8*h* determines, on the basis of a signal that is input from the driving unit 8*d* and indicates whether or not the assisting actuators 6 are being driven, whether or not assist is being performed by the assisting actuators 6. If assist is being performed, the processing proceeds to step S120. If assist is not being performed, a waiting state continues until assist starts.

In step S120, the preliminary movement/command input movement determining unit 8*h* performs determination of a preliminary movement. The processing proceeds to step S140 only if the preliminary movement/command input movement determining unit 8*h* determines that a preliminary movement has been performed.

In step S140, the preliminary movement/command input movement determining unit 8*h* performs a command determination operation of determining whether or not a command input movement has been performed within a certain time period. The processing proceeds to step S150 only if the preliminary movement/command input movement determining unit 8*h* determines that a command input movement has been performed within the certain time period. If the preliminary movement/command input movement determining unit 8*h* determines that a command input movement has not been performed within the certain time period, the processing returns to step S171.

In step S150, as described above, the preliminary movement/command input movement determining unit 8*h* sets a driving condition on the basis of the information stored in the storage unit 8*a* and the determination result information.

Next, processing for a preliminary movement performed by the preliminary movement/command input movement determining unit 8*h* will be described with reference to FIG. 32.

In step S121 it is determined whether or not the first pressure value (sensor signal) output from the pressure sensor 87 in step S110 has been received and detected by the preliminary movement/command input movement determining unit 8*h*. If the first pressure value has not been detected, a waiting state continues until it is detected. If the first pressure value (sensor signal) output from the pressure sensor 87 has been received and detected by the preliminary movement/command input movement determining unit 8*h*, the processing proceeds to step S122.

Subsequently, in step S122, the preliminary movement/command input movement determining unit 8*h* determines whether or not the first pressure value (sensor signal) output from the pressure sensor 87 in step S110 is the first threshold TH1 or larger. If the preliminary movement/command input movement determining unit 8*h* determines that the first pressure value detected by the pressure sensor 87 is the first threshold TH1 or larger (see part (b) of FIG. 27), the preliminary movement/command input movement determining unit 8*h* receives the detection result indicating the first pressure value as a detection result indicating a first contact, and the processing proceeds to step S130. If the preliminary movement/command input movement determining unit 8*h* determines that the first pressure value detected by the pressure sensor 87 is smaller than the first threshold TH1 (see part (a) of FIG. 27), the processing returns to step S121.

In a case where a preliminary movement is formed of a plurality of touches, the time interval of the touches, the touch position, or the touch order may be compared with the pattern stored in the storage unit 8*a*, in addition to performing the comparison with the thresholds, so as to determine whether or not a preliminary movement has been performed.

Next, processing for a command input movement performed by the preliminary movement/command input movement determining unit 8*h* will be described with reference to FIG. 33.

In step S141, the waiting time is reset after determination of the preliminary movement in step S120, and measurement of the first time period t1 is started.

Subsequently, in step S142, if the preliminary movement/command input movement determining unit 8*h* determines that the second pressure value of the pressure sensor 87 output in step S130 is equal to or larger than the second threshold TH2 within the first time period t1 (see part (c) of FIG. 27), the detection result indicating the second pressure value is received as a detection result indicating a second contact (it is determined that a command input movement has been performed), and the processing proceeds to step S144. If the preliminary movement/command input movement determining unit 8*h* determines that the second pressure value detected by the pressure sensor 87 is smaller than the second threshold TH2, the processing returns to step S171 (see step S147). If the preliminary movement/command input movement determining unit 8*h* determines that determination is not able to be made within the first time period t1, the processing returns to step S171 (see step S147).

Subsequently, in step S144, the waiting time is reset and measurement of the second time period t2 is started.

Subsequently, in step S145, if the preliminary movement/command input movement determining unit 8*h* determines that the second pressure value of the pressure sensor 87 output in step S130 is equal to or larger than the second threshold TH2 within the second time period t2 (see part (d) of FIG. 27), the detection result indicating the second pressure value is received as a detection result indicating a second contact (it is determined that a command input movement has been performed), and the preliminary movement/command input movement determining unit 8*h* counts the number of sensors related to the detection of the second contact in step S146. After that, determination in step S145 is performed again. If the preliminary movement/command input movement determining unit 8*h* determines that the second pressure value detected by the pressure sensor 87 and output in step S130 is smaller than the second threshold TH2, the processing stays in step S145, and the preliminary movement/command input movement determining unit 8*h* determines whether or not the next pressure value is equal to or larger than the second threshold TH2. The processing proceeds to step S148 only if the preliminary movement/command input movement determining unit 8*h* determines that the second time period t2 has elapsed.

In step S148, the number of pressure sensors 87 that perform detection in step S142, that is, one, is added to the total number of sensors counted in step S146 if the total number exists. If the total number of sensors counted in step S146 does not exist, the number of pressure sensors 87 that perform detection in step S142, that is, one, is calculated as the counted number of sensors. On the basis of the information calculated in this manner and the relationship information between the total number of sensors stored in the storage unit 8*a* and an increase in the driving power, the preliminary movement/command input movement determining unit 8*h* transmits setting information about an increase in the driving power to the determining unit 8*c*. After that, the processing proceeds to step S150.

In this example, in response to reception of a detection result indicating a second contact (a command input movement has been performed), setting information is updated to increase the driving power of expansion/contraction driving of the assisting actuators 6 in accordance with the number of times of reception. An example of this is illustrated in FIG. 34. FIG. 34 is an explanatory diagram in the form of a table illustrating a relationship between the numbers of touches and set values of assist power in the case of increasing the assist power of assisting actuators 6 in proportion to the number of times a second contact has been detected. FIG. 34 indicates that the preliminary movement/command input movement determining unit 8*h* increases the assist power of the assisting actuators 6 by 10% if the number of times a second contact has been detected is one, and increases the assist power of the assisting actuators 6 by 20% if the number of times a second contact has been detected is two.

The preliminary movement/command input movement determining unit 8*h* or the receiving unit 8*f* in the third modification example described below controls driving of the assisting actuators 6 on the basis of information indicating detection of a second contact and the number of times of detection, and information indicating the relationship between the number of times stored in the storage unit 8*a* and the set value of assist power (see the table showing the relationship between the numbers of touches and set values of assist power in FIG. 34). Specifically, the preliminary movement/command input movement determining unit 8*h* or the command determination controller 88 in the third modification example described below controls an increase or decrease in the driving power of expansion/contraction driving of the assisting actuators 6 on the basis of the number of times a second contact has been detected by the pressure sensor 87 after the preliminary movement/command input movement determining unit 8*h* or the receiving unit 8*f* has received a detection result indicating a first contact. More specifically, the preliminary movement/command input movement determining unit 8*h* or the command determination controller 88 controls an increase or decrease in the driving power of expansion/contraction driving of the assisting actuators 6 on the basis of the number of times a contact has been detected within the second time period t2 after a second contact having a second pressure value which is the second threshold TH2 or larger is detected by the pressure sensor 87 within the first time period t1 after the preliminary movement/command input movement determining unit 8*h* or the receiving unit 8*f* receives a detection result indicating a first pressure value which is the first threshold TH1 or larger.

Here, as an example, the assist power is increased by a certain amount if a command input movement is performed. The method for adjusting the assist power is not limited thereto.

As an example of controlling an increase or decrease in the driving power of expansion/contraction driving of the assisting actuators 6, the preliminary movement/command input movement determining unit 8*h* is capable of increasing the assist power of the assisting actuators 6 in proportion to the number of times a second detection has been detected. In this way, the assist power is increased in proportion to the number of times a second contact has been detected, and thus, if the user 1 wants to increase the assist power, the user 1 only has to touch the wear main body 2 until a desired assist power is obtained, and thus an increase or decrease in the driving power of the expansion/contraction driving of the assisting actuators 6 can be adjusted more easily.

Finally, the method for avoiding incorrect input of a command according to the embodiment will be described. First, in the already described method, a detection result indicating a first contact is received only during expansion/contraction driving of the assisting actuators 6. Only in a case where the user 1 wants to fine-tune the assist power, the user 1 is allowed to perform a touch input. In determination of a preliminary movement or a command input movement, a threshold which is equal to or larger than a pressure value that is detected in response to an unintended touch is set and a pressure value is detected. Further, the preliminary movement is formed of a plurality of touches, which is a movement that is less likely to be performed accidentally.

If a contact is detected within a certain time period after a first contact as a preliminary movement is detected, the contact is determined to be command input, which is regarded as detection of a first contact. If the first contact is a contact that is not intended by the user 1, there is a low possibility that a second contact as the next contact is performed within the first time period t1. That is, if the user 1 wants to change (increase or decrease) the driving power of expansion/contraction driving of the assisting actuators 6, it is natural that the time interval between the first contact and the second contact is short to some extent. Thus, in the embodiment, it is determined that a command input has been performed only in a case where a contact is detected within the first time period t1 from the time point when a first contact is detected. Accordingly, the driving power of expansion/contraction driving of the assisting actuators 6 is not changed (increased or decreased) by a second contact that is not detected within the first time period t1. Further, it can be determined whether or not a first contact is a contact intended by the user 1.

According to the embodiment, an increase or decrease in the driving power of expansion/contraction driving of the assisting actuators 6 is controlled on the basis of the number of times a second contact has been detected, and thus a second contact is detected a plurality of times, for example. Here, in a case where the time interval between detections of individual second contacts is long to some extent, if the assist wear item 4 receives a contact after the user 1 has finished a second contact, the driving power of expansion/contraction driving of the assisting actuators 6 may be changed (increased or decreased). Thus, according to the embodiment, the second time period t2 is set to a few seconds to prevent incorrect input. The second time period t2 may be shorter than the first time period t1. Further, in a case where a second contact is detected a plurality of times, the time interval between two second contacts that are sequentially performed may be set to be shorter than the first time period t1. Examples of the time interval between two second contacts that are sequentially performed are the time interval between the contact indicated by (c) and the contact indicated by (d) illustrated in FIG. 27, 28, or 29, or the time interval between the contact indicated by (d) and the contact indicated by (e) illustrated in FIG. 27, 28, or 29. The earliest time point where the signal level exceeds a threshold may be regarded as an effective contact.

Advantages

According to the above-described embodiment, the following advantages can be obtained.

If the driving power of expansion/contraction driving of the assisting actuators 6 is increased or decreased by using the information terminal 15, the input/output device 16, or the like, it is necessary to specify a portion where the driving power is to be increased or decreased or an amount of increase or decrease in the driving power by using the information terminal 15, the input/output device 16, or the like every time the driving power is to be increased or decreased, which is inconvenient.

According to the above-described embodiment, in a case where a detection result indicating a second contact is received after reception of a detection result indicating a first contact, the driving power of expansion/contraction driving of the assisting actuators 6 is increased or decreased. Accordingly, the user 1, which is an example of a living body that wears the wear main body 2, is able to increase or decrease the driving power of expansion/contraction driving of the assisting actuators 6 only by touching the wear main body 2, that is, without using the information terminal 15, the input/output device 16, or the like.

Here, the wear main body 2 is worn by the user 1 who performs movements or the like, and thus the outer surface of the wear main body 2 often receives a contact. In this case, if the driving power increases or decreases every time the wear main body 2 receives a contact not intended by the user 1, an increase or decrease in the driving power not intended by the user 1 may occur. According to the embodiment, the driving power increases or decreases if a detection result indicating a second contact is received within the first time period t1 after reception of a detection result indicating a first contact. This is because, if the first contact is an unintended contact, there is a low probability that a second contact as the next contact is detected in a short time period from the first contact. On the other hand, if the user 1 wants to increase or decrease the driving power, it is natural that the first contact and the second contact are detected within a short time period. Thus, a detection result indicating the second contact is received only in the first time period t1 after reception of a detection result indicating the first contact, and thereby an increase or decrease in the driving power not intended by the user 1 can be prevented.

First Modification Example

The controller 8 may control an increase or decrease in the driving power of expansion/contraction driving of the assisting actuators 6 by changing the expansion/contraction length of the assisting actuators 6. That is, for example, in the case of increasing the driving power, the expansion/contraction length of the assisting actuators 6 may be increased. On the other hand, in the case of decreasing the driving power, the expansion/contraction length of the assisting actuators 6 may be decreased.

Alternatively, the controller 8 may control an increase or decrease in the driving power of the expansion/contraction driving of the assisting actuators 6 by changing the spring constant of the assisting actuators 6. That is, for example, in the case of increasing the driving power, the spring constant of the assisting actuators 6 may be increased. On the other hand, in the case of decreasing the driving power, the spring constant of the assisting actuators 6 may be decreased.

Second Modification Example

The first threshold TH1 may be automatically increased when the movement of a muscle of the user 1 is large. In many cases, a pressure value detected when the user 1 is moving hard is larger than a pressure value detected when the user 1 is not moving hard. For example, it is assumed that a pressure value detected when a hand of the user 1 who is running touches the wear main body 2 is larger than a pressure value detected when a hand of the user 1 who is walking touches the wear main body 2. In this case, if the first threshold TH1 is a specific fixed value, the touch may be detected or not detected as a first contact depending on the degree of movement of the user 1.

To avoid such variations, the controller 8 may increase the first threshold TH1 when the amount of change in the expansion/contraction length of the assisting actuators 6 per certain time period is a certain threshold or larger. Such a second modification example will be described in detail below.

Figures 35, 36:
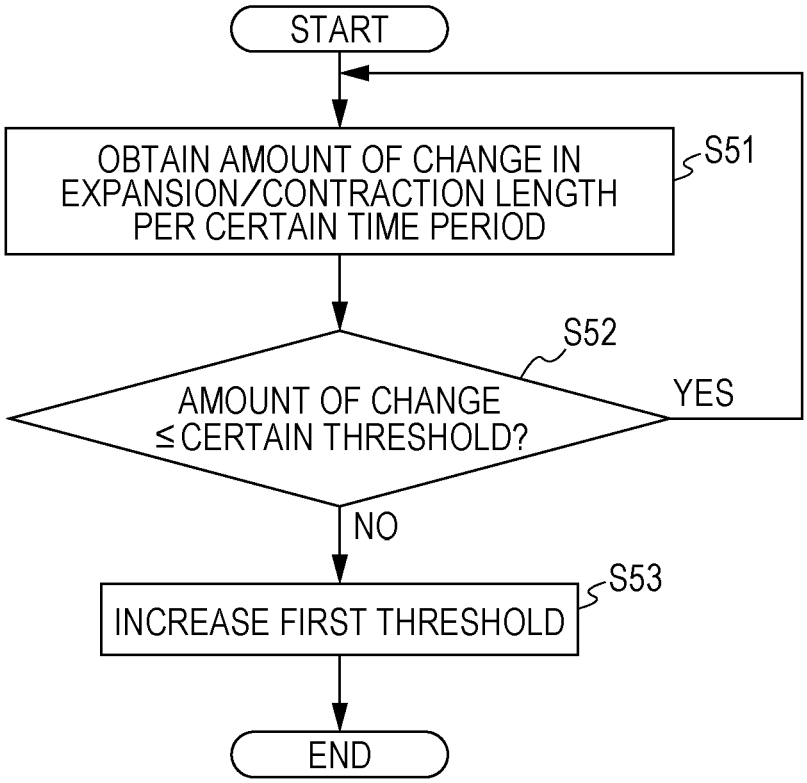
FIG. 35 is a flowchart of processing performed by the preliminary movement/command input movement determining unit or a receiving unit according to a second modification example.
FIG. 36 illustrates, in the form of a table, new thresholds set for amounts of change in an expansion/contraction length of assisting actuators.

FIG. 35 is a flowchart of processing in the preliminary movement/command input movement determining unit 8*h* or the receiving unit 8*f* according to the second modification example. FIG. 36 illustrates, in the form of a table, new thresholds set for the amounts of change in the expansion/contraction length of the assisting actuators 6. This piece of information is stored in the storage unit 8*a*.

Here, as in FIG. 37 described below, the pressure sensors 87, the driving unit 8*d*, and the storage unit 8*a* are connected to the preliminary movement/command input movement determining unit 8*h* or the receiving unit 8*f*. Information representing the amount of change in the expansion/contraction length of the assisting actuators 6 is input from the driving unit 8*d* to the preliminary movement/command input movement determining unit 8*h* or the receiving unit 8*f*.

In a case where the amount of change in the expansion/contraction length of the assisting actuators 6 per certain time period is equal to or larger than the fifth threshold TH5 stored in the storage unit 8*a*, it is estimated that the assisting actuators 6 are operating hard, and thus the preliminary movement/command input movement determining unit 8*h* or the receiving unit 8*f* sets the first threshold TH1 for determination of a preliminary movement to be increased. Specifically, the preliminary movement/command input movement determining unit 8*h* or the receiving unit 8*f* performs the following processing.

First, in step S51 in FIG. 35, the preliminary movement/command input movement determining unit 8*h* or the receiving unit 8*f* obtains an amount of change in the expansion/contraction length of the assisting actuators 6 per certain time period.

Subsequently, in step S52, the preliminary movement/command input movement determining unit 8*h* or the receiving unit 8*f* determines whether or not the obtained amount of change in the expansion/contraction length of the assisting actuators 6 per certain time period is equal to or smaller than a certain threshold (the fifth threshold TH5). If the preliminary movement/command input movement determining unit 8*h* or the receiving unit 8*f* determines that the amount of change in the expansion/contraction length of the assisting actuators 6 is larger than the fifth threshold TH5, it is estimated that the assisting actuators 6 are operating hard, and the processing proceeds to step S53. If the preliminary movement/command input movement determining unit 8*h* or the receiving unit 8*f* determines that the amount of change in the expansion/contraction length of the assisting actuators 6 is equal to or smaller than the fifth threshold TH5, it is estimated that the assisting actuators 6 are not operating hard, and the processing returns to step S51.

In step S53, the preliminary movement/command input movement determining unit 8*h* or the receiving unit 8*f* sets the first threshold TH1 to a larger value on the basis of the table stored in the storage unit 8*a* and the obtained amount of change in the expansion/contraction length. An example of the table stored in the storage unit 8*a* is illustrated in FIG. 36. In FIG. 36, new thresholds for obtained amounts of change in the expansion/contraction length are stored. In FIG. 36, "A" represents a value of the first threshold TH1 that is initially set. It means that the value of the first threshold TH1 is not increased when the amount of change is 10% or less, and that the value of the first threshold TH1 is increased 1.5 times when the amount of change is larger than 10%.

According to the second modification example, the value of the first threshold TH1 is increased when the amount of change per certain time period in the voltage value generated when a muscle is moved is a certain threshold (the fifth threshold TH5) or larger, that is, when the user 1 is moving hard. Accordingly, even when the user is moving hard, an increase or decrease in the driving power of expansion/contraction driving of the assisting actuators 6 that is not intended by the user 1 can be effectively prevented.

Third Modification Example

Figure 37:
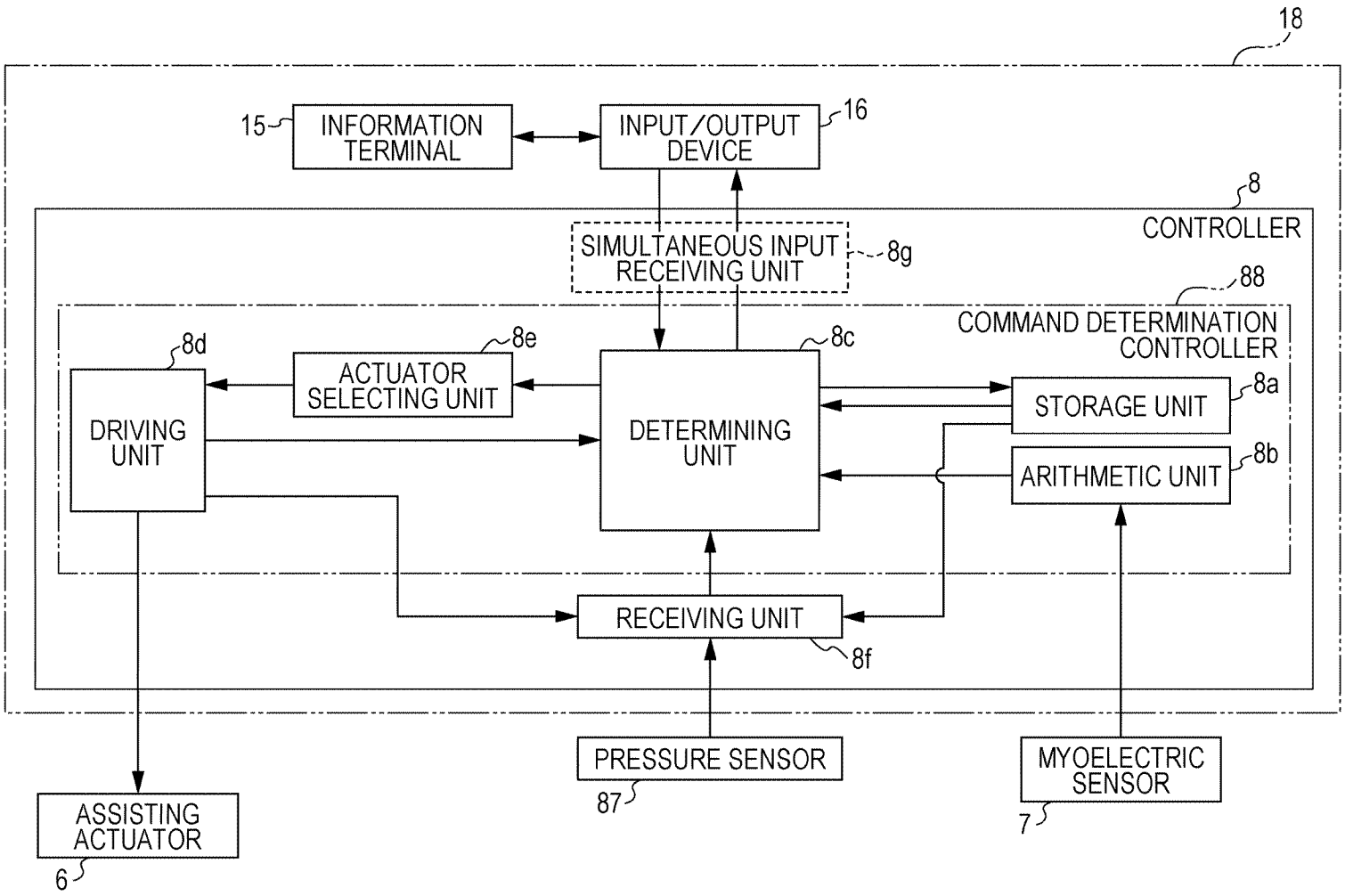
FIG. 37 is a block diagram related to an assist wear item according to a third modification example.

FIG. 37 is a block diagram related to an assist wear item 4 according to a third modification example. The difference from the block diagram in FIG. 4A is that the controller 8 is separated into the receiving unit 8*f* for determination of a preliminary movement (reception operation) and the command determination controller 88 for determination of a command input movement. Other than this point, the configuration and operation of the components illustrated in FIG. 37 are the same as those in FIG. 4A.

As illustrated in FIG. 37, the controller 8 includes the receiving unit 8*f* and the command determination controller 88. The command determination controller 88 includes the storage unit 8*a*, the arithmetic unit 8*b*, the determining unit 8*c*, the actuator selecting unit 8*e*, and the driving unit 8*d*.

The receiving unit 8*f* is capable of receiving outputs from all the pressure sensors 87, and determines, on the basis of the outputs from the pressure sensors 87, whether or not a first contact as a reception operation has been detected by the pressure sensors 87 and whether or not a second contact as an assist power adjustment operation has been detected by the pressure sensors 87. In the determination of whether or not the second contact has been detected, if it is determined that the second contact has been detected, the receiving unit 8*f* also determines the number of times the second contact has been detected. The determination of whether or not the second contact has been detected and determination of the number of times the second contact has been detected may be performed by the command determination controller 88, instead of the receiving unit 8*f*.

More specifically, the receiving unit 8*f* receives, as a reception operation, a detection result indicating a first contact by a plurality of pressure sensors 87 while the assisting actuators 6 are driven to expand and contract by the driving unit 8*d* of the command determination controller 88. While the assisting actuators 6 are driven to expand and contract actually means a period in which the assisting actuators 6 are driven to expand and contract or a period after a drive start signal for the assisting actuators 6 has been input. Specifically, when the drive start signal for the assisting actuators 6 is input from the driving unit 8*d* to the receiving unit 8*f*, the receiving unit 8*f* is able to determine that the assisting actuators 6 are being driven to expand and contract.

The reception period is limited in this way for the following reason.

A case where the user 1 wants to change (increase or decrease) the driving power of expansion/contraction driving of the assisting actuators 6 is, in many cases, a case where the user 1 wants to fine-tune the driving power of the expansion/contraction driving of the assisting actuators 6 when receiving assist power from the assist wear item 4. In other words, the user 1 is less likely to want to change (increase or decrease) the driving power of expansion/contraction driving of the assisting actuators 6 when not receiving assist power from the assist wear item 4.

Thus, a setting is made so that a detection result indicating a first contact can be received while the assisting actuators 6 are being driven to expand and contract, that is, while the user 1 is receiving assist power from the assist wear item 4. Accordingly, a detection result indicating a first contact is received while the user 1 is receiving assist power from the assist wear item 4, when the user 1 wants to fine-tune the assist power. As a result, in a situation where the user 1 is less likely to want to change (increase or decrease) the driving power of expansion/contraction driving of the assisting actuators 6, reception of a detection result indicating a first contact is prevented, and accordingly change (increase or decrease) in the driving power of expansion/contraction driving of the assisting actuators 6 not intended by the user 1 can be prevented.

Whether a detection result is a detection result indicating a first contact as a preliminary movement and whether a detection result is a detection result indicating a second contact as an assist power adjustment operation is determined by determining whether the movement of the user 1 is a movement that is not accidentally performed. For example, when the user 1 taps a portion of the wear main body 2 once, that movement may be determined as both an accidental light touch of a hand of the user 1 and an intended tap movement as a reception operation.

Thus, for example, if the first threshold TH1 for determination of a preliminary movement and the second threshold TH2 for determination of a command input movement are set to values equal to or larger than a pressure value that is detected in response to an unintended touch, change (increase or decrease) in the driving power of expansion/contraction driving of the assisting actuators 6 not intended by the user 1 can be prevented.

Fourth Modification Example

Figure 41:
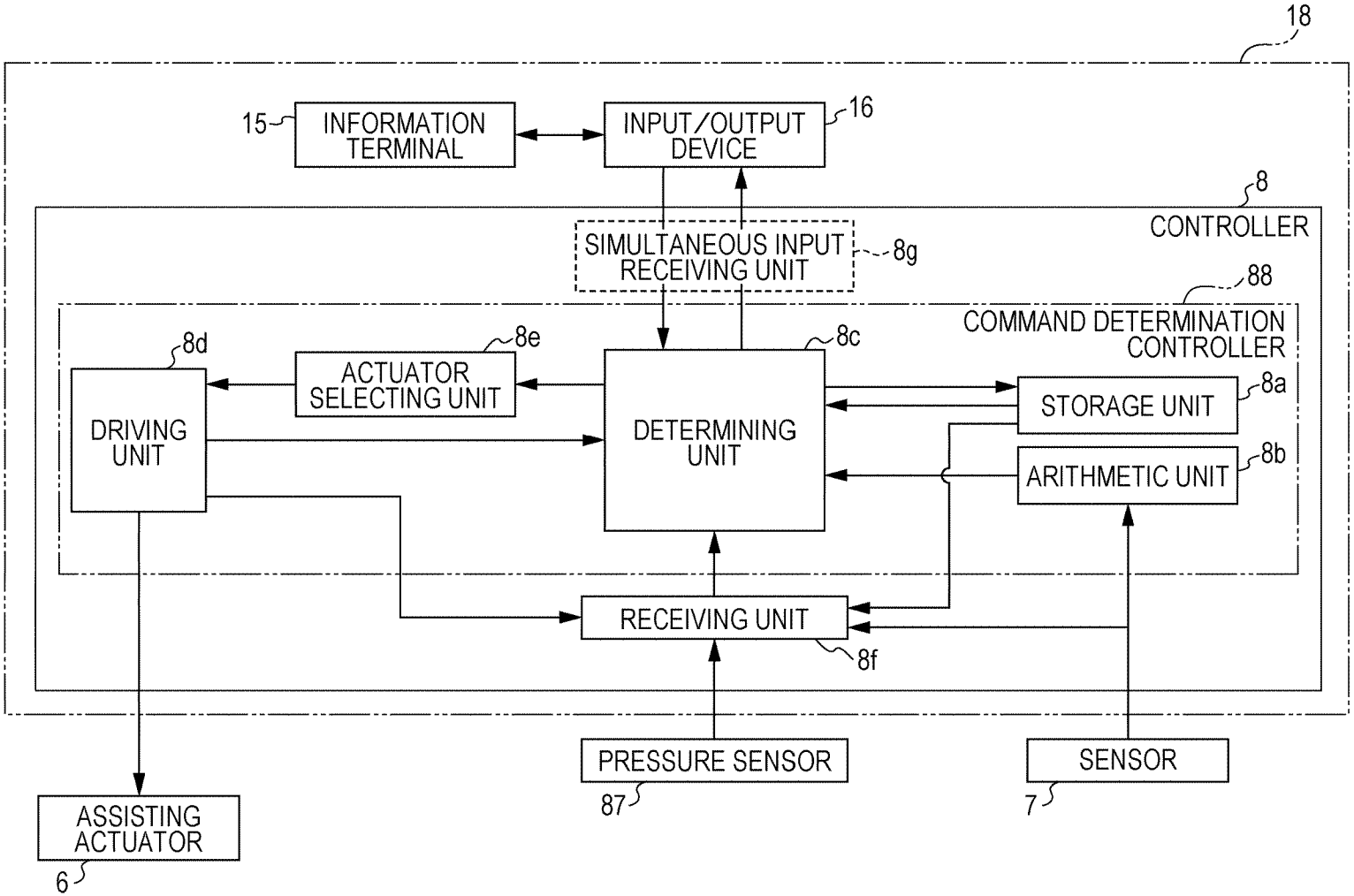
FIG. 41 is a block diagram related to an assist wear item according to a fourth modification example.

FIG. 41 is a block diagram related to an assist wear item 4 according to a fourth modification example. The difference from the block diagram in FIG. 37 is that a sensor 7 is provided instead of the myoelectric sensor 7 and that an output from the sensor 7 can be transmitted to the receiving unit 8*f*. The sensor 7 may be a myoelectric sensor, a distortion sensor, a gyro sensor, or an acceleration sensor. The assist wear item 4 may include both a myoelectric sensor and a distortion sensor, both a myoelectric sensor and a gyro sensor, or both a myoelectric sensor and an acceleration sensor.

The receiving unit 8*f* is configured to be able to detect a posture of a target portion to be assisted by using sensors, such as gyro sensors, selects a pressure sensor 87 on the basis of the detected posture, and determines, on the basis of an output of the selected pressure sensor 87, whether or not a second contact as an assist power adjustment operation has been detected. In the case of a periodic movement such as a walking movement, a current posture can be estimated on the basis of change in the waveform by using output of a myoelectric sensor or acceleration sensor alone, and determination can be performed similarly. For example, in the walking movement illustrated in FIG. 25, signal waveforms in the individual states A to G can be obtained from myoelectric sensors or acceleration sensors, and thus a current state can be determined through continuous monitoring. In FIG. 41, the components denoted by the same reference numerals except the receiving unit 8*f* have the same configuration and function as those described above.

Here, arrangement positions for various postures during an assist operation are assigned to the pressure sensors 87 that detect a second contact. For example, regarding a certain posture, the pressure sensors 87 arranged at positions where the driving power of the actuator is large are associated with that posture.

More specifically, while the assisting actuators 6 are being driven to expand and contract by the driving unit 8*d* of the command determination controller 88, the receiving unit 8*f* receives a detection result indicating a first contact from a plurality of pressure sensors 87 as a reception operation. Subsequently, a posture of a target portion to be assisted is detected on the basis of outputs from the sensors 7, outputs of the pressure sensors 87 associated with the detected posture are received by the receiving unit 8*f*, and it is determined whether or not a second contact has been detected. That is, only when the target portion to be assisted has a specific posture, the driving power of the actuators corresponding to the posture can be adjusted.

A description will be given by using the walking assist operation as an example with reference to FIG. 25. After a first contact has been detected, the current state, that is, which of the states A to G in walking, is detected by the sensors 7. For example, if it is configured to adjust the driving power of each actuator after the peak of the driving power, a second contact with the pressure sensors corresponding to the actuators on the front side of the right thigh is received only in the states B to C and the states E to F, a second contact with the pressure sensors corresponding to the actuators on the back side of the right thigh is received only in the states G to A, and determination of the contact is performed.

As described above, a case where the user 1 wants to change (increase or decrease) the driving power of expansion/contraction driving of the assisting actuators 6 is often a case where the user 1 wants to fine-tune the driving power of expansion/contraction driving of the assisting actuators 6 when receiving assist power from the assist wear item 4. At this time, the timing to input an amount of adjustment of the driving power may be limited to the most appropriate timing in the series of assist operation for each portion to be assisted, for example, during assist, just before assist, or just after assist, and accordingly incorrect input can be further reduced.

Further, with use of a posture to determine the timing, a determination can be made while eliminating the influence on the movement speed. For example, in the walking movement illustrated in FIG. 25, control can be performed in which a second contact on the front side of the right thigh is received only in a specific time period from state B or state E. However, if the specific time period is short, it is difficult to perform input. If the specific time period is long, the next peak comes within the specific time period if the walking speed is high. In such a case, there is no effect of reducing incorrect input by limiting the input timing. In this modification example, the input timing is determined on the basis of a posture, and thus incorrect input can be reduced while allowing appropriate input in accordance with the walking speed.

Fifth Modification Example

A plurality of contact sensors are not limited to pressure sensors and may be a plurality of small touch sensors that are arranged on the outer surface of the wear main body 2 and that detect an amount of change in capacitance. The touch sensors according to a fifth modification example can be illustrated in a small shape like the pressure sensors 87 illustrated in FIGS. 2 and 3. In the fifth modification example, the preliminary movement/command input movement determining unit 8*h* or the receiving unit 8*f* receives, as a detection result indicating a first contact, a detection result indicating an amount of change in a third capacitance which is a third threshold TH3 or larger from a plurality of touch sensors (not illustrated). Also, if the preliminary movement/command input movement determining unit 8*h* or the command determination controller 88 receives, as a detection result indicating a second contact, a detection result indicating an amount of change in a fourth capacitance which is a fourth threshold TH4 or larger from the touch sensors a certain number of times within the second time period t2 after the preliminary movement/command input movement determining unit 8*h* or the receiving unit 8*f* has received a detection result indicating a first contact, the preliminary movement/command input movement determining unit 8*h* or the command determination controller 88 performs control to increase or decrease the driving power of expansion/contraction driving of the assisting actuators 6.

With this configuration, touch sensors are used as contact sensors, an amount of change in the third capacitance which is the third threshold TH3 or larger is detected as a first contact, and an amount of change in the fourth capacitance which is the fourth threshold TH4 or larger is detected as a second contact. Here, in the case of increasing or decreasing the driving power of expansion/contraction driving of the assisting actuators 6, the user 1 is likely to touch the wear main body 2 more strongly than in the case of touching it accidentally. Thus, for example, if the third threshold TH3 and the fourth threshold TH4 are set to values that are equal to or larger than an amount of change in capacitance that is detected when the user 1 accidentally touches the wear main body 2, an increase or decrease in the driving power can be prevented when the user 1 accidentally touches the wear main body 2.

Sixth Modification Example

A simultaneous input receiving unit 8*g* may further be provided in the controller 8, and a simultaneous input mode may be provided so that the assist power for the left leg is automatically adjusted when the assist power for the right leg is adjusted through an assist power adjustment operation performed on the right leg.

That is, the assist wear item 4 includes a pair of attachments 20*a* and 20*b* that are worn on two symmetrical portions of the user 1. In the assist wear item 4, the individual assisting actuators 6 arranged in the attachment 20*a* (one of the symmetrical portions of the user 1) are associated with the individual assisting actuators 6 arranged in the attachment 20*b* (the other of the symmetrical portions of the user 1). The correspondence is stored in, for example, the storage unit 8*a*.

The controller 8 may include the simultaneous input receiving unit 8*g* whose function is turned on when a simultaneous input mode is selected by using the input/output device 16 in the operation device 18 and which performs a simultaneous input control operation. The simultaneous input control operation of the simultaneous input receiving unit 8*g* is enabled when the simultaneous input mode is selected by using the input/output device 16 in the operation device 18. In the simultaneous input control operation, the determining unit 8*c* is operated so that, when control is performed to increase or decrease the driving power of expansion/contraction driving of first assisting actuators 6 arranged in the attachment 20*a* (one of the symmetrical portions of the user 1), control is performed to increase or decrease the driving power of expansion/contraction driving of second assisting actuators 6 arranged in the attachment 20*b* (the other of the symmetrical portions of the user 1).

When a second contact is detected by third pressure sensors 87 that are arranged in the region corresponding to the attachment 20*a* (one of the symmetrical portions) after the simultaneous input receiving unit 8*g* has received a simultaneous input reception operation and when the determining unit 8*c* controls an increase or decrease in the driving power of expansion/contraction driving of the first assisting actuators 6 corresponding to the third pressure sensors 87, the determining unit 8*c* controls an increase or decrease in the driving power of expansion/contraction driving of the second assisting actuators 6 corresponding to the first assisting actuators 6 in the attachment 20*b* (the other of the symmetrical portions).

Figure 38:
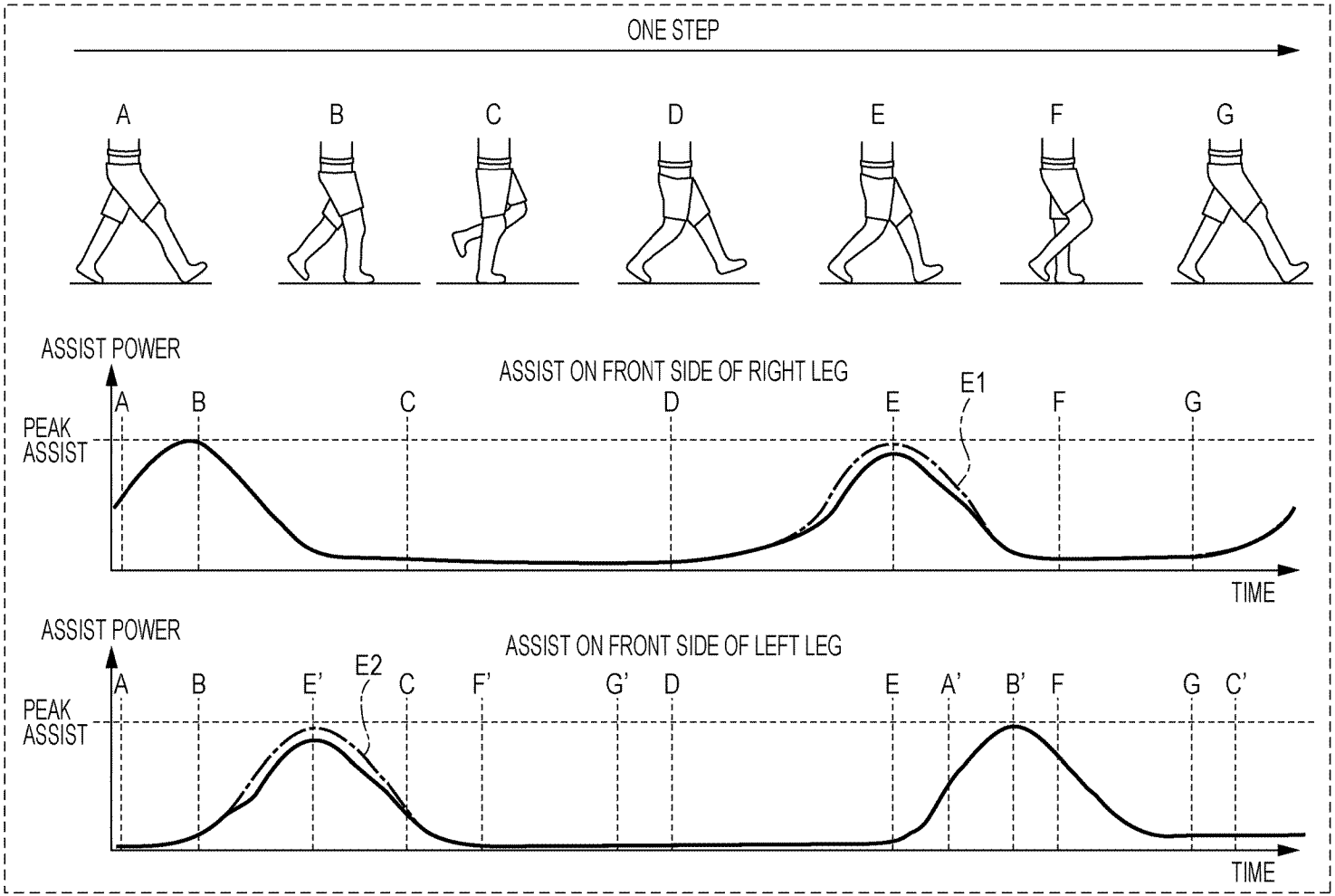
FIG. 38 is an explanatory diagram of a process of assisted walking using assist on the front side of a right leg and a left leg.

For example, in response to an assist power adjustment input for the assisting actuators 6 of one of the right and left legs, an assist power adjustment output for the assisting actuators 6 of the other leg is automatically generated, the generated output is transmitted to the corresponding assisting actuators 6, and an increase or decrease in the driving power of expansion/contraction driving of the assisting actuators 6 is controlled similarly. A specific example is illustrated in FIG. 38. FIG. 38 illustrates a process of assisted walking (phases A' to G') on the front side of the left leg corresponding to a process of assisted walking (phases A to G) on the front side of the right leg using the assist wear item 4 illustrated in FIG. 25. As illustrated in FIG. 38, the assist power reaches a peak in phase B in the process of assisted walking (phases A to G) on the front side of the right leg using the assist wear item 4, but the assist power is not at the peak in phase E. At this time, it is assumed that a preliminary movement and a command input movement are performed to increase the assist power in phase E to the peak, and control is performed to increase the assist power in phase E to the peak (see the chained line E1 in FIG. 38). With such control being performed, the determining unit 8*c* performs control to increase the assist power in phase E' on the front side of the left leg, corresponding to phase E on the front side of the right leg, to the peak, in response to an instruction provided from the simultaneous input receiving unit 8*g* (see the chained line E2 in FIG. 38).

With this configuration, in a case where assist pants that are worn to cover both legs are used as the assist wear item 4, if the driving power for one of the legs is increased or decreased, the driving power for the other leg is also increased or decreased. Accordingly, if an input is given for one of the legs, an input can also be given for the other leg simultaneously, and thus an input operation can be performed more easily.

Seventh Modification Example

Figure 39:
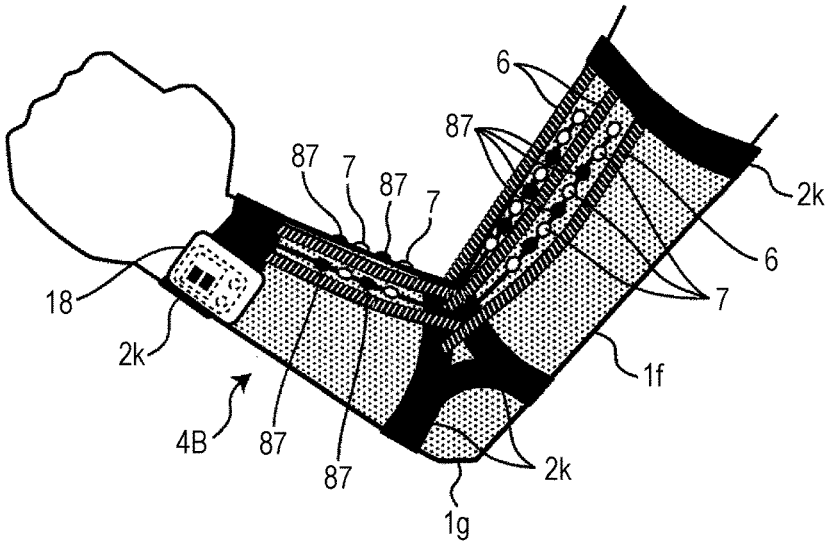
FIG. 39 is an explanatory diagram of an assist wear item for an elbow according to a seventh modification example.
Figure 40:
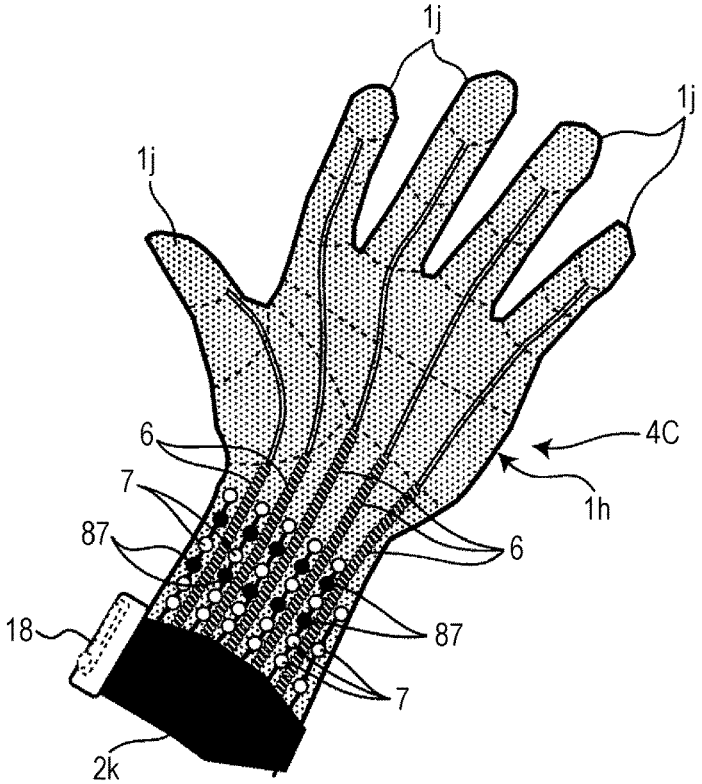
FIG. 40 is an explanatory diagram of an assist wear item for fingers according to the seventh modification example.

In the above-described embodiment, pants are used as an example of the wear main body 2, but the wear main body 2 is not limited thereto. As illustrated in FIGS. 39 and 40, an assist wear item 4B for an elbow that is worn on an arm 1*f* and assists bending and stretching movements of an elbow 1*g*, or an assist wear item 4C for fingers that is worn on a hand 1*h* and assists bending and stretching movements of fingers 1*j*, may be used. Also, the controller belt 3 is not limited to the one provided separately from the wear main body 2 as illustrated in FIG. 2. As illustrated in FIG. 39, the operation device 18 may be provided at an end portion of a wear main body 2B of the assist wear item 4B for an elbow.

As illustrated in FIG. 39, the assist wear item 4B for an elbow includes a plurality of assisting actuators 6 arranged along an axis direction of the arm if.

As illustrated in FIG. 40, the assist wear item 4C for fingers includes a plurality of assisting actuators 6 arranged along an axis direction of the arm if and the fingers 1*j*.

In FIGS. 39 and 40, black band portions are restraining portions 2*k* such as rubber belts.

Other than these examples, an assist wear item may also be applied to a knee, an ankle, toes, and so forth.

The present disclosure has been described on the basis of the embodiment and modifications. The present disclosure is of course not limited to the embodiment and modifications. The following is also included in the present disclosure.

Part of the controller 8 or the entire controller 8 is specifically a computer system constituted by a microprocessor, a read only memory (ROM), a random access memory (RAM), a hard disk unit, a display unit, a keyboard, a mouse, and so forth. The RAM or the hard disk unit stores a computer program. When the microprocessor operates in accordance with the computer program, the individual units implement their functions. Here, the computer program is constituted by combining a plurality of command codes indicating instructions for the computer to implement certain functions.

For example, a software program recorded on a recording medium such as a hard disk or a semiconductor memory is read and executed by a program executing unit such as a central processing unit (CPU), and thereby the individual components can be implemented.

The software that implements some or all of the components constituting the controller according to the embodiment or modification examples is the following program. That is, the program is executed by the controller of an assist wear item that is worn on a portion of a living body and that has an inner surface which is brought into contact with the portion, the assist wear item including a plurality of assisting actuators each of which is driven to expand and contract, the plurality of assisting actuators being linearly arranged along an expansion/contraction direction of a muscle at the portion in a case where the assist wear item is worn on the portion, a plurality of contact sensors each of which detects a contact with an outer surface of the assist wear item, and the controller, the program including:

receiving a detection result indicating a first contact from a first contact sensor among the plurality of contact sensors; and if a detection result indicating a second contact is received from a second contact sensor among the plurality of contact sensors within a first time period after reception of the detection result indicating the first contact, increasing or decreasing a driving power of expansion/contraction driving of an assisting actuator corresponding to the second contact sensor among the plurality of assisting actuators.

This program may be executed after being downloaded from a server or the like, or may be executed after being read out from a certain recording medium (for example, an optical disc such as a CD-ROM, a magnetic disk, or a semiconductor memory).

The program may be executed by a single computer or a plurality of computers. That is, centralized processing may be performed or distributed processing may be performed.

An aspect of the present disclose may also be expressed as follows. That is, an assist wear item according to another aspect of the present disclosure is an assist wear item including a wear main body that is worn on a portion of a living body and that has an inner surface which is brought into contact with the portion, the assist wear item including:

a plurality of assisting actuators each of which is driven to expand and contract, the plurality of assisting actuators being linearly arranged along an expansion/contraction direction of a muscle at the portion in a case where the wear main body is worn on the portion;

a plurality of contact sensors each of which detects a contact with an outer surface of the wear main body, the plurality of contact sensors being arranged on the wear main body;

a receiver that receives a detection result indicating a first contact from the plurality of contact sensors;

a command determination controller that receives information indicating the number of times a second contact has been detected by the plurality of contact sensors within a first time period after reception of the detection result indicating the first contact from the receiver; and a controller that performs control to increase or decrease a driving power of expansion/contraction driving of the assisting actuators in accordance with the information indicating the number of times a second contact has been detected received from the command determination controller.

Among the above-described various embodiments and modification examples, certain embodiments or certain modification examples may be appropriately combined so as to obtain respective effects. A combination of embodiments, a combination of modification examples, and a combination of an embodiment and a modification example are acceptable, and also a combination of features of different embodiments or modification examples is acceptable.

An assist wear item, a method for controlling a controller of an assist wear item, and a recording medium according to an embodiment of the present disclosure are capable of easily adjusting an increase or decrease in the driving power of expansion/contraction driving of assisting actuators in the case of assisting movements of a living body. Thus, the assist wear item, the method for controlling a controller of an assist wear item, and the recording medium according to the embodiment of the present disclosure can be used to adjust the assist power for various assist operations for assisting movements, such as an assist operation for lifting or carrying a heavy object, in which biceps brachii, back muscles, gluteus maximus, or femoral muscles are assisted to reduce heavy burden; a gripping power assist operation for assisting bending and stretching of fingers or a walking assist operation for assisting gluteus maximus or femoral muscles for rehabilitation or assist of reduced muscular power; an assist operation for muscles of the neck, shoulders, or back for massage; a muscle assist operation for a golf swing lesson or the like, in which muscles of the whole body are assisted for skill assist; and a muscle assist operation for developing muscles by imposing a load in the opposite direction of movements of the muscles for training.

What is claimed is:

1. An assist wear item configured to be worn on a portion of a living body and that has an inner surface which is brought into contact with the portion, the assist wear item comprising:

a plurality of assisting actuators each being configured to be driven to expand and contract, the plurality of assisting actuators being linearly arranged along an expansion or contraction direction of a muscle at the portion in a case where the assist wear item is worn on the portion, the plurality of assisting actuators including a first assisting actuator and a second assisting actuator;

a plurality of contact sensors each being configured to detect a contact with an outer surface of the assist wear item, the plurality of contact sensors including a first contact sensor provided between the first assisting actuator and the second assisting actuator, and a second contact sensor; and a controller that, when the controller receives a detection result indicating a first contact from the first contact sensor and receives a detection result indicating a second contact from the second contact sensor within a first time period after reception of the detection result indicating the first contact, increases or decreases a driving power of expansion or contraction driving of one assisting actuator among the plurality of assisting actuators proximate to the second contact sensor, wherein, when the controller receives a detection result indicating a contact with the outer surface of the assist wear item from the first contact sensor during expansion or contraction driving of the assisting actuator proximate to the second contact sensor, the controller determines that the contact with the outer surface of the assist wear item is the first contact.

2. The assist wear item according to claim 1, wherein, when the controller receives a detection result indicating the second contact during expansion driving of the assisting actuator proximate to the second contact sensor, the controller increases the driving power of the expansion driving of the assisting actuator.

3. The assist wear item according to claim 1, wherein, when the controller receives a detection result indicating the second contact during contraction driving of the assisting actuator proximate to the second contact sensor, the controller increases the driving power of the contraction driving of the assisting actuator.

4. The assist wear item according to claim 1, wherein, when the controller receives a detection result indicating the second contact from the second contact sensor a plurality of times, the controller increases or decreases the driving power in accordance with a total number of the plurality of times.

5. The assist wear item according to claim 4, wherein the controller determines a detection result indicating the second contact received within a second time period from when a detection result indicating the second contact is first received to be a valid signal.

6. The assist wear item according to claim 1, wherein a change in the driving power of the expansion or contraction driving of the assisting actuator proximate to the second contact sensor is controlled by changing an expansion or contraction range of the assisting actuator proximate to the second contact sensor.

7. The assist wear item according to claim 1, wherein a spring constant of the assisting actuator proximate to the second contact sensor is controlled based on an increase or decrease in the driving power of the assisting actuator proximate to the second contact sensor.

8. The assist wear item according to claim 1, wherein the second contact sensor is identical to the first contact sensor.

9. The assist wear item according to claim 1, wherein the second contact sensor is different from the first contact sensor.

10. The assist wear item according to claim 1, wherein the plurality of contact sensors are a plurality of pressure sensors each of which detects a pressure value of a pressure applied to the outer surface of the assist wear item, and when the controller receives a detection result indicating a pressure value which is equal to a first threshold or greater than a pressure value from each of the plurality of pressure sensors, the controller determines that contact with the outer surface of the assist wear item has been detected.

11. The assist wear item according to claim 10, wherein, when the controller receives the detection result indicating the first contact, a detection result indicating a first pressure value which is equal to a second threshold or greater than a pressure value from a first pressure sensor among the plurality of pressure sensors and receives the detection result indicating the second contact, a detection result indicating a second pressure value which is equal to a third threshold or greater than a pressure value from a second pressure sensor among the plurality of pressure sensors within the first time period after reception of the detection result indicating the first pressure value, the controller increases or decreases the driving power of expansion or contraction driving of the assisting actuator proximate to the second pressure sensor among the plurality of assisting actuators.

12. The assist wear item according to claim 1, further comprising:

a plurality of myoelectric sensors each of which detects a voltage value of a voltage generated when the muscle at the portion is moved, the plurality of myoelectric sensors being arranged at positions where the plurality of assisting actuators are proximate to the positions, wherein the controller causes the plurality of assisting actuators to be driven to expand and contract in accordance with the individual voltage values detected by the plurality of myoelectric sensors.

13. The assist wear item according to claim 12, wherein, when an amount of change in the voltage value per unit time detected by a first myoelectric sensor among the plurality of myoelectric sensors is equal to or greater than a fourth threshold, the controller increases a first threshold that is used by a pressure sensor proximate to the first myoelectric sensor to detect a pressure value.

14. The assist wear item according to claim 1, wherein the plurality of contact sensors are a plurality of touch sensors each of which detects an amount of change in capacitance, the plurality of touch sensors being arranged on the outer surface of the assist wear item, and when the controller receives a detection result indicating an amount of change in capacitance that is equal to or greater than a fifth threshold from each of the plurality of touch sensors, the controller determines that a contact with the outer surface of the assist wear item has been detected.

15. The assist wear item according to claim 1, wherein the assist wear item includes a pair of attachments that are configured to be respectively worn on two symmetrical portions of the living body, each of a plurality of assisting actuators arranged on a first attachment in the pair of attachments is associated with one of a plurality of assisting actuators arranged on a second attachment in the pair of attachments, and when the driving power of expansion or contraction driving of a first assisting actuator arranged on the first attachment is increased or decreased, the controller increases or decreases, in conjunction with the increase or decrease in the first assisting actuator, the driving power of expansion or contraction driving of a second assisting actuator arranged on the second attachment and proximate to the first assisting actuator.

16. A control method for a controller of an assist wear item configured to be worn on a portion of a living body and that has an inner surface which is brought into contact with the portion, providing the assist wear item comprising:

a plurality of assisting actuators each being configured to be driven to expand and contract, the plurality of assisting actuators being linearly arranged along an expansion or contraction direction of a muscle at the portion in a case where the assist wear item is worn on the portion, the plurality of assisting actuators including a first assisting actuator and a second assisting actuator;

a plurality of contact sensors each being configured to detect a contact with an outer surface of the assist wear item, the plurality of contact sensors including a first contact sensor provided between the first assisting actuator and the second assisting actuator and a second contact sensor; and the controller, the control method comprising:

receiving a detection result indicating a first contact from the first contact sensor;

when a detection result indicating a second contact is received from the second contact sensor within a first time period after reception of the detection result indicating the first contact, increasing or decreasing a driving power of expansion or contraction driving of an assisting actuator proximate to the second contact sensor among the plurality of assisting actuators; and when a detection result indicating a contact with the outer surface of the assist wear item is received from the first contact sensor during expansion or contraction driving of the assisting actuator proximate to the second contact, determining that the contact with the outer surface of the assist wear item is the first contact.

17. A recording medium storing a control program that causes a device including a processor to perform processing executed by a controller of an assist wear item configured to be worn on a portion of a living body and that has an inner surface which is brought into contact with the portion, the recording medium being nonvolatile and computer-readable, the assist wear item comprising:

a plurality of assisting actuators each being configured to be driven to expand and contract, the plurality of assisting actuators being linearly arranged along an expansion or contraction direction of a muscle at the portion in a case where the assist wear item is worn on the portion, the plurality of assisting actuators including a first assisting actuator and a second assisting actuator;

a plurality of contact sensors each being configured to detect a contact with an outer surface of the assist wear item, the plurality of contact sensors including a first contact sensor provided between the first assisting actuator and the second assisting actuator and a second contact sensor; and the controller, the processing executed by the controller comprising:

receiving a detection result indicating a first contact from the first contact sensor;

when a detection result indicating a second contact is received from the second contact sensor within a first time period after reception of the detection result indicating the first contact, increasing or decreasing a driving power of expansion or contraction driving of an assisting actuator proximate to the second contact sensor among the plurality of assisting actuators; and when a detection result indicating a contact with the outer surface of the assist wear item is received from the first contact sensor during expansion or contraction driving of the assisting actuator proximate to the second contact, determining that the contact with the outer surface of the assist wear item is the first contact.

18. The assist wear item according to claim 1, further comprising:

a plurality of sensors that detect a posture of the portion, wherein, based on an output of the sensor, the controller selects the second contact sensor in accordance with the posture detected by the sensors, and detects the second contact based on an output from the selected second contact sensor.

19. An assist wear item comprising:

sensors that output an initial signal and one or more signals when the sensors detect a plurality of contacts with the assist wear item;

an actuator that changes a degree of contraction in accordance with a control signal; and a controller that receives the initial signal and the one or more signals and that generates the control signal when the initial signal is a valid initial signal and a first signal included in the one or more signals is a valid first signal, wherein the control signal includes information indicating the degree of contraction, the information is generated based on a total number of valid signals among the one or more signals, and the degree of contraction indicated by the information increases as the total number of valid signals increases, one of conditions is a first condition in which the first signal is the first valid signal when a time period between the initial signal and the first signal is within a first time period, another one of the conditions is a second condition in which a signal included in the one or more signals except the first signal is a second valid signal when a time period between the first signal and the second signal is within a second time period, and wherein the first time period is longer than the second time period.

20. The assist wear item according to claim 19, wherein, when the second valid signal is subsequent to a first valid signal included in the one or more signals, a third condition of the conditions in which the signal is a valid third signal is when first time period is longer than a time period between the second valid signal and the third valid signal.

* * * * *